US012648639B1

(12) United States Patent
Eberlein et al.

(10) Patent No.: US 12,648,639 B1
(45) Date of Patent: Jun. 9, 2026

(54) WORKSTATION ASSEMBLIES INCLUDING ROTATING FURNITURE AFFORDANCES

(71) Applicant: Steelcase Inc., Grand Rapids, MI (US)

(72) Inventors: David Eberlein, Hudsonville, MI (US); Jeffrey Simon, Portland, MI (US); Robert Scheper, Grand Rapids, MI (US); Gregory Goosen, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 149 days.

(21) Appl. No.: 18/782,365

(22) Filed: Jul. 24, 2024

Related U.S. Application Data

(60) Provisional application No. 63/519,057, filed on Aug. 11, 2023, provisional application No. 63/531,229, filed on Aug. 7, 2023.

(51) Int. Cl.

| | |
|---|---|
| ***A47B 87/00*** | (2006.01) |
| ***A47B 9/00*** | (2006.01) |
| ***A47B 13/00*** | (2006.01) |
| ***A47B 13/08*** | (2006.01) |
| ***A47B 13/10*** | (2006.01) |
| ***A47B 96/04*** | (2006.01) |

(52) U.S. Cl.
CPC ..... *A47B 87/002* (2013.01); *A47B 9/00* (2013.01); *A47B 13/003* (2013.01); *A47B 13/081* (2013.01); *A47B 13/10* (2013.01); *A47B 96/04* (2013.01); *A47B 2200/0051* (2013.01); *A47B 2200/0066* (2013.01)

(58) Field of Classification Search
CPC ..... A47B 87/002; A47B 9/00; A47B 11/00; A47B 13/003; A47B 13/10
See application file for complete search history.

(56) References Cited

U.S. PATENT DOCUMENTS

| | | | |
|---|---|---|---|
| 1,023,620 | A | 4/1912 | Burge |
| 1,053,357 | A | 2/1913 | Carter |
| 1,445,726 | A | 2/1923 | Soros |

(Continued)

FOREIGN PATENT DOCUMENTS

| | | |
|---|---|---|
| AU | 48399/85 | 4/1986 |
| AU | 2017200398 A1 | 2/2017 |

(Continued)

OTHER PUBLICATIONS

U.S. Pat. No. 197,690, S. B. Tizzard, Wall-Fender for Furniture, Nov. 27, 1877.

*Primary Examiner* — Daniel J Rohrhoff
(74) *Attorney, Agent, or Firm* — Quarles & Brady LLP

(57) ABSTRACT

A reconfigurable assembly includes a stationary base and a workstation including a worktop supported by the base. A mounting assembly secures the workstation to the base for rotation about a vertical axis through the base and worktop, and includes a first coupler forming first and second limit surfaces within an arcuate path about the vertical axis that define a limit space of a first length, and a second coupler that forms first and second stop surfaces that define a limit space of a second length along the arcuate path. The workstation is rotatable about the vertical axis between a first limit position where the first stop surface contacts the first limit surface and a second limit position where the second stop surface contacts the second limit surface.

20 Claims, 60 Drawing Sheets

(56) References Cited

U.S. PATENT DOCUMENTS 1,889,783 A 12/1932 Harman
2,016,850 A 10/1935 Bittermann
2,103,651 A 12/1937 Thomas
2,230,444 A 2/1941 Balster
2,245,951 A 6/1941 Agee
2,495,494 A 1/1950 Ziegenfuss
2,554,852 A 5/1951 Bryan et al.
2,605,155 A 7/1952 Lewis
2,625,986 A 1/1953 Siff
2,630,581 A 3/1953 Ziegenfuss
2,658,553 A 11/1953 Stewart
2,681,840 A 6/1954 Miller
2,694,611 A 11/1954 Lorber
2,705,179 A 3/1955 Hodgin
2,717,699 A 9/1955 Spindler et al.
2,724,923 A 11/1955 Weir
2,734,952 A 2/1956 Austin
2,783,108 A 2/1957 Walker
2,827,176 A 3/1958 Ready, Jr.
2,899,691 A 8/1959 Davis et al.
2,988,413 A 6/1961 Bergen
3,002,787 A 10/1961 Ziegenfuss
3,048,461 A 8/1962 Peterson
3,055,017 A 9/1962 Thierfelder
3,082,034 A 3/1963 Silver
3,146,025 A 8/1964 Heaney
3,179,071 A 4/1965 Johnston
3,191,811 A 6/1965 McBroom
3,212,748 A 10/1965 Faurot
3,321,778 A 5/1967 Vogel
3,322,389 A 5/1967 Janin
3,322,460 A 5/1967 Leverman
3,632,180 A 1/1972 Hauville
3,726,535 A 4/1973 Longato
3,844,633 A 10/1974 Frederick
3,879,084 A 4/1975 Jones
3,883,202 A 5/1975 Konig
3,908,565 A 9/1975 Burnett
3,964,401 A 6/1976 Gutmann, Jr. et al.
4,053,193 A 10/1977 Grover et al.
4,067,606 A 1/1978 Desmoulins nee Fouchereau et al.
4,090,754 A 5/1978 Kavis
4,145,097 A 3/1979 Naess et al.
4,161,345 A 7/1979 Begun
4,180,298 A 12/1979 Borgerson, Jr.
4,272,136 A 6/1981 Sengua
4,323,291 A 4/1982 Ball
4,337,988 A 7/1982 Schenck
4,353,518 A 10/1982 Taylor et al.
4,365,561 A 12/1982 Tellier et al.
4,382,642 A 5/1983 Burdick
4,433,884 A 2/1984 Edwards et al.
4,478,467 A 10/1984 Tyndall
4,511,158 A 4/1985 Varga et al.
4,527,555 A 7/1985 Ruf
4,546,708 A 10/1985 Wilburth
4,560,215 A 12/1985 Turner
4,561,619 A 12/1985 Robillard et al.
4,567,835 A 2/1986 Reese et al.
4,577,187 A 3/1986 Barr et al.
4,637,666 A 1/1987 Worrell et al.
4,643,547 A 2/1987 Collins et al.
4,645,167 A 2/1987 Hardwick
4,709,971 A 12/1987 Leeds et al.
4,831,791 A 5/1989 Ball
4,852,500 A 8/1989 Ryburg et al.
4,945,592 A 8/1990 Sims et al.
5,044,284 A 9/1991 Gross
5,323,695 A 6/1994 Borgman et al.
5,558,418 A 9/1996 Lambright et al.
5,568,775 A 10/1996 Rizzi et al.
5,584,546 A 12/1996 Gurin et al.
5,606,919 A 3/1997 Fox et al.
5,630,566 A 5/1997 Case
5,676,068 A 10/1997 Kallander
5,704,298 A * 1/1998 Corpuz, Jr. ..... A47B 21/00 108/50.01
5,704,299 A 1/1998 Corpuz, Jr. et al.
5,752,449 A 5/1998 Simon et al.
5,842,425 A 12/1998 van der Aa
5,898,961 A 5/1999 Ambach et al.
5,943,966 A 8/1999 Machado et al.
5,957,529 A 9/1999 Schrewe
5,967,058 A 10/1999 Ambrose et al.
5,988,076 A 11/1999 Vander Park
6,048,044 A 4/2000 Biggel et al.
6,062,148 A 5/2000 Hodge et al.
6,098,936 A 8/2000 Birrell
6,102,475 A 8/2000 Hamann
D431,739 S 10/2000 Rives
6,161,487 A * 12/2000 Chang ..... A47B 21/00 108/50.01
6,170,410 B1 1/2001 Gioacchini et al.
6,189,268 B1 2/2001 Carr et al.
6,247,772 B1 6/2001 Tuttle et al.
6,298,794 B1 10/2001 Brown et al.
6,357,086 B1 3/2002 Ye
6,374,548 B1 4/2002 Ruedinger et al.
6,397,762 B1 6/2002 Goldberg et al.
6,425,631 B1 7/2002 Lin
6,453,826 B1 9/2002 Fookes et al.
6,497,184 B1 * 12/2002 Whitesitt ..... A47B 17/065 108/65
6,536,357 B1 3/2003 Hiestand
6,543,369 B1 4/2003 Swensson et al.
6,588,346 B1 7/2003 Bockheim et al.
6,595,144 B1 7/2003 Doyle
6,598,542 B2 7/2003 Goldberg et al.
6,712,008 B1 3/2004 Habenicht et al.
6,715,722 B2 4/2004 Roberts
6,796,536 B1 9/2004 Sevier, IV
6,805,060 B2 10/2004 Nicoletti
6,935,250 B1 8/2005 Arnold
6,997,114 B2 2/2006 Chang
7,032,523 B2 4/2006 Forslund, III et al.
7,082,882 B2 8/2006 Heimbrock
7,118,080 B2 10/2006 Chan et al.
7,125,088 B2 10/2006 Haberman
7,178,469 B2 2/2007 Goza
7,357,086 B2 * 4/2008 Petrick ..... A47B 21/00 108/50.02
D569,142 S 5/2008 Burak
D573,820 S 7/2008 Burak
7,640,866 B1 1/2010 Schermerhorn
7,735,788 B2 6/2010 Newkirk et al.
7,827,920 B2 11/2010 Beck et al.
7,836,834 B2 11/2010 Brault et al.
7,845,601 B1 12/2010 Culpepper et al.
7,862,341 B2 1/2011 Durand et al.
7,865,983 B2 1/2011 Newkirk et al.
7,938,372 B2 5/2011 MacLeod
8,051,782 B2 11/2011 Nethken et al.
8,225,723 B2 7/2012 Nakamura et al.
8,292,250 B2 * 10/2012 Jines ..... G10G 7/00 248/441.1
8,424,828 B1 4/2013 Roccasalva et al.
8,522,695 B2 9/2013 Ellegaard
8,573,554 B2 11/2013 Jines et al.
8,733,719 B2 5/2014 Gaal et al.
8,991,320 B2 3/2015 DesRoches et al.
9,167,894 B2 * 10/2015 DesRoches ..... A47B 21/00
9,179,768 B2 11/2015 Stubbs et al.
9,271,569 B2 3/2016 Zaccai et al.
9,404,616 B2 8/2016 Bally
9,521,901 B2 12/2016 Dalebout
9,717,328 B1 8/2017 Tsai
9,839,742 B2 12/2017 Pryor et al.
10,045,611 B1 * 8/2018 Siebert ..... A47B 87/002
10,314,391 B2 6/2019 DesRoches et al.
10,390,611 B2 8/2019 Lee
10,524,568 B2 1/2020 Lin
10,548,395 B2 2/2020 DesRoches et al.
10,568,414 B1 2/2020 Glattstein

(56) References Cited

U.S. PATENT DOCUMENTS

| | | | | |
|---|---|---|---|---|
| 10,602,840 | B2 | 3/2020 | Ergun et al. | |
| D882,997 | S | 5/2020 | Powell et al. | |
| 10,709,236 | B2 | 7/2020 | Patrick et al. | |
| 10,736,419 | B2 | 8/2020 | Koulizakis | |
| 10,842,266 | B2 * | 11/2020 | Matthai | A47B 83/001 |
| 10,866,578 | B1 | 12/2020 | Labrosse et al. | |
| 11,007,102 | B2 | 5/2021 | Patmore et al. | |
| 11,076,688 | B2 | 8/2021 | Ergun et al. | |
| 11,141,240 | B2 | 10/2021 | Bally et al. | |
| 11,369,195 | B2 | 6/2022 | Battey et al. | |
| 11,395,543 | B2 * | 7/2022 | Reddig | A47B 13/081 |
| 11,503,905 | B2 | 11/2022 | Matthai et al. | |
| 11,633,040 | B2 | 4/2023 | Beasley et al. | |
| 11,969,087 | B1 * | 4/2024 | Kayali | A47B 21/06 |
| 2002/0011193 | A1 * | 1/2002 | Beck | A47B 83/001 108/50.01 |
| 2002/0073900 | A1 | 6/2002 | Birsel et al. | |
| 2003/0213415 | A1 | 11/2003 | Ross et al. | |
| 2004/0216647 | A1 | 11/2004 | Cvek | |
| 2006/0284529 | A1 * | 12/2006 | Milutinovics | A47B 9/10 312/319.8 |
| 2007/0151489 | A1 | 7/2007 | Byrne | |
| 2007/0267902 | A1 | 11/2007 | Hill et al. | |
| 2008/0035034 | A1 * | 2/2008 | Morita | A47B 83/001 108/143 |
| 2008/0231091 | A1 | 9/2008 | Goranson | |
| 2008/0289545 | A1 | 11/2008 | Picchio | |
| 2010/0258040 | A1 | 10/2010 | Coble | |
| 2010/0277043 | A1 | 11/2010 | Bloch et al. | |
| 2013/0284075 | A1 * | 10/2013 | Reithler | A47B 21/03 108/91 |
| 2014/0312754 | A1 | 10/2014 | Hecht et al. | |
| 2016/0235193 | A1 | 8/2016 | Reddig | |
| 2019/0350358 | A1 * | 11/2019 | Knapp | A47B 21/06 |
| 2020/0128951 | A1 * | 4/2020 | Anderson | A47B 21/02 |
| 2022/0166482 | A1 * | 5/2022 | Yu | H04B 7/0695 |
| 2022/0312956 | A1 | 10/2022 | Reddig et al. | |

FOREIGN PATENT DOCUMENTS

| | | | |
|---|---|---|---|
| CN | 2112314 | U | 8/1992 |
| CN | 100434016 | C | 11/2008 |
| CN | 103462362 | A | 12/2013 |
| CN | 203913864 | U | 11/2014 |
| CN | 204120470 | U | 1/2015 |
| CN | 208821858 | U | 5/2019 |
| CN | 109953482 | A | 7/2019 |
| DE | 1654580 | A1 | 2/1971 |
| DE | 2944555 | A1 | 5/1981 |
| DE | 4112180 | A1 | 10/1992 |
| DE | 4428390 | A1 | 2/1996 |
| DE | 29617925 | U1 | 1/1997 |
| DE | 29719679 | U1 | 1/1998 |
| DE | 29808054 | U1 | 7/1998 |
| DE | 29907084 | U1 | 7/1999 |
| DE | 29922626 | U1 | 3/2000 |
| DE | 19931126 | A1 | 5/2000 |
| DE | 10030674 | A1 | 1/2002 |
| DE | 20310447 | U1 | 9/2003 |
| DE | 202010014601 | U1 | 1/2012 |
| EP | 0145410 | A2 | 6/1985 |
| EP | 0332096 | A2 | 9/1989 |
| EP | 0400407 | A1 | 12/1990 |
| EP | 1514494 | A1 | 3/2005 |
| FR | 1463176 | A | 6/1966 |
| FR | 2544269 | A1 | 10/1984 |
| FR | 2717677 | A1 | 9/1995 |
| GB | 2125693 | A | 3/1984 |
| GB | 2319470 | A | 5/1998 |
| GB | 2358795 | A | 8/2001 |
| JP | 2005102742 | A | 4/2005 |
| JP | 4554099 | B2 | 9/2010 |
| JP | 6448059 | B2 | 1/2019 |
| JP | 6598053 | B2 | 10/2019 |
| JP | 6666204 | B2 | 3/2020 |
| JP | 6787052 | B2 | 11/2020 |
| JP | 6827703 | B2 | 2/2021 |
| WO | 9419987 | A1 | 9/1994 |
| WO | 9746138 | A1 | 12/1997 |
| WO | 2004004621 | A2 | 1/2004 |
| WO | 2010127425 | A1 | 11/2010 |
| WO | 2011043659 | A1 | 4/2011 |
| WO | 2011098350 | A1 | 8/2011 |
| WO | 2014151755 | A2 | 9/2014 |

* cited by examiner

WORKSTATION ASSEMBLIES INCLUDING ROTATING FURNITURE AFFORDANCES

CROSS-REFERENCE TO RELATED APPLICATIONS

This application is related to and claims priority to provisional U.S. patent application No. 63/531,229 which was filed on Aug. 7, 2023 and which is titled "System for Workstation Assemblies Including Rotating Worktops" and also is related to and claims priority to provisional U.S. patent application Ser. No. 63/519,057 which was filed on Aug. 11, 2023 and which is also titled "System for Workstation Assemblies Including Rotating Worktops", each of which is incorporated herein by reference in its entirety.

BACKGROUND OF THE DISCLOSURE

The present disclosure generally relates to devices and systems for providing affordances to workers in a workspace allowing workers to adjust orientations of furniture within the workspace to achieve varying degrees of privacy and to meet other user preferences.

Many modern workspaces are designed to foster collaboration, while maximizing use of floor space by increasing a density of workstations in each facility area. In some cases, workspaces no longer include designated spaces for specific individuals, but rather, provide shareable workspaces that can be usable by any worker in a workspace. In some cases, including where workers have hybrid work arrangements, it can be cost-prohibitive to maintain a designated space for individual workers that is only occasionally occupied.

In some cases, workspaces are designed with high-density workstations, with workstations arranged in rows where workers occupy workspaces next to adjacent workers along each row (e.g., rather than cubicle arrangements, individual offices, etc.). In some cases, a row can include a continuous, or semi-continuous worksurface (e.g., a table, desk, or series thereof), and workers can work at workstations along the worksurface, with little separation between the workers and their respective equipment (e.g., screens, keyboards, laptops, workstation tabletops, etc.). These types of systems can advantageously increase collaboration between team members seated along a common worksurface, and adjacent each other. Unfortunately, these types of systems afford limited privacy to workers and often further subject workers to relatively high levels of disruption and distraction from other workers seated along the worksurface, or opposite the worker on another side of the worksurface.

One important object of the disclosed workstation systems is to provide useful systems and devices to afford workers in high-density workspaces desired levels of privacy according to individual worker preferences and working requirements.

In some embodiments, another object is to afford workstation users the ability to adjust workstation orientation with respect to other proximate workstations thereby increasing or decreasing privacy level while still limiting the amount of workstation movement that is possible. By limiting the amount of workstation adjustment and orientations several advantages result. First, workstations remain generally at their locations and cannot be moved to locations where the workstations are hard to locate. Second, the overall appearance of workstation assemblies remains at least somewhat organized which has certain aesthetic advantages. Third, in some cases movement limits reduce or eliminate the possibility that a user will move a workstation or other affordance into a position where system components collide such that the components could be damaged or aesthetically compromised.

Another object of at least some disclosed embodiments it to enable workstation users to orient their workstations for collaboration with users of either first or second adjacent other workstations or to place a workstation in a semi-private orientation.

Other objects and advantages are contemplated and should be apparent from the disclosure that follows.

SUMMARY OF THE DISCLOSURE

Some embodiments of the present disclosure include a reconfigurable assembly comprising a stationary base, a workstation including a worktop forming a worksurface and an undersurface, the workstation supported by the base with the worksurface in a substantially horizontal orientation, a mounting assembly securing the workstation to the base for rotation about a vertical axis passing through the base and the worktop, the mounting assembly including a first coupler secured to the base and a second coupler secured to the workstation wherein the first coupler forms first and second stationary limit surfaces within an arcuate path about the vertical axis that define a limit space having a first length dimension along the arcuate path, the second coupler forms first and second stop surfaces within the limit space having a second length dimension along the arcuate path that is less than the first dimension with the first and second stop surfaces facing the first and second limit surfaces along the arcuate path and wherein, the workstation is rotatable about the vertical axis between a first limit position where the first stop surface contacts the first limit surface and a second limit position where the second stop surface contacts the second limit surface.

In some cases the workstation further includes a leg having upper and lower ends, the lower end of the leg including the second coupler and affixed to the base for rotation about the vertical axis, the worktop secured to the upper end of the leg. In some embodiments the leg is height adjustable. In some cases the leg includes a lower leg member and an upper leg member, the lower leg member affixed to the base for rotation about the vertical axis, the upper leg member telescopically mounted to the lower leg member for movement between extended and contracted positions.

In some cases an edge defines the shape of the worktop, the edge including a rear edge having a first substantially straight rear edge portion and a second substantially straight rear edge portion that form an obtuse angle and an apex adjacent the obtuse angle, the leg mounted to the undersurface of the worktop adjacent the apex. In some embodiments the first substantially straight rear edge portion is substantially parallel to a first vertical plane when the workstation is in the first limit position and the second substantially straight rear edge portion is substantially parallel to the first vertical plane when the workstation is in the second limit position. In some cases the edge further includes first and second substantially straight lateral edges that extend from distal ends of the first and second rear edge portions toward a front edge of the worktop and, wherein, the first and second substantially straight lateral edges angle toward each other from the rear edge toward the front edge such that the first lateral edge is substantially perpendicular to the first vertical plane when the worktop is in the first limit position and the second lateral edge is substantially perpendicular to the first vertical plane when the worktop is in the second limit position.

In some embodiments the leg is a first leg, and the assembly further includes at least a second leg spaced from the first leg, the second leg height adjustable and controlled such that the worksurface remains substantially horizontal as height is adjusted. In some cases the assembly includes a caster at the lower end of the second leg.

In some cases the base includes a stationary leg having upper and lower ends, the first coupler affixed to the upper end of the leg and the second coupler affixed to the undersurface of the worktop for rotation about the vertical axis.

In other cases the base includes a cup structure having an undersurface and forming an upwardly opening cylindrical cavity, the cup structure mountable to an ambient floor surface with the undersurface adjacent the floor surface and the cup opening upward and centered along the axis of rotation.

Other embodiments include a reconfigurable assembly comprising a stationary base, a workstation including a worktop forming a worksurface and an undersurface, an edge defining the shape of the worktop, the edge including a rear edge having a substantially straight first rear edge portion and a substantially straight second rear edge portion that form an obtuse angle and an apex at the obtuse angle, wherein the workstation is supported by the base for rotation about a vertical axis through the base between first and second limit positions, wherein, the first substantially straight rear edge portion is substantially parallel to a first vertical plane when the workstation is in the first limit position and the second substantially straight rear edge portion is substantially parallel to the first vertical plane when the workstation is in the second limit position.

In some cases the base is affixed to an elongated spine subassembly having a length dimension and a width dimension perpendicular to the length dimension, the length dimension extending parallel to the first vertical plane. In some cases the first vertical plane divides the width dimension in half and wherein the first and second rear edge portions are adjacent the vertical plane when the workstation is in the first and second limit positions, respectively.

Other embodiments include a reconfigurable assembly comprising a first stationary base, a second stationary base adjacent the first stationary base, a first workstation including a first worktop forming a first worksurface and an undersurface, an edge defining the shape of the first worktop, the edge including first and second adjacent and substantially straight edge portions that form a first angle, wherein the first workstation is supported by the first base for rotation about a vertical axis through the first base between first and second limit positions, a second workstation including a second worktop forming a second worksurface and an undersurface, an edge defining the shape of the second worktop, the edge including third and fourth adjacent and substantially straight edge portions that form a second angle, wherein the second workstation is supported by the second base for rotation about a vertical axis through the second base between first and second limit positions, wherein, the first edge portion is substantially parallel to and proximate the third edge portion when the workstations are in the first limit positions and the second edge portion is substantially parallel to and proximate the fourth edge portion when the workstations are in the second limit positions.

In some embodiments the first and second edge portions are first and second rear edge portions that form an obtuse angle and wherein the third and fourth edge portions are first and second rear edge portions of the second worktop that form an obtuse angle. In some cases the obtuse angled are between 110 and 160 degrees.

Still other embodiments include a reconfigurable assembly comprising a first stationary base, a second stationary base spaced from the first stationary base, a first workstation including a first worktop forming a first worksurface and an undersurface, an edge defining the shape of the first worktop, the edge including a substantially straight first lateral edge, wherein the first workstation is supported by the first base for rotation about a vertical axis through the first base between first and second limit positions, a second workstation including a second worktop forming a second worksurface and an undersurface, an edge defining the shape of the second worktop, the edge including a substantially straight second lateral edge, wherein the second workstation is supported by the second base for rotation about a vertical axis through the second base between first and second limit positions, wherein, the first lateral edge is substantially parallel to and proximate the second lateral edge when the workstations are in the first limit positions and the first lateral edge is spaced from and forms an acute and with the second lateral edge when either one of the first and second workstations is in a position other than the first limit position.

Yet other configurations include a reconfigurable assembly comprising a stationary elongated spine subassembly having a length dimension, a width dimension perpendicular to the length dimension, and a height dimension, a workstation including a worktop forming a worksurface and an undersurface, the workstation supported by the spine subassembly with the worksurface in a substantially horizontal orientation, the undersurface at a height above the height dimension of the spine subassembly, a mounting assembly securing the workstation to the spine subassembly for rotation about a vertical axis passing through the worktop between first and second limit positions, wherein a first portion of the worktop resides above the spine subassembly when the workstation is in the first limit position and a second portion of the worktop resides above the spine subassembly when the workstation is in the second limit position.

Other embodiments include a reconfigurable assembly for use in a rectangular workspace wherein the workspace includes parallel front and rear boundaries and parallel first and second lateral boundaries that are perpendicular to the front and rear boundaries, the assembly comprising a stationary base, a workstation including a worktop forming a worksurface and an undersurface, an edge defining the shape of the worktop, the edge including a front edge, a rear edge and substantially straight first and second lateral edges that extend from the rear edge toward the front edge, the rear edge including substantially straight first and second rear edge portions that form an obtuse angle at an apex spaced apart from the first and second lateral edges, the first and second lateral edges angling toward each other as they extend from the rear edge toward the front edge, the worktop supported by the base with the worksurface in a substantially horizontal orientation and for rotation about a vertical axis through the base between first and second limit positions, wherein, the first rear edge portion is parallel to the rear boundary and the first lateral edge is parallel to the first lateral boundary when the workstation is in the first limit position and the second rear edge portion is parallel to the rear boundary and the second lateral edge is parallel to the second lateral boundary when the workstation is in the second limit position.

Additional embodiments include a reconfigurable assembly comprising a plurality of height adjustable leg assemblies including at least first and second leg assemblies wherein each leg assembly is extendable and contractable to change the length of the leg assembly, each leg assembly including a lower member and an extendable upper member affixed to the lower member and extending to an upper end for telescopic movement along a length dimension of the lower member, a worktop having a worktop surface and an undersurface, the undersurface affixed to the upper ends of the leg assemblies so that the leg assemblies reside below the worktop and a stationary base, wherein, the lower member of a first leg assembly is rotationally secured to the stationary base so that the first leg assembly and worktop rotate together about a vertical axis through the first leg assembly.

BRIEF DESCRIPTION OF THE SEVERAL VIEWS OF THE DRAWINGS

The present disclosure can be more fully understood from the following detailed description taken in conjunction with the accompanying drawings, in which.

DETAILED DESCRIPTION OF THE DISCLOSURE

Workspaces can be provided to maximize use of a facility space, while also facilitating at least some level of worker privacy in the workspaces when desired. Workstations and other furniture can be adjustable to accommodate user characteristics and preferences. According to some aspects of the present disclosure, workstations can be adjusted between configurations (e.g., can be moved between a range of positions and orientations) to alternatively afford a user greater privacy, or facilitate collaboration with other workers in proximity to the workstation. Workstations can be arranged to advantageously position workstations relative to other workstations to provide users flexibility to collaborate with other individuals while efficiently using a floor space of a work facility. Assemblies can be provided to facilitate adjustability of workstations and efficiently and aesthetically manage cabling associated with workstations and technology devices supported thereon.

According to this disclosure, workstations (e.g., including height-adjustable desks (HADs)) can be rotatably adjustable to allow a user to adjust an orientation of working in a first position relative to a second angular position of the workstation. For example, a first user at a first pivotable workstation may be seated next to a second user at another workstation and can rotate the first pivotable workstation away from the second user to provide greater privacy with respect to the second user or can rotate the first workstation towards the second user so that the first user can be positioned closer to the second user and to enable the second user a greater view of items located at the first workstation (e.g., a display screen, a document on the first workstation tabletop, etc.). In some cases, rotatable workstations may increase user comfort when the user decides to rotate the workstation in response to environmental within a work facility (e.g., a change in lighting, a relative change in temperature, proximity to air vents, etc.).

Figure 1:
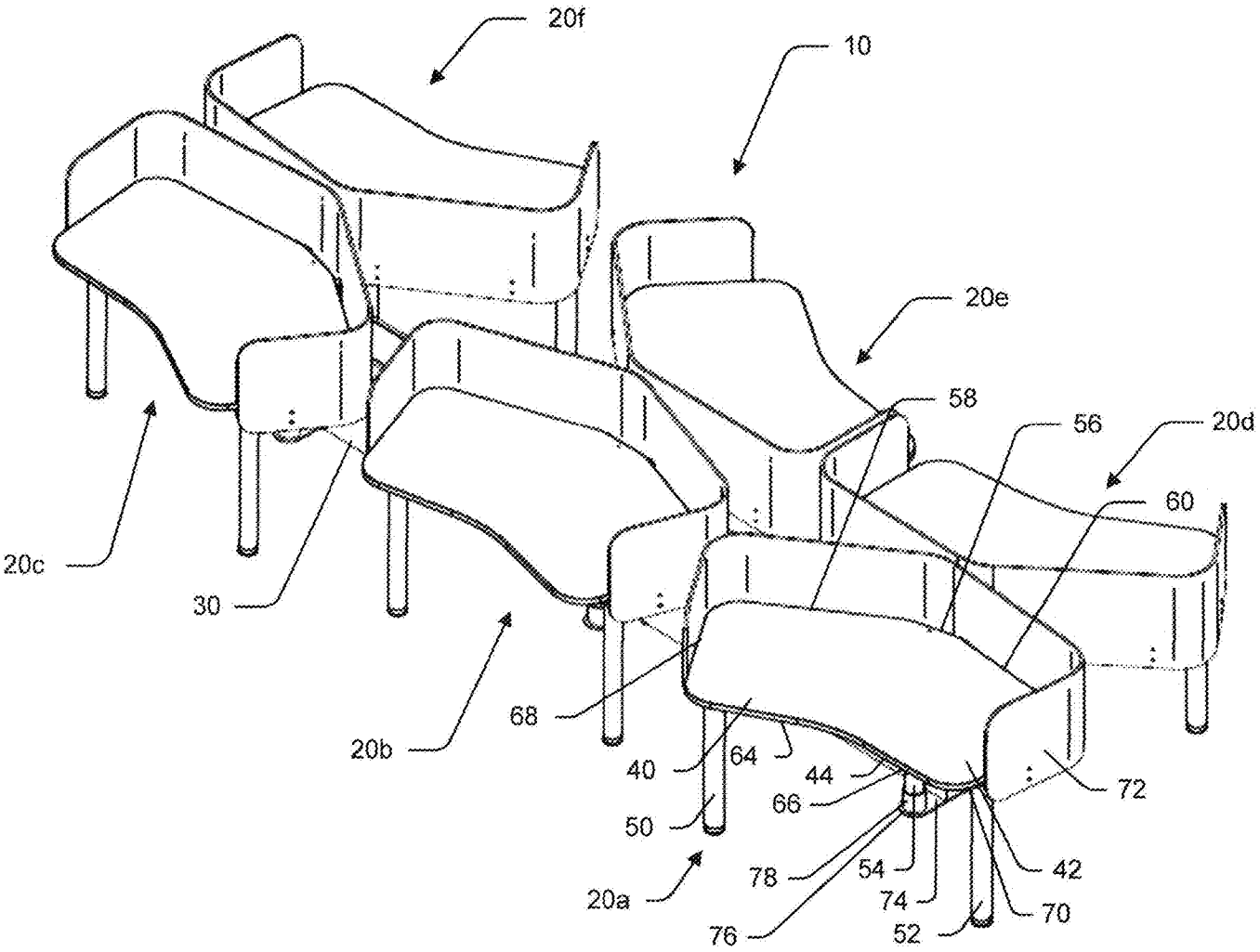
FIG. 1 is a perspective view of an exemplary workstation assembly that includes, among other components, six workstations, three of the workstations on a first side of a spine and three of the workstations on a second side of the spine opposite the first side.
Figure 4:
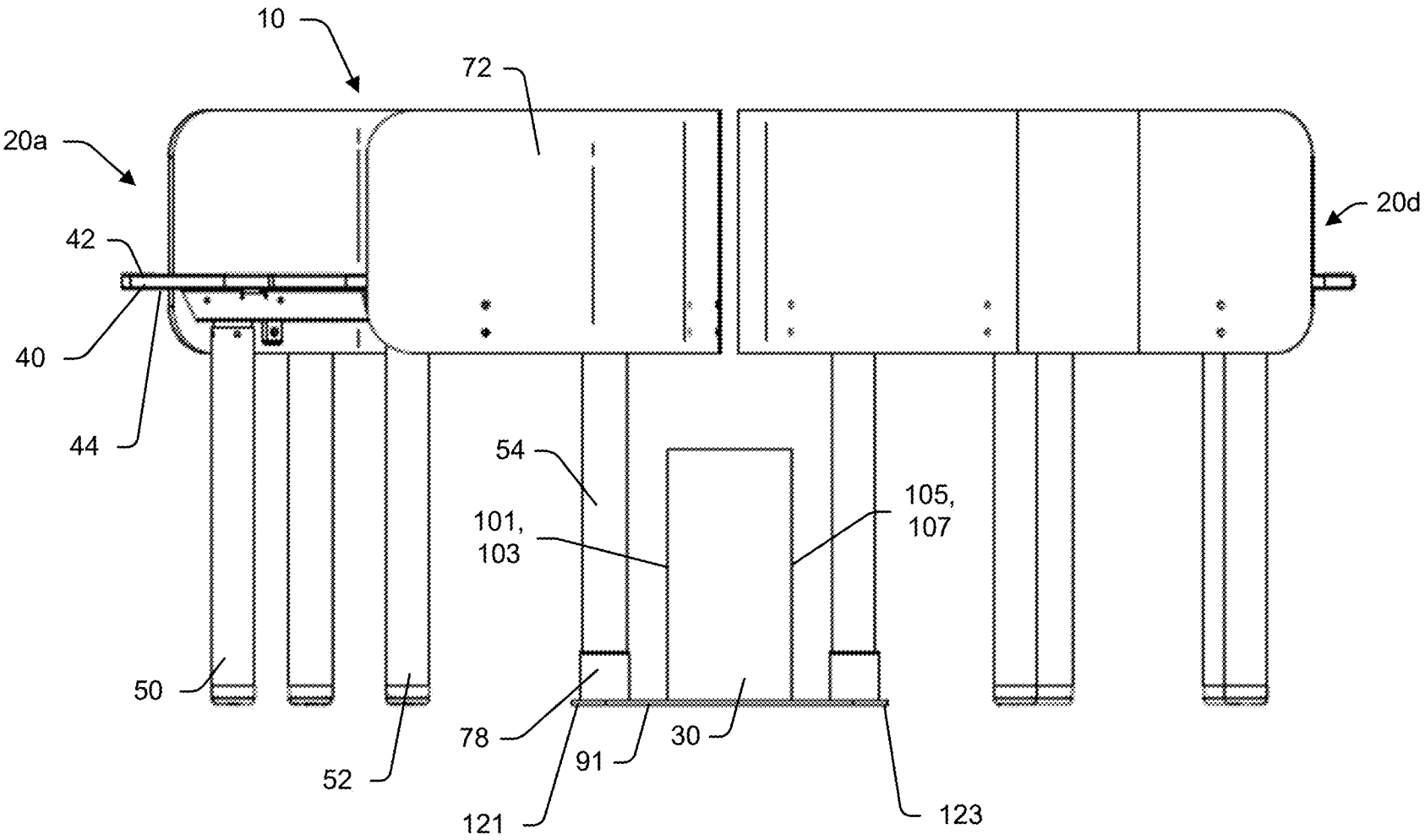
FIG. 4 is a schematic end elevation view of workstation assembly of FIG. 1, according to some aspects of the present disclosure.
Figure 5:
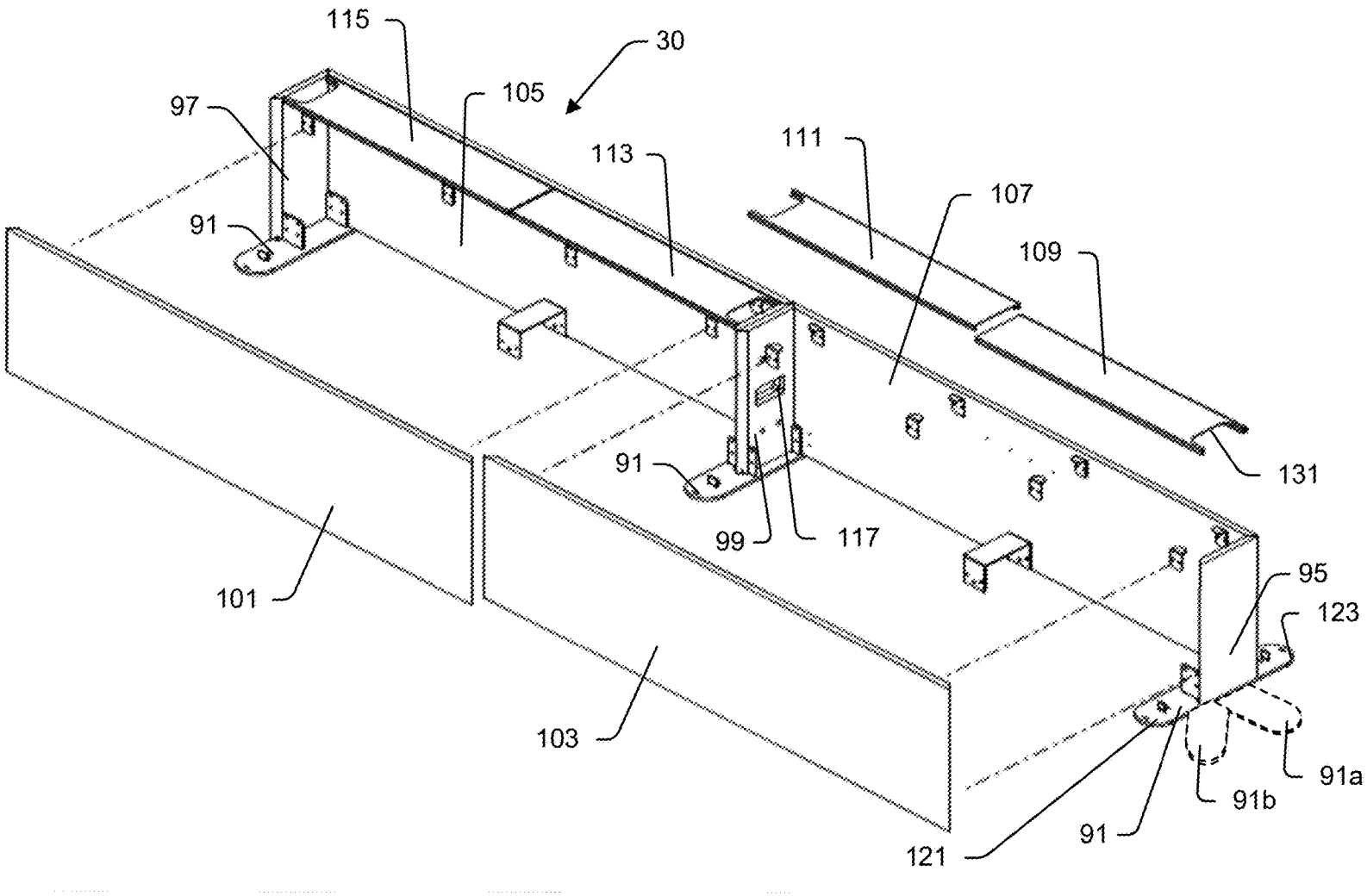
FIG. 5 is an exploded top angled perspective view of an exemplary spine, usable with the exemplary workstation assembly of FIG. 1.

Consistent with at least some aspects of the present disclosure, workspace assemblies can be afforded with features enabling arrangement of rotatable (e.g., pivotable) workstations, and provide users a range of possible working positions. To this end, referring to FIG. 1, an exemplary workstation assembly 10 including a six workstations 20*a* through 20*f* (hereafter "workstations" 20*a* through 20*f*) and a wire management trough or "spine" assembly 30 (hereafter "spine"). In FIG. 1, workstation assembly 10 includes first through third workstations 20*a*, 20*b*, 20*c*, respectively, arranged on a first side of spine 30, and fourth through sixth workstations 20*d*, 20*e*, 20*f*, respectively, arranged on a second side of spine 30, opposite the first side. Spine 30 in FIG. 1 is an elongated assembly that resembles a box and extends lengthwise between first and second ends of assembly 10. Spine 30 forms an internal power cable receiving channel along its length (e.g., as illustrated in FIG. 5). In at least some embodiments, a maximum height of spine 30 is below a minimum height of an undersurface of tabletops 40 of each of the workstations 20 as best seen in FIG. 4). In some cases, a maximum height of spine 30 is at least an inch lower than a minimum height of the undersurfaces of the tabletops 40.

In the illustrated example, the workstations 20*a* through 20*f* are substantially identical, and description of one of the workstations 20*a* is applicable to the rest of the workstations 20*b* through 20*f*.

Figure 2:
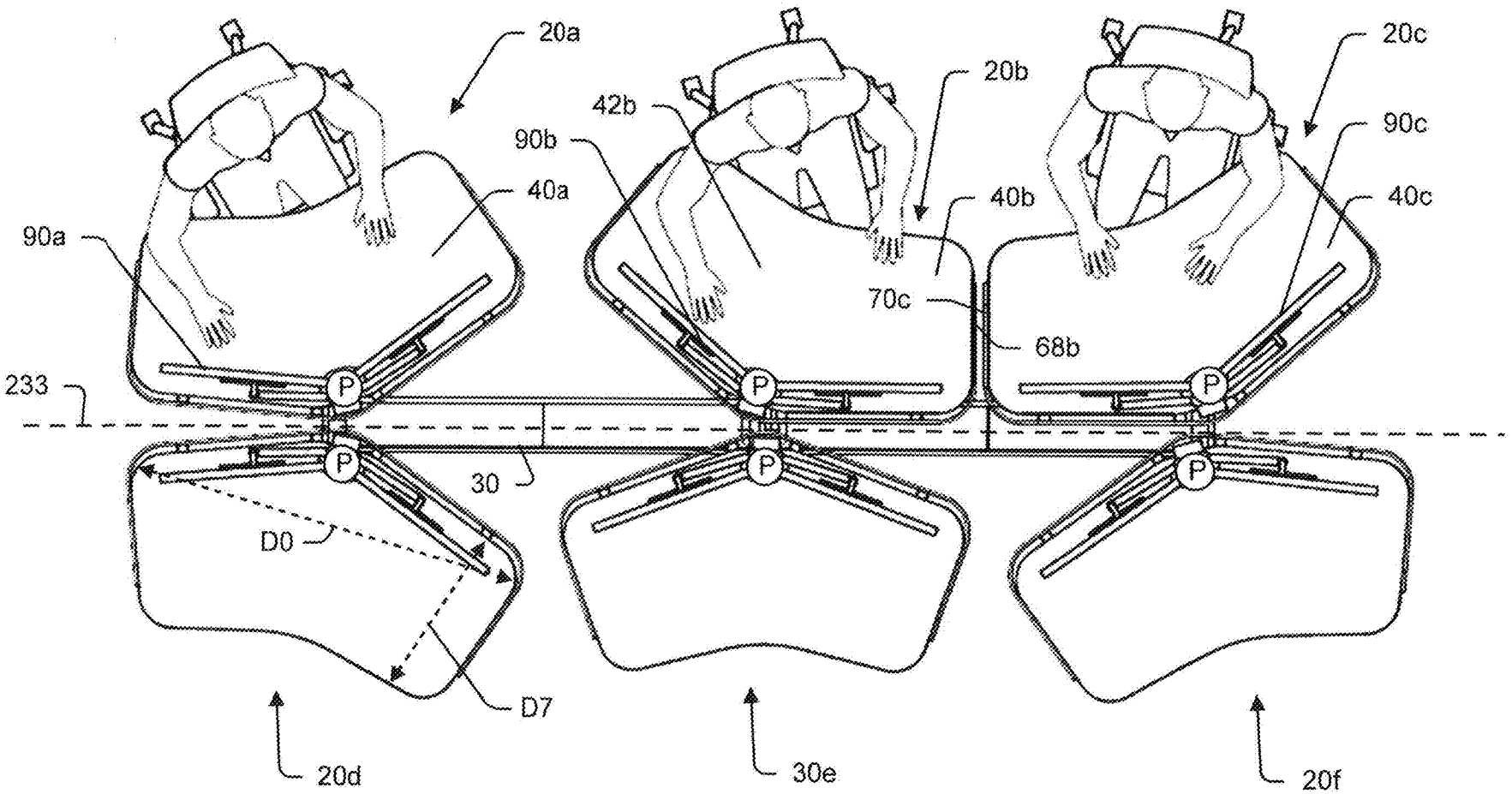
FIG. 2 is a top plan view showing six tabletops of the workstations of FIG. 1 in different rotational positions, according to some aspects of the disclosure.
Figure 3:
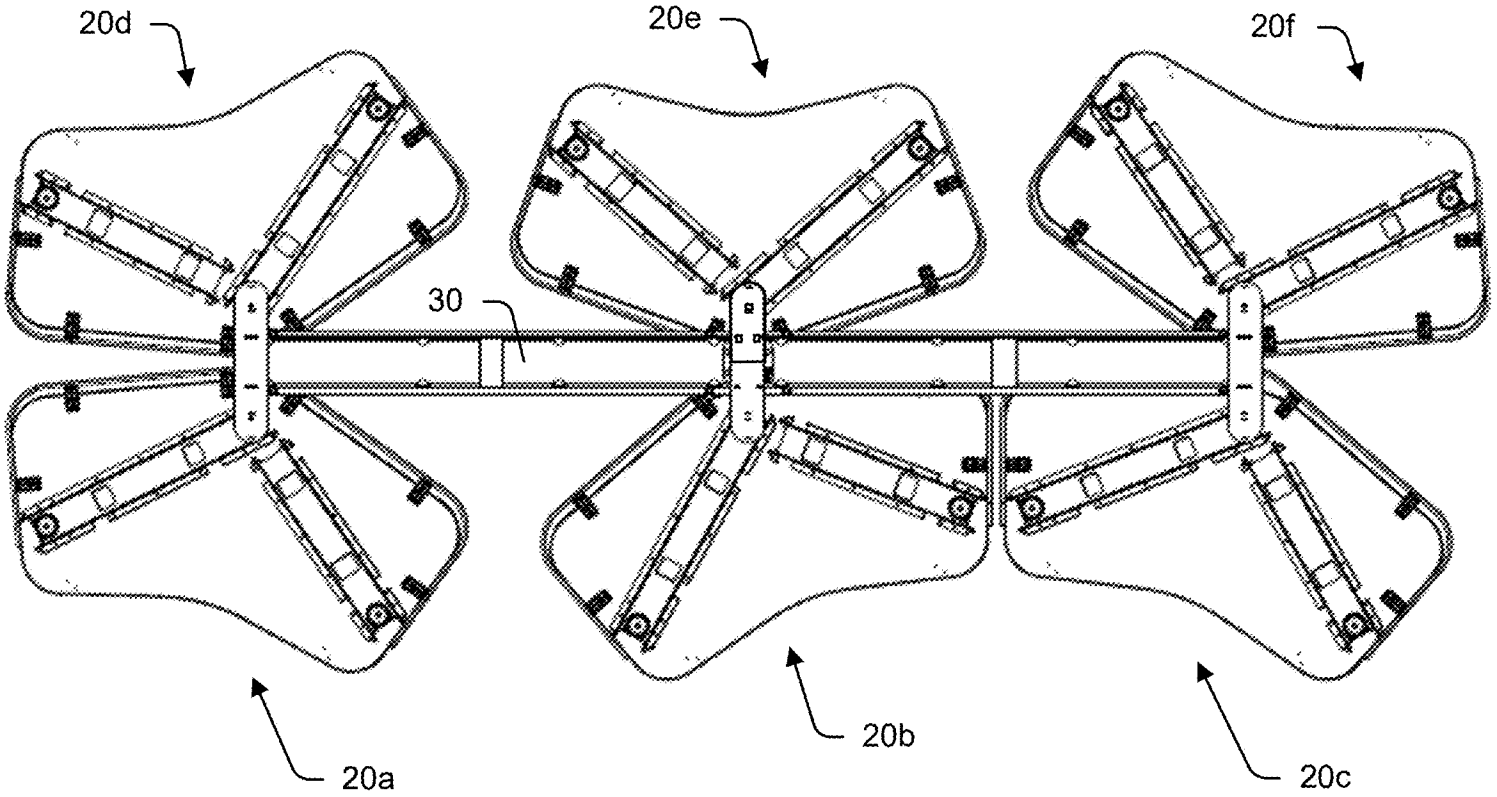
FIG. 3 is a bottom plan view of the workstation assembly of FIG. 1 showing six tabletops of the workstations in different rotational positions, according to some aspects of the disclosure.

Referring still to FIG. 1 and also to FIGS. 2 and 3, workstation 20*a* comprises a tabletop 40 supported at the upper ends of a plurality of leg assemblies, including two lateral/front leg assemblies 50, 52 and a single pivoting central/rear leg assembly 54 (hereafter the "front" legs and "rear" leg, unless indicated otherwise). Legs 50, 52, 54 are spaced apart from each other, and extend vertically upward from bottom ends to upper ends with the tabletop 40 mounted at the upper ends. As shown, the front legs 50, 52 are positioned on opposing lateral sides of the workstation 20*a*, and the pivoting rear leg 54 is positioned laterally between the outer legs 50, 52 (e.g., laterally central relative to the tabletop 40) and near a rear edge of the tabletop 40 at a central location along the rear edge of the tabletop 40.

In some cases, the pivoting leg can be offset from a central location along the rear edge of the worktop 40 to facilitate varying arcuate paths for rotation of the workstation. In some cases, a workstation can be configured to rotate about a leg other than a centrally located rear leg (e.g., pivoting leg 54). For example, in some embodiments front leg 50 may be the pivoting leg.

Figure 11:
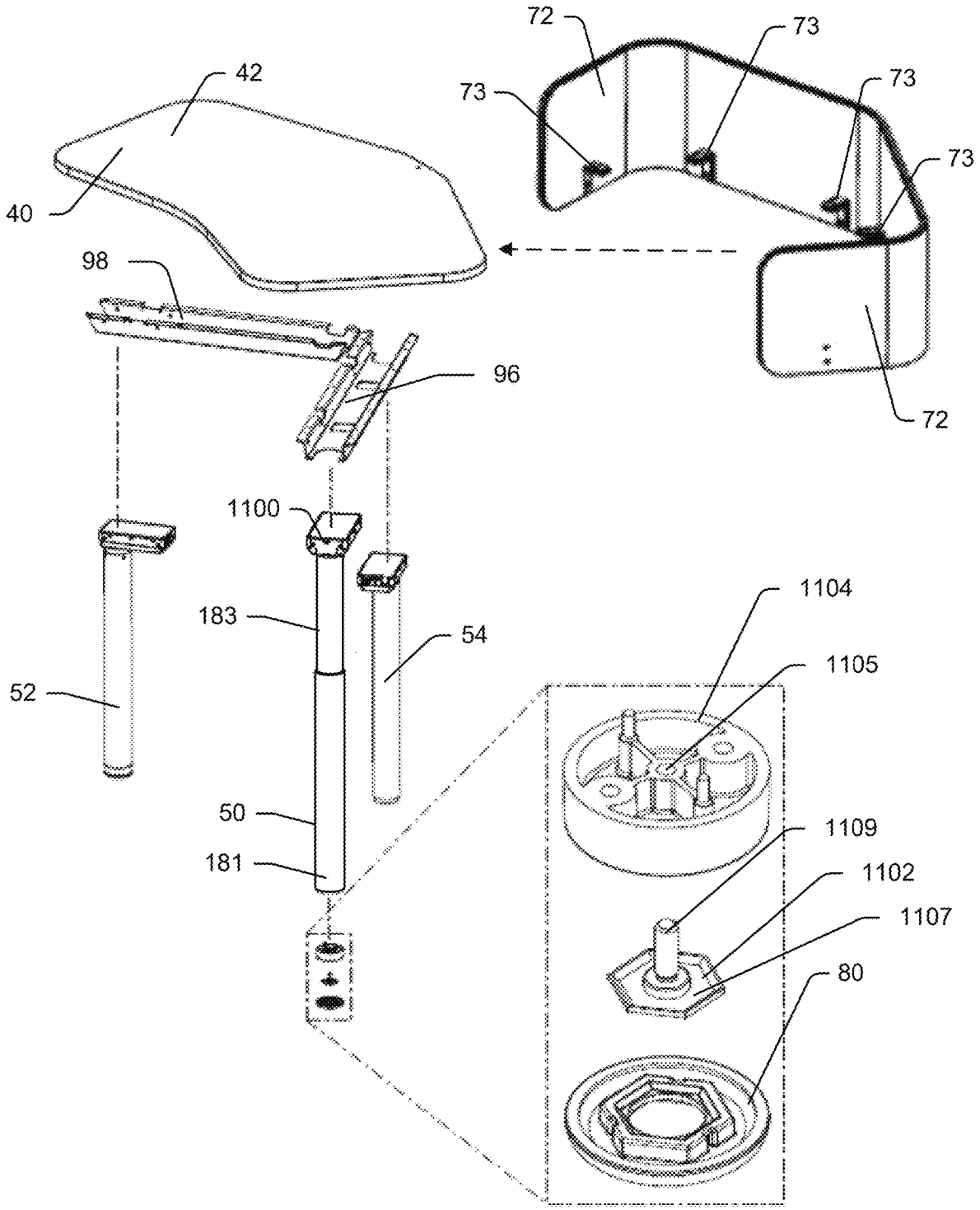
FIG. 11 is an exploded view of the rotatable workstation of FIG. 7, according to some aspects of the disclosure.
Figure 12:
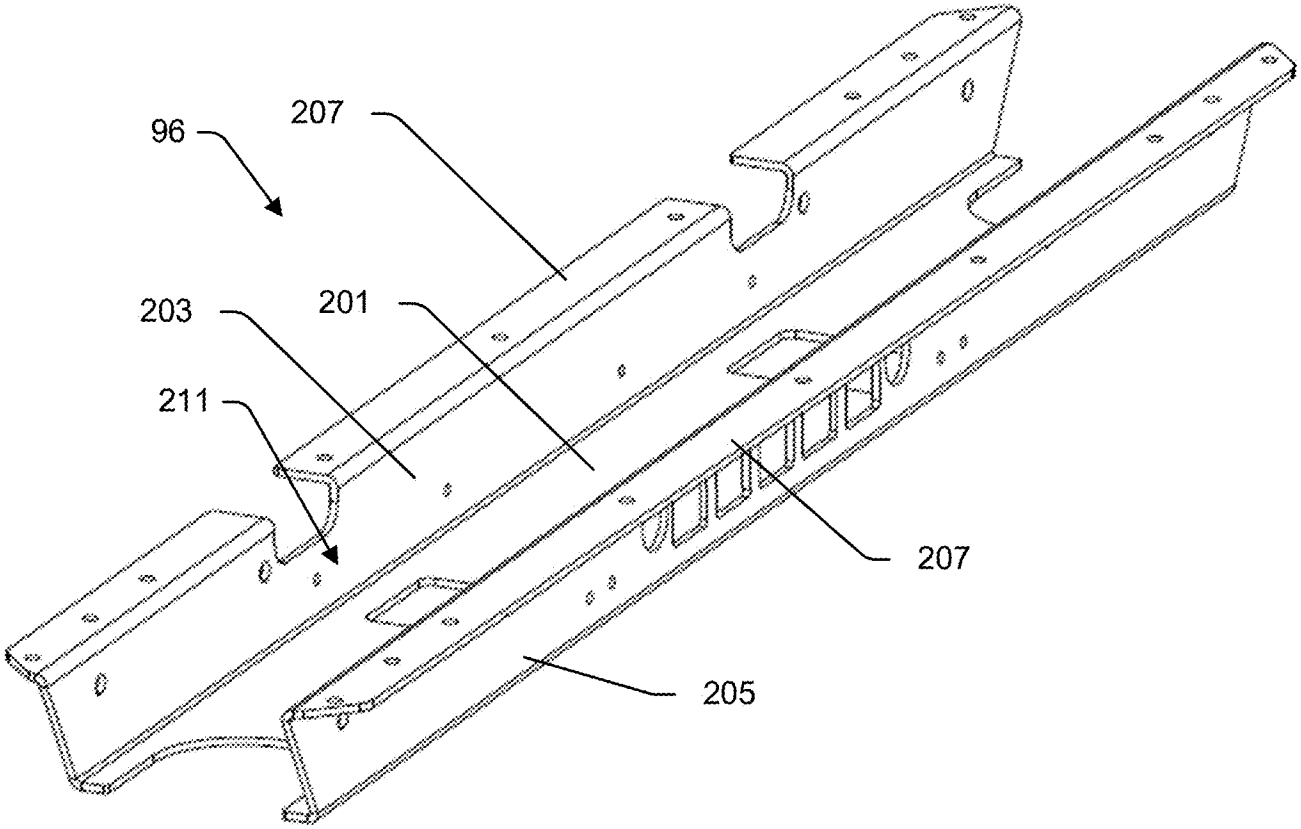
FIG. 12 is a perspective view of a support member mountable on a bottom surface of a tabletop of a workstation.

Coasters can be provided at the bottom ends of the front/side leg members 50, 52 to reduce friction between an ambient floor surface and the front/side legs 50, 52 during rotation of workstation 20*a* about pivoting leg 54 as further described with respect to FIG. 11 hereafter. In some cases, workstations can include other components designed to reduce/minimize friction between leg members and the ambient floor during rotation (e.g., casters, wheels, other low-friction surfaces etc.).

In some embodiments, one or more of the legs may include height leveling components that can be used to manually change the height of the leg. To this end, see for instance in FIG. 11 that a leg leveling structure includes a base member 80, a leveling bolt 1102 and a leg bracket 1104. Leg bracket 1104 secures to a bottom end of leg 50 and forms a threaded central channel 1105. Leveling bolt 1102 includes a foot 1107 and a threaded shaft 1109 that is adjustably receivable within channel 1105 so that the shaft 1109 can be rotated to different positions within the channel to extend the overall length of the leg assembly. Foot 1107 forms a keyed outer shape (e.g., a hexagon in the illustrated example). Base member 80 forms a keyed recess in an upper surface for receiving the keyed shape of foot 1107 so that base 80 moves with foot 1107. A lower surface of base 80 is formed of a material that has a low coefficient of friction with the material that forms the ambient floor surface.

In addition to the height leveling components, in some examples, each of the legs 50, 52, 54 includes a mechanism so that the leg assembly is height adjustable and can be driven to any length between and including a fully extended length and a fully retracted length to support a user of workstation 20*a* at standing or sitting heights, according to user preferences. For instance, see in FIG. 11 that leg assembly 50 is a telescoping leg assembly including a cylindrical outer leg member 181 and a cylindrical inner leg member 183 that is received within an internal channel formed by outer leg member 181 to move telescopically between extended and retracted positions to change tabletop 40 height. A motor located within a motor housing 1100 is mounted at an upper end of inner/upper leg member 183 which is connected to a lifting mechanism (not illustrated) located within the leg assembly 50. Other leg assemblies 52 and 54 include similar telescoping leg assemblies, motors, and drive mechanisms and a controller (not illustrated) controls the motors to adjust leg heights simultaneously to maintain the top surface of tabletop 40 horizontal during height adjustment. A user interface (not shown; e.g., buttons, a lever, a touch sensitive pad or display screen, etc.) can be used to control the controller and to receive height adjustment commands from a workstation user.

Figure 10:
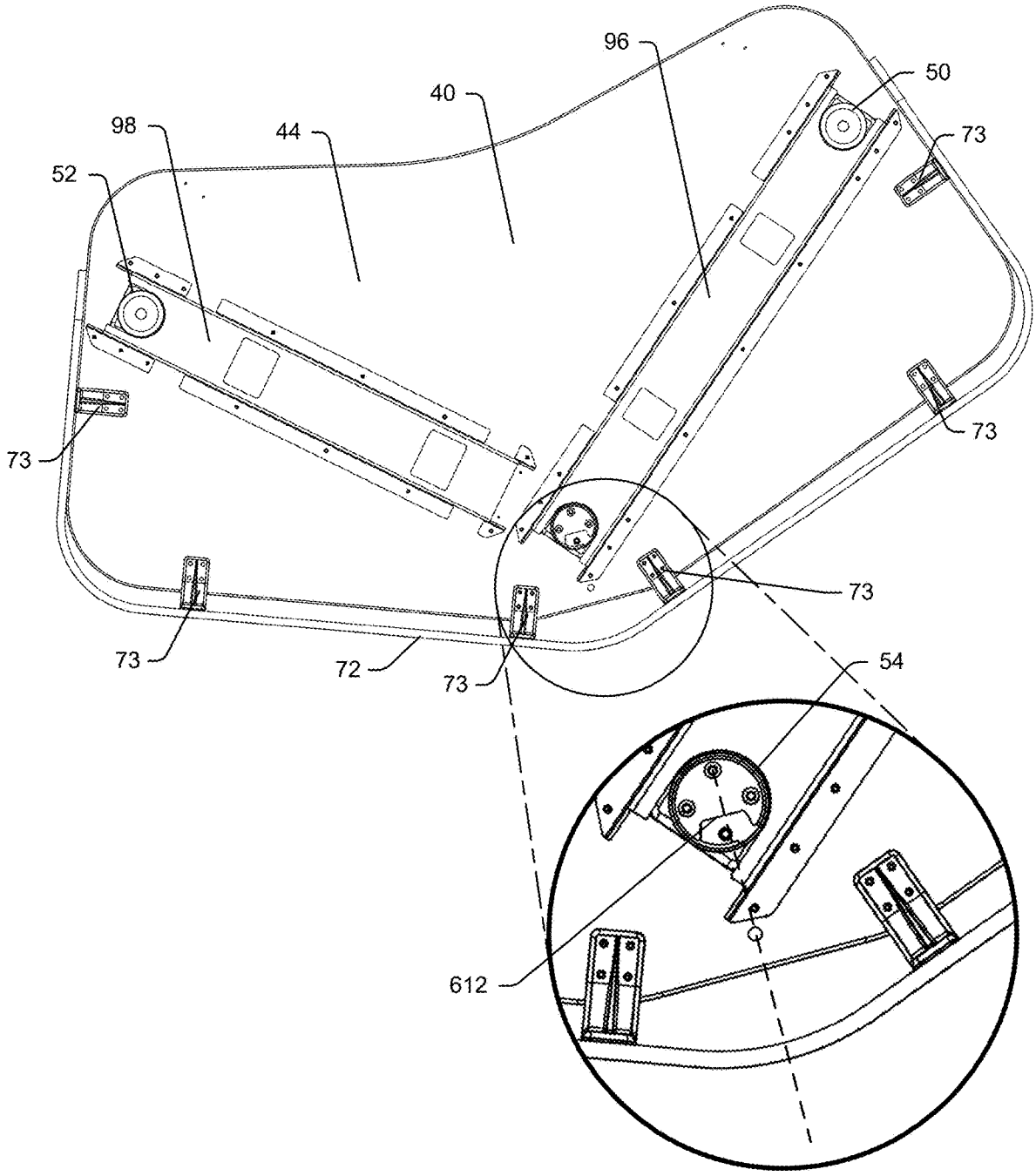
FIG. 10 is a bottom plan view showing an underside of the tabletop of the rotatable workstation of FIG. 7.

Referring to FIGS. 3, 10 and 11, wire management member 96 is a rigid sheet metal member bent into the form shown including a floor member 201, first and second lateral wall members, 203 and 205 and laterally extending mounting tabs 207, where the floor and wall members form a channel 211 for running power and data cables below the tabletop 40. Member 96 is mounted to the undersurface 44 of member 40 adjacent rear edge portion 60 and has a length dimension that extends generally along straight rear edge portion 60, connecting the locations at which legs 50 and 54 are secured to undersurface 44. Wall members 203 and 205 extend vertically upward from opposite long edges of floor member 201 and the tabs 207 extend outwardly from upper edges of the wall members 203 and 205. In addition to providing cable management channel 211, member 96 provides additional rigidity to tabletop 40 and also to the leg assemblies 50 and 54 attached thereto.

The motors and motor housings 1100 (see again FIG. 11) are located within the channel 211 and are securely attached to the lateral wall member 203 and 205 with associated legs 50 and 54 extending downward therefrom through cutout openings at the ends of floor member 201. Because each leg 50 and 54 is mounted to the underside of the tabletop 40 via an associated motor housing 1100 and wire management member 96 that is secured along the entire length of member 96, the leg-tabletop connection is extremely robust.

One or more of the floor member 201 and or the wall member(s) forms one or more openings for passing cables from within channel 211 to locations outside channel 211.

Second wire management member 98 is similar constructed and operates in a similar fashion to member 96, albeit extending between the mounting locations of legs 52 and 54, and where only the motor and housing 1100 associated with leg 52 are located within the member channel.

In the illustrated embodiment, the workstation 20*a* includes three legs 50, 52, 54. In other embodiments, one or more workstations of a workstation assembly can include a single leg, two legs, or more than three legs, and associated motors and drive mechanisms.

Figure 8:
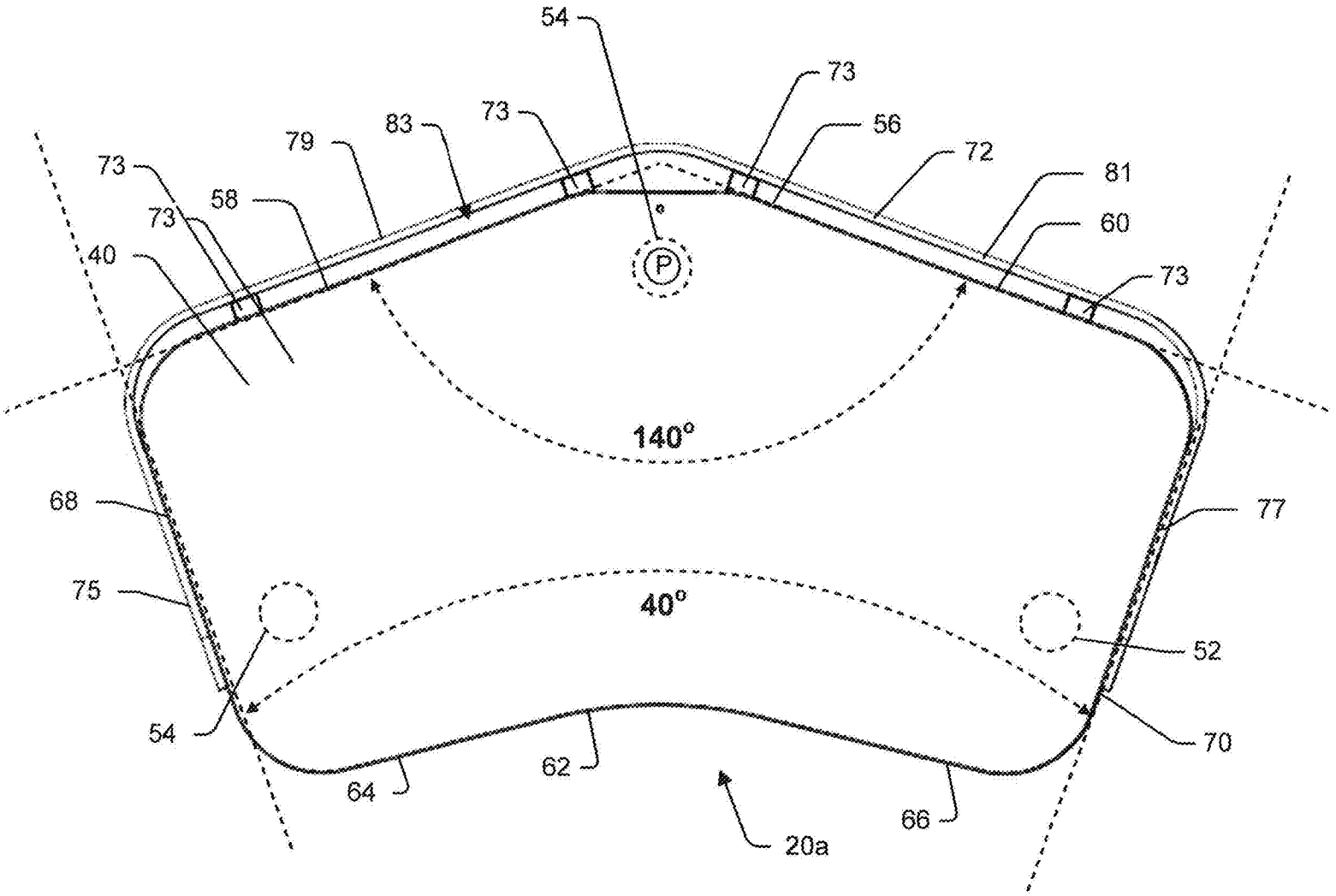
FIG. 8 is a top plan view showing a tabletop of the rotatable workstation of FIG. 7.
Figure 9:
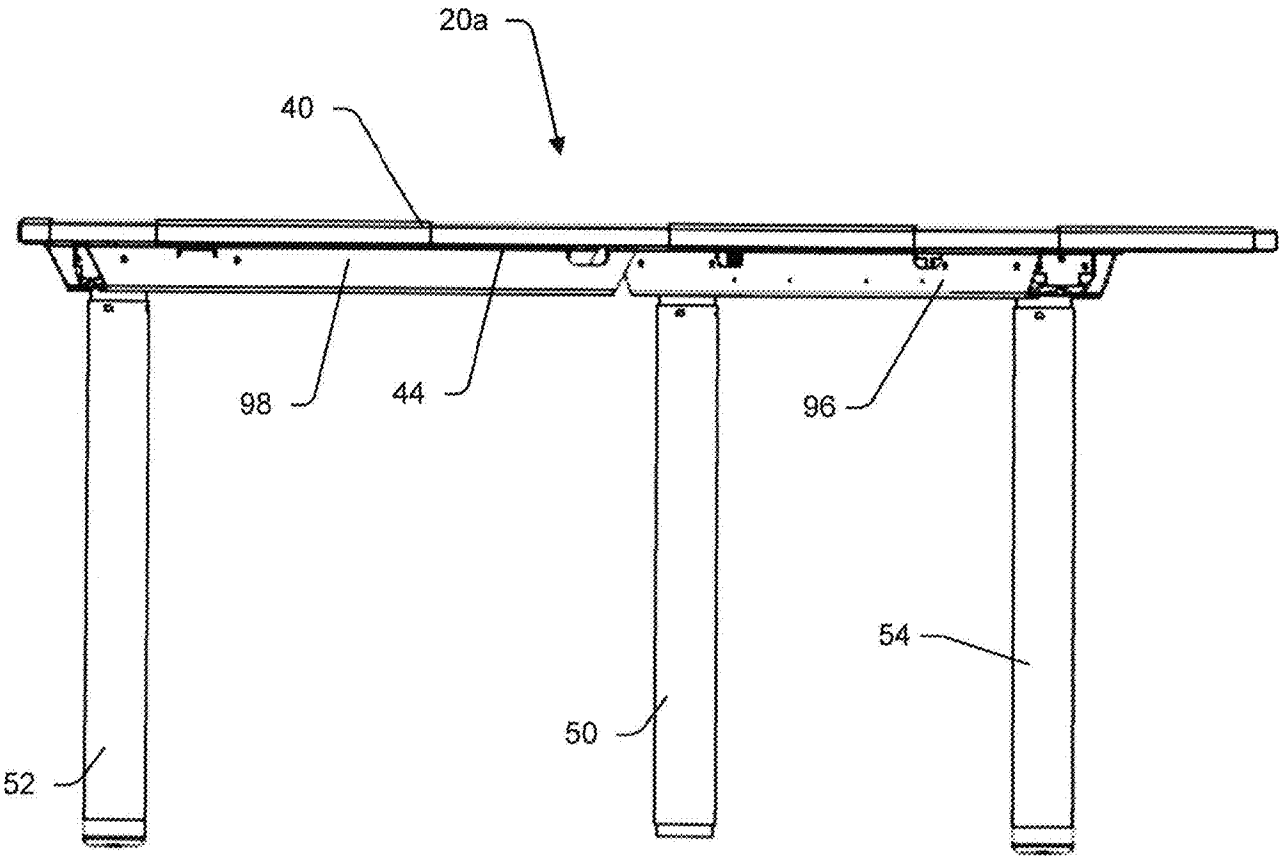
FIG. 9 is a side elevation view of the rotatable workstation of FIG. 7.

Tabletop 40 includes a worksurface 42 on a top of the tabletop 40 and an undersurface 44 (see also FIG. 3). Tabletop is shaped to cooperate with other assembly components to facilitate movement of the tabletop 40 between several advantageous user positions in which relative degrees of privacy are different in the different positions. Referring now to FIGS. 1 and 8, the illustrated workstation tabletop 40 is a flat generally planar member that has a specific and functional shape referred to herein as a "boomerang shape". The boomerang shape has a rear edge 56 that is generally convex rearward (e.g., in a direction toward spine 30 when the assembly is constructed). In the example shown, rear edge 56 includes a generally straight left rear edge portion 58 and a generally straight right rear edge portion 60. The left and right rear edge portions 58, 60 meet at a rear apex area of the tabletop and form an obtuse angle that, in at least some embodiments, is substantially 140 degrees. Each straight rear edge portion is 22 inches long. In other embodiments the straight rear edge portions may be within a range between 18 inches and 26 inches.

Tabletop 40 has a front edge 62 that is proximate to a user when the user is at the workstation 20*a*. Front edge 62 is generally concave forward and has a shape similar to the shape of rear edge 56. In this regard, front edge 62 has a straight left front edge portion 64 and a straight right front edge portion 66 that meet at a concave curved central portion. Each straight front edge portion is 12.5 inches long and can be within a range between 10 and 15 inches in some embodiments. Left rear edge portion 58 and left front edge portion 64 are substantially parallel in the illustrated embodiment and right rear edge portion 60 and right front edge portion 66 are also substantially parallel.

Tabletop 40 has a first lateral side edge 68 and a second lateral side edge 70. The first and second lateral side edges 68, 70 are straight and extend from the rear edge 56 toward the front edge 62, and angle toward each other from rear to front edges to form an approximately 40-degree angle. In the illustrated embodiment, each side edge is substantially perpendicular to adjacent front and rear edge portions. There are curved edge portions between each side edge and adjacent front and rear edges in the illustrated embodiment. Each straight side edge portion is 15 inches long. In other embodiments the side edge portions may be within a range between 10 inches and 20 inches.

The boomerang shape is particularly advantageous for several reasons. First, the shape provides a degree of curvature about a workstation user seated at the front edge thereof. Second, the shape allows rotation of a tabletop within a range of rotation relative to a spine that the top is anchored to while the entire tabletop remains to one side of a central plane through the middle of the spine along the length of the spine. In some embodiments restricting rotation of a top to one side of the central spine plane is important to eliminate the possibility of tabletops being rotated into collision with other tops.

Referring again to FIG. 1 and to FIGS. 8 and 11, workstation 20*a* includes a privacy screen 72 that at least partially obscures views of worksurface 42 from one or more directions. The illustrated privacy screen 72 is mounted adjacent the rear and parts of the side edges of tabletop 40 to provide at least some privacy to a workstation user (e.g., along the rear edge 56, and the first and second lateral side edges 68, 70). Privacy screen 72 is mounted to tabletop 40 via a plurality of L-shaped brackets 73 where each bracket 73 is mounted to underside 44 of the tabletop and extends laterally past an adjacent edge of the tabletop then downward to form a surface to which the internal surface of screen 72 is attached. Screen 72 extends below undersurface 44 (e.g., 2-5 inches) to accommodate brackets 73 and extends upward above top surface 42 to afford privacy. In some cases screen 72 extends upward above the top surface between 10 and 24 inches.

In some embodiments screen 72 is formed of a rigid material or rigid layers of material that form a shape in top plan view that mirrors the shape of the side and rear edges of tabletop 40. Thus internal surfaces of screen 72 that mirror the rear edge 58 of tabletop 40 form a 140 degree angle and surfaces of screen 72 that mirror the side edges 68 and 70 of tabletop 40 extend at a right angle to adjacent internal surfaces that mirror the rear edge 58 as best seen in FIG. 8.

Referring still to FIG. 8, side portions 75 and 77 of screen 72 adjacent side edges 68 and 70 are pressed up against side edges 68 and 70 when screen 72 is mounted to tabletop 40 in at least some embodiments. Rear portions 79 and 81 of screen 72 in the illustrated embodiment are spaced from rear edge portions 58 and 60 of tabletop 40 to form a gap 83 for passing cables from equipment supported on top surface 42 to locations below tabletop 40.

Referring to FIG. 5, exemplary spine 30 includes three foot or anchor members 91, first and second vertical end members 95 and 97, one intermediate vertical member 99, side panels 101, 103, 105 and 107, top cover members 109, 111, 113 and 115, and a plurality of brackets (not labelled). Referring also to FIG. 8, each anchor member 91 includes a rigid horizontal and elongated plate type member 93 that form a base for other spine components as well as upwardly extending brackets 133 for securing one of the vertical members 95, 97 or 99 thereto. The anchor members 91 are spaced apart along the length of spine 30.

Vertical end members 95 and 97 are mounted to brackets 133 and extend upward from central portions of the end anchor members 91 and include finished outer surfaces while intermediate vertical member 99 is mounted to brackets 133 and extends upward from a central portion of an intermediate anchor member 91 and forms an opening 117 for passing cables. Panels 101, 103, 105 and 107 mount via brackets 133 and other brackets to the vertical upright members 95, 99 and 97 to form an upwardly opening cavity or channel at the upper ends of members 95, 97 and 99. Referring also to FIG. 4, once panels 101, 103, 105 and 107 are installed, distal ends 121 and 123 of anchor members 91 extend laterally past outer finished surfaces of panels 101, 103, 105 and 107 to provide stability for subassembly 30 as well as anchor structure for restricting workstation rotation as described hereafter. In some cases, each distal anchor member extends past the finished panel surfaces a length within a range between 2 inches and 18 inches and in particularly advantageous embodiments the distal ends extend within a range between 4 and 9 inches.

Referring again to FIG. 5, each cover member 109, 111, 113 and 115 is a rigid plate like elongated member that is receivable on upper surfaces of brackets attached to internal surfaces of adjacent panel members at the upper end of the cavity formed by spine 30. Together, the cover members are used to substantially close off the upper side of the cavity to hide power and/or data cables therein. Each cover member has a cut out end portion (see 131 in FIG. 5) for passing cables from within the cavity up to the workstations there above.

Referring again to FIG. 1, workspace assembly 10 includes features and components 99 for anchoring workstations 20*a*-20*f* to spine 30 in a manner that restricts rotation of each workstation to about a single axis and that further restricts rotation to within a limited rotation range relative to spine 30. In the illustrated example each anchor member 91 includes features that cooperate with other assembly components at the bottom of two of the rear legs of two of the workstations to facilitate station pivoting and to restrict station rotation about vertical axis and within a limit range of rotation. Hereafter, the components that facilitate workstation pivoting and restrict workstation rotation will be referred to as "the rotation restricting mechanism 99" unless indicated otherwise.

Figure 6:
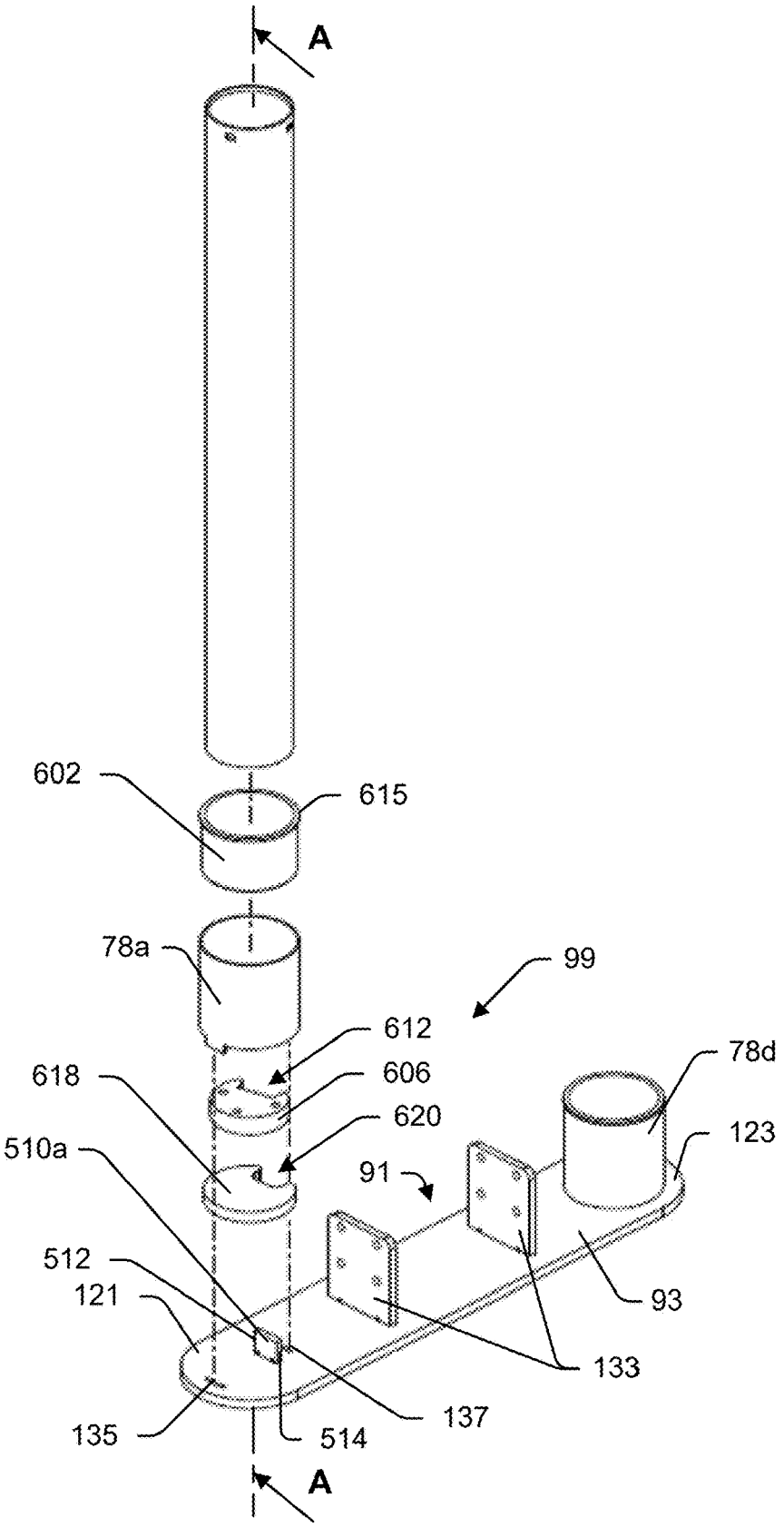
FIG. 6 is an exploded perspective view of an exemplary rotation limiting leg assembly of the workstation assembly of FIG. 1.
Figure 7:
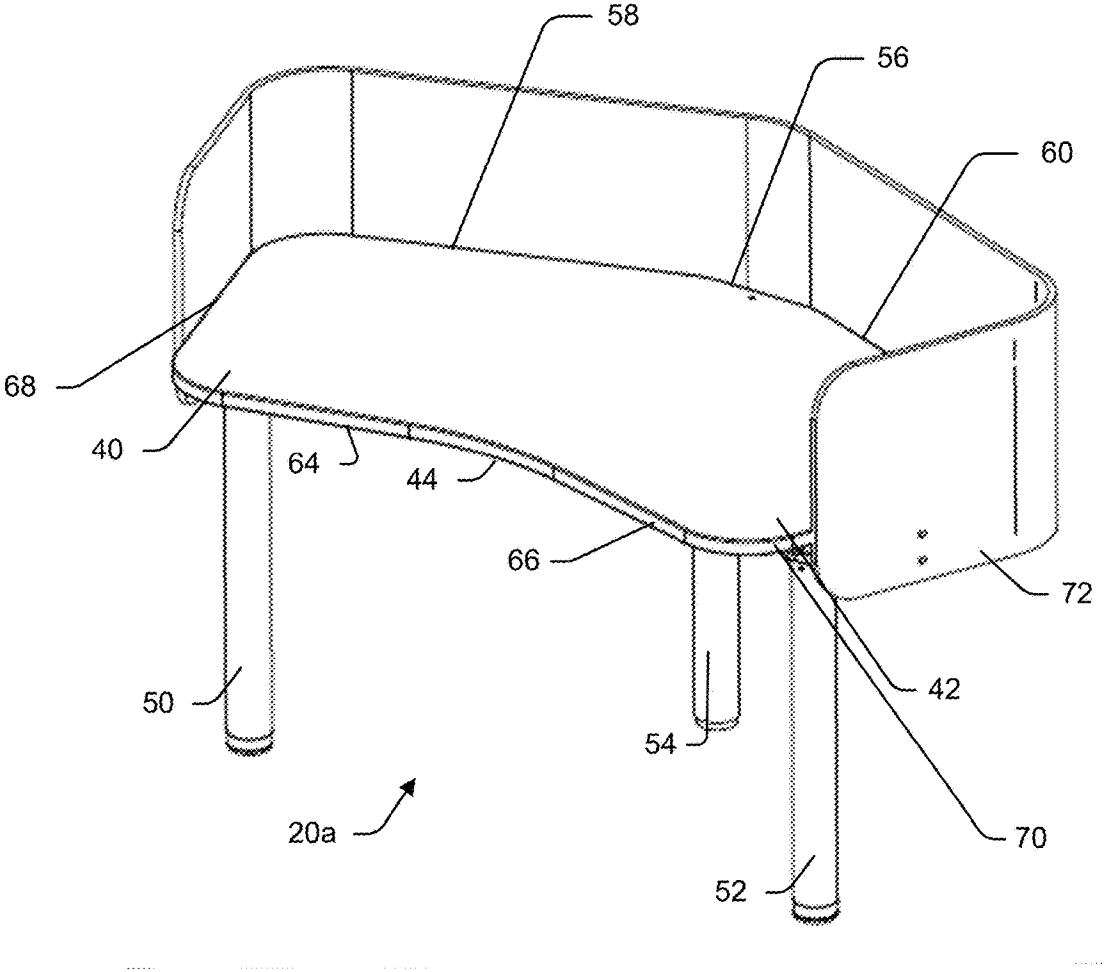
FIG. 7 is a perspective view of an exemplary rotatable workstation, according to some aspects of the disclosure.

Referring also to FIG. 6, first and second spaced apart slots 135 and 137 are formed near distal end 121 that cooperate to position a cup shaped housing member 78*a* (hereafter "cup member 78*a*"). While not shown, two similar slots are formed adjacent second end 123 of member 91 for positioning a second cup member 78*d* as shown in FIG. 6.

Figure 17:
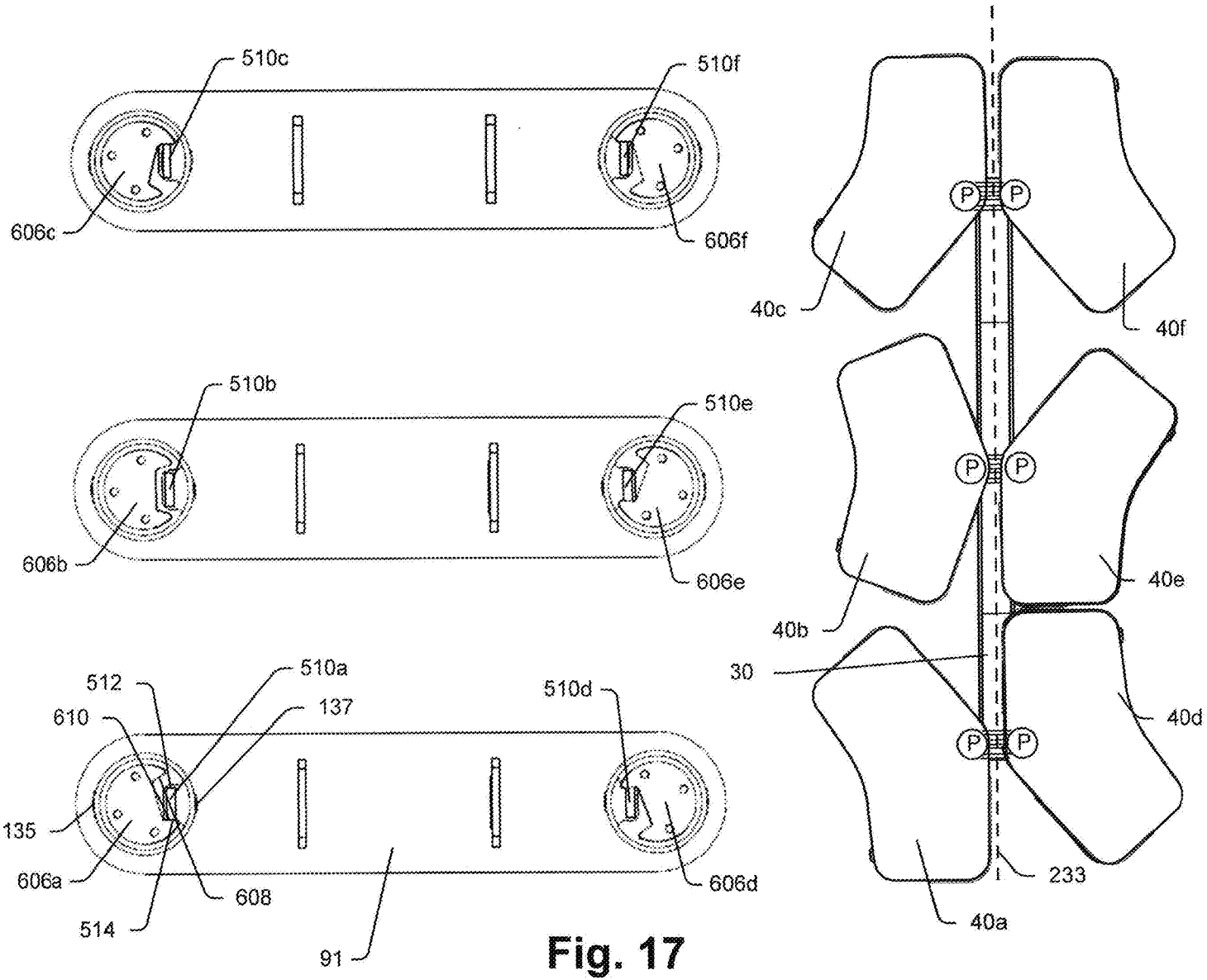
FIG. 17 is a schematic plan view of an exemplary workstation assembly that includes, among other components, six workstations, along with a schematic top plan sectional view showing corresponding orientations of components of a rotation-limiting leg assembly, according to some aspects of the disclosure.

In addition, a first coupler in the form of a rectangular tab 510*a* is rigidly connected to the upper surface of anchor member 91 and extends vertically upward therefrom at a location between slots 135 and 137 and closer to slot 137 than to slot 135. Referring also to FIG. 17, tab 510*a* has lateral edges or surfaces 512 and 514 that form vertical limit surfaces that cooperate with other components to restrict leg rotation as described hereafter. A similar tab 510*d* extends upward from member 91 adjacent second distal end 123 which cooperates with other components to restrict rotation of a second rear leg assembly as described in greater detail hereafter.

Figure 13:
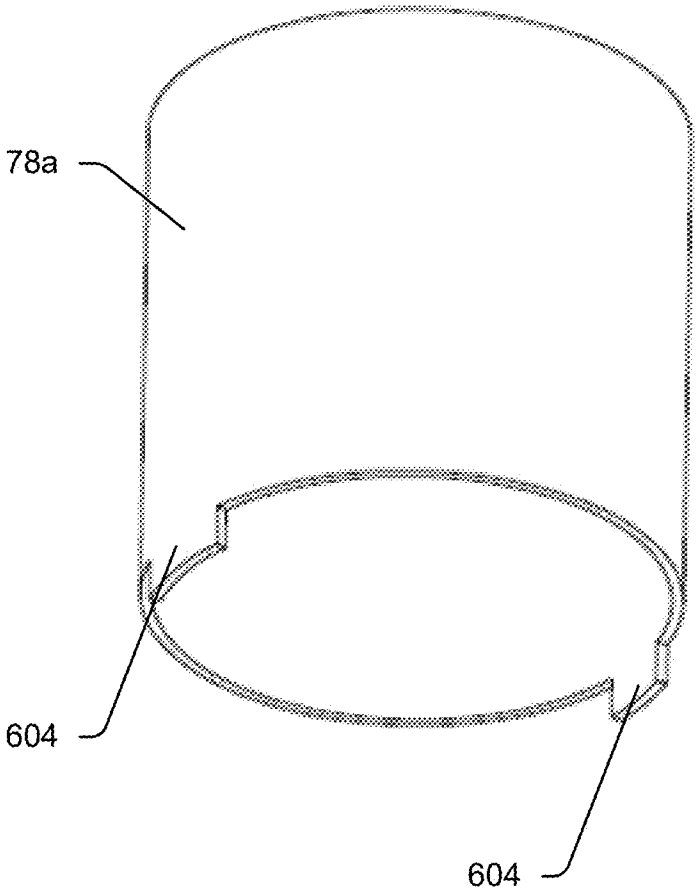
FIGS. 13-15 are views of exemplary components of a rotation-limiting leg assembly, according to some aspects of the disclosure.

Referring again to FIG. 1 and to FIGS. 4, 6 and 13, exemplary cup member 78*a* is a rigid cylindrical member that includes upper and lower edges and that forms a cylindrical cup opening that extends form upper to lower edges. Two mounting tabs 604 extend from the lower edge. Cup 78*a* has a width dimension such that tabs 604 align with slots 135 and 137 formed by anchor member 91. Tabs 604 are received in slots 135 and 137 and may be secured therein via adhesive, welding, mechanical fasteners, or in some other way, so that the cup opening faces upward and forms a vertical pivot axis. Once cup 78*a* is mounted to anchor member 91, tab 510*a* is located within the cup cavity as best seen in FIG. 17. A second cup member 78*d* is similarly mounted near opposite distal end 123. The cup cavity is sized and configured to receive a bottom portion of the pivoting leg member 54.

When workstation 20*a* is anchored to the spine 30 with the lower end of pivoting leg member 54 received in cup member 78, workstation 20*a* can rotate (e.g., pivot) about the vertical axis that extends through both pivoting leg member 54 and cup member 78*a*.

Figure 16:
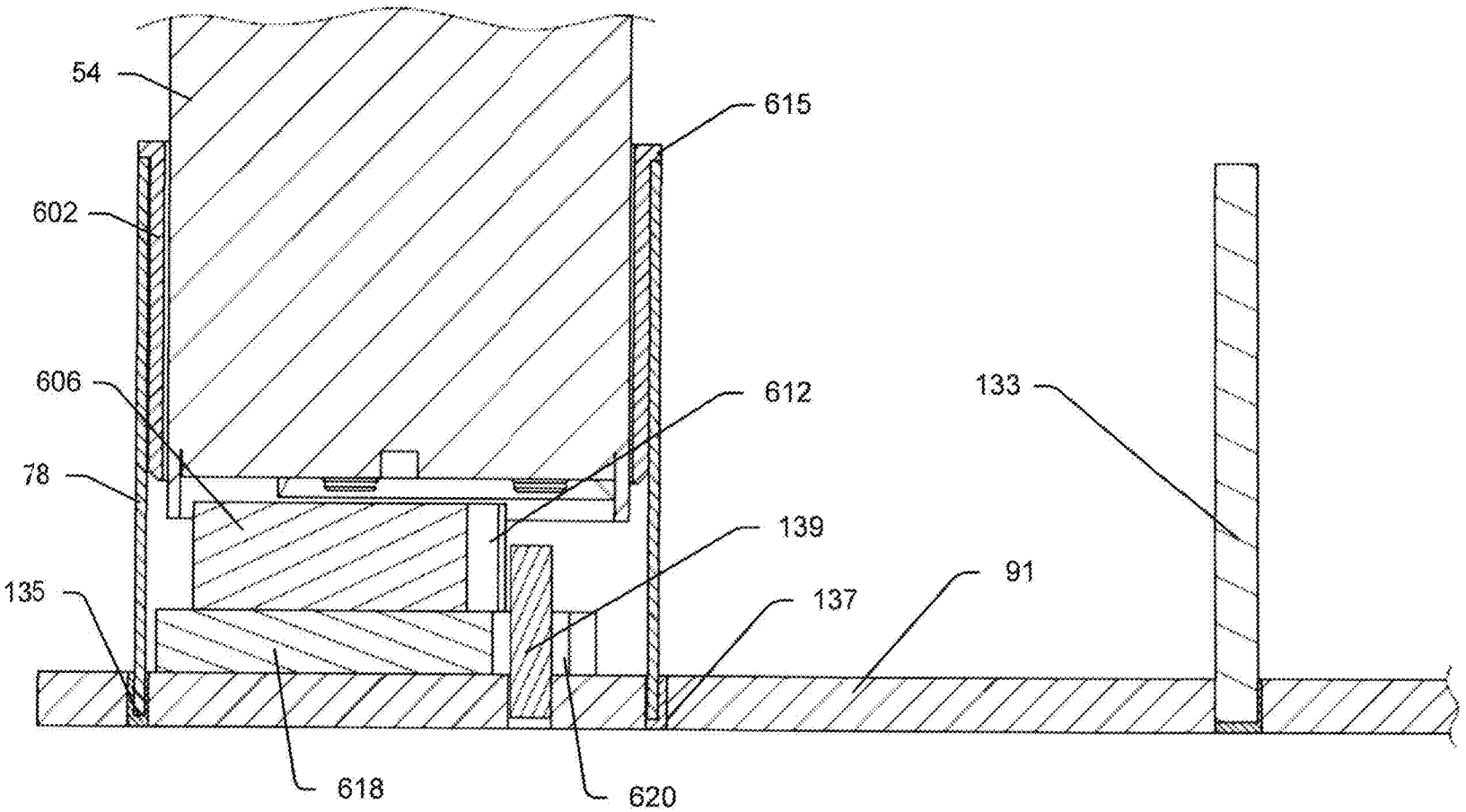
FIG. 16 is a sectional view of the rotation-limiting leg assembly of FIG. 6 taken along the line A-A, albeit with the assembly in an assembled operational state.

Referring to FIGS. 6 and 16, in the illustrated embodiment, the rotation restricting components that cooperate with tab 510*a* to restrict rotation of workstation 20*a* include a friction plate member 618, a second coupler or stop member 606, and a cylindrical bushing 602. Friction plate member 618 is a disc shaped rigid member that includes at least an upper surface that has a low coefficient of friction with the material that forms an undersurface of stop member 606. In some embodiments, plate member 618 is formed of a low friction plastic or other low friction material that as a shape like the circular shape formed by the internal surface of cup member 78 with a cut out edge at 610 shaped to accommodate tab 510*a* when member 618 is placed within the cup cavity on the upper surface of anchor member 91.

Figure 14:
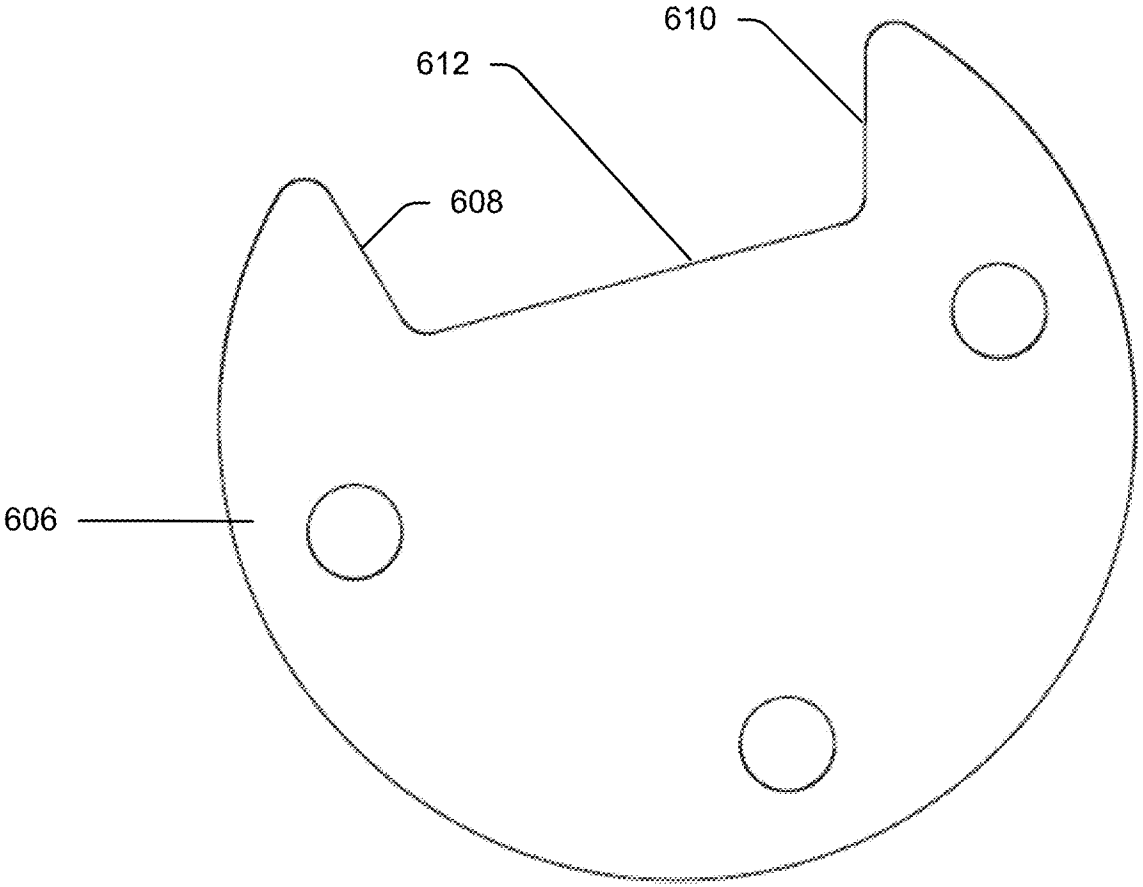
Figure 15:
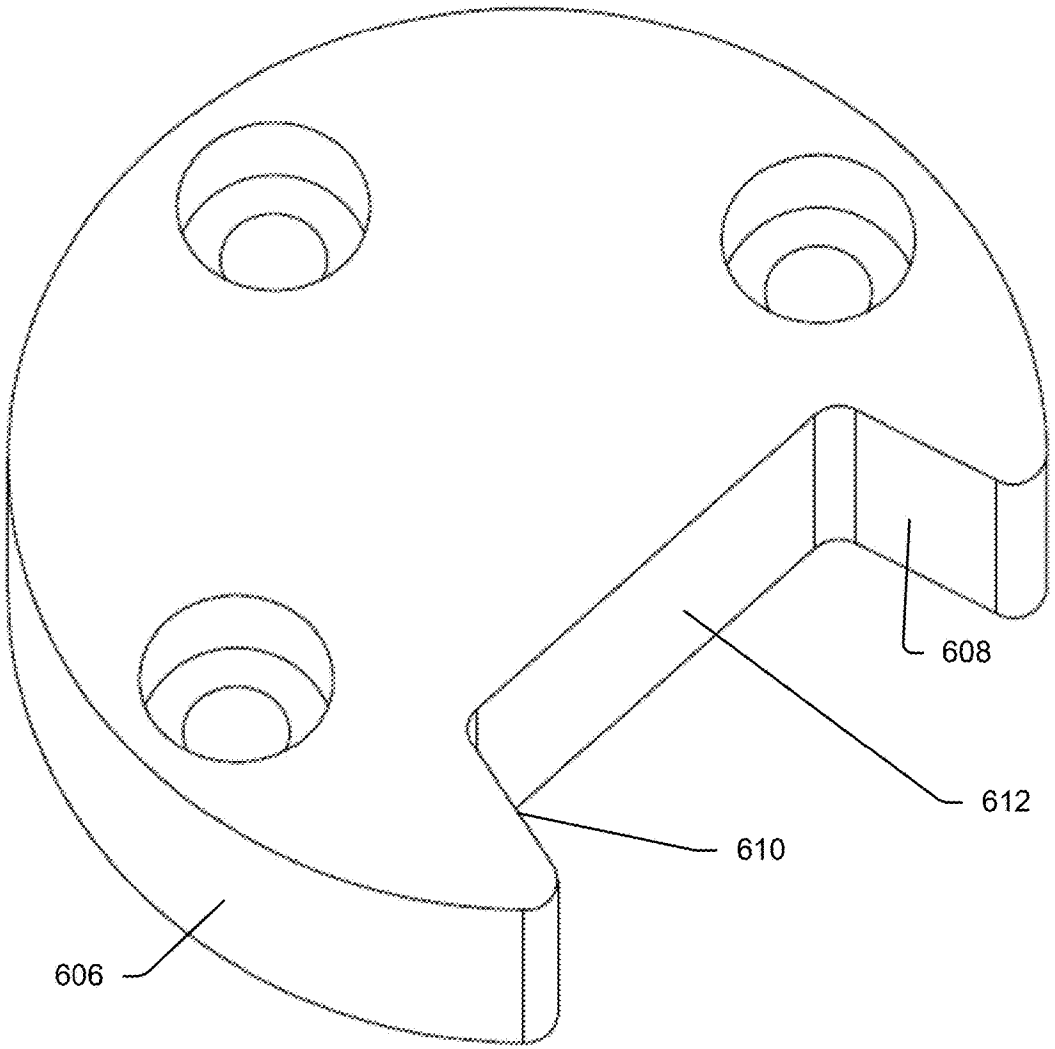

Referring still to FIGS. 6 and 16 and to FIGS. 14 and 15, stop member 606 is puck shaped having an outer cylindrical surface and upper and lower surfaces that forms a cut out or limit space 612 in the cylindrical surface. Opposite surfaces of limit space 612 are generally flat and extend radially outward from a center of member 606 to form first and second stop surfaces 608 and 610, respectively, that angle outwardly away from each other to form an acute angle. In some embodiments the acute angle formed by surfaces 608 and 610 is substantially 40 degrees. The dimension between stop surfaces 608 and 610 is greater than the dimension between limit surfaces 512 and 514 formed by tab 510*a* so that tab 510*a* can be located in different positions within the limit space. To this end, see FIG. 17 where tab 510*a* is shown in a first limit position with stop surface 610 pressed up against limit surface 514 and recognize that stop member 606 could be rotates to other positions with stop surface 610 separated from limit surface 514. In at least some embodiments, the dimension between stop surfaces 608 and 610 enables rotation between first and second limit positions that are separated by 40 degrees of stop member 606 rotation wherein, in the first limit position shown in FIG. 17, stop surface 610 abuts limit surface 514 and in the second limit position, stop surface 608 abuts the other limit surface 512.

A diameter of stop member 606 is less than the diameter formed by the internal surface of cup member 78 so that the side surface of member 606 does not contact the internal surface of cup member 78 during rotation. At least the undersurface of stop member 606 is formed of a material that has a low coefficient of friction with the upper surface of friction plate member 618. Referring still to FIGS. 6 and 16, stop member 606 forms recessed openings for receiving screws or other fasteners to secure stop member 606 to the undersurface of leg assembly 54. The bolt or screw heads are recessed within the undersurface of member 606.

Bushing 602 is a cylindrical bushing that includes an upper radial lip 615 along an upper edge and is dimensioned so that an external surface is snuggly receives in the cavity formed by cup member 78 and an internal surface snuggly receives an outer surface of the lower end of leg assembly 54 as best seen in FIG. 16.

To mount leg assembly 54 to anchor member 91, with cup 78 secured to the upper surface of member 91, friction plate 618 is inserted in the cup opening and is placed on or attached to the upper surface of member 91 with tab 510*a* extending through cutout space 620. Bushing 602 is slid into cup 78 with a lower surface of lip 615 resting on the upper edge of cup 78.

Stop member 606 is positioned on the bottom end of leg assembly 54 so that the limit space 612 (see FIG. 5) is facing rearward with respect to workstation 20*a* as best shown in FIG. 10 (e.g., in plan view the limit space 612 faces the apex area of tabletop member 40). With stop member 606 so positioned, recessed bolts are used to connect member 606 to the lower end of leg assembly 54.

Next, the bottom end of leg assembly 54 and member 606 attached thereto is inserted into the bushing and cup subassembly so that the lower end of leg assembly 54 is journalled within and restricted by the bushing and cup and so that tab 510*a* extends up into the limit space 612.

At this point, leg 54 and the tabletop 40 and other leg assemblies are anchored to spine 30 by the cup member and bushing. Bushing 602 limits friction with the lower end of leg assembly 54 and stop member 606 limits friction with member 618 so the leg assembly can rotate relatively easily about the axis through leg 54 and cup member 68.

In the illustrated example, workstations 20*a* through 20*c* are anchored on one side of spine 30 and workstations 20*d* through 20*f* are anchored along a second side of spine 30 where anchor positions (e.g., the anchor members 91) are equi-spaced along the first and second trough sides, respectively. As shown, the workstations are arranged so that workstation 20*a* is anchored to the same anchor member 91 that workstation 20*d* is anchored to, albeit on opposite sides of the spine 30, workstation 20*b* is anchored to the same anchor member 91 that workstation 20*e* is anchored to, albeit on opposite sides of the spine 30, and workstation 20*c* is anchored to the same anchor member 91 that workstation 20*f* is anchored to, albeit on opposite sides of the spine 30.

Workstation assemblies can be arranged and configured to provide users flexibility to work at various positions relative to workers occupying other workstations, including, for example, a worker at an adjacent workstation. For example, workspace subassemblies including rotatable/pivotable tabletops can allow a user to rotate a workspace subassembly away from an adjacent workstation to obtain greater privacy relative to that workstation or rotate the workstation towards the adjacent workstation to facilitate collaboration with a user at the adjacent workstation.

In FIGS. 1 through 3, the six tabletops 40 of workstations 20*a-f* are in different rotational positions relative to the spine 30 and relative to adjacent tabletops. The tabletops 40 can each rotate through approximately 40 degrees of rotation about corresponding vertical axis extending through the pivoting leg 54, where rotation is limited by stop members 606 and tabs 510*a* through 510*f* (see again FIG. 17).

FIG. 2 is a top plan view of the workstation assembly 10 showing workers seated at workspace subassemblies 20*a-c* and monitors 90*a-c* mounted at the respective workstations 20*a-c*. Tabletop 40*c* of workstation 20*c* is shown rotated fully in a counterclockwise direction to a first limit position, and the tabletop 40*b* of adjacent workstation 20*b* is fully rotated in a clockwise direction to a second limit position. In this configuration, tabletops 40*b* and 40*c* are rotated toward each other and adjacent edges of those tops are parallel and proximate each other, users at workstations 20*b*, and 20*c* are positioned in close proximity, and the monitors 90*b*, 90*c* mounted above the respective tabletops 40*b*, 40*c* are in a field of view of the users at both workstations 20*b*, 20*c* (e.g., privacy screens 72*b*, 72*c* do not impede a view of the monitors 90*b*, 90*c* from the user at the other of workstations 20*b*, 20*c*). A straight portion of the first lateral side edge 68*b* of workstation 20*b* is substantially parallel to and adjacent a straight portion of the second lateral side edge 70*c* of workstation 20*c*. Worksurface 42*b* of workstation 20*b* and worksurface 42*c* of workstation 42*c* can thus be partially substantially continuous (e.g., the worksurfaces 42*b*, 42*c* can define a federated or semi-federated worksurface with a gap between lateral side edges 68*b* and 70*c*).

In FIG. 2, workstation 20*a* is rotated away from workstation 20*b* in a counterclockwise direction. Thus, both workstations 20*a* and 20*b* are rotated away from each other in FIG. 2. The mutual rotation away from adjacent workstations maximizes a distance between the user at the workstation 20*a* and the user at the workstation 20*b* and decreases a visibility of screens 90*a*, 90*b* mounted on the respective workstations 20*a*, 20*b* relative to the user of the other workstation. Mutual rotation of the workstations 20*a*, 20*b* away from each other also reduces visibility of worksurfaces 42*a*, 42*b* from the adjacent workstation 20*a*, 20*b*.

Referring still to FIG. 2, workstations 20*d* and 20*f* are rotated at least partially clockwise and counterclockwise, as illustrated, respectively, so that they are rotated away from central workstation 20*e* to increase privacy. Workstation 20*e* is rotated to a middle position halfway between the first and second limit positions so that the tabletop 40*e* is in a neutral privacy position.

Rotation range of each tabletop is limited mechanically by structure within the rotational coupling between the tabletop of a respective workstation and the spine, so that the tabletop (e.g., the privacy screen, the worksurface and items supported on the worksurface including screens, etc.) associated with a workstation cannot collide with the tabletop, screens, etc., of a second workstation located on an opposite side of the spine or with a second workstation located laterally adjacent the first workstation. In exemplary embodiments, the rotation restriction mechanism is designed such that no rear edge portion of the tabletop extends past a central vertical plane 233 (see FIG. 2) through the spine 30 that is aligned with the length dimension of the trough regardless of rotation position of the tabletop. In this regard, see again FIG. 2 where tabletops 40*b* and 40*c* are shown at extreme rotational limit positions where rear edge portions do not extend past the center of the trough.

In some cases, when first and second tabletops on opposite sides of spine 30 are rotated to their limit positions in opposite directions (e.g., one clockwise and one counterclockwise), adjacent rear edge portions of those tabletops are parallel and proximate each other (e.g., within 1-2 or less inches of each other). Further in the illustrated example, the pivoting leg members of adjacent tabletops on the same side of the spine are spaced apart along the length dimension of the spine such that when the adjacent tabletops are rotated toward each other to limit positions, adjacent edges of the tabletops are parallel and substantially immediately adjacent each other (e.g., only a small gap (e.g., 1-2 or less inches) exists between the adjacent edges).

FIG. 17 illustrates the rotation-limiting mechanisms of the six workstations shown in FIG. 1 with the tabletops in the positions illustrated. In the figures including top plan views including FIG. 17, a circled "P" indicates a workstation rotation point. Thus, for instance, in FIG. 17, tabletop 40*a* rotates about the pivot point "P" centrally located along the rear edge of top member 40*a*. In FIG. 17, orientations of the tabletops are shown, along with corresponding orientations of stop members of rotation-limiting mechanisms for the workstation, showing a spatial relationship between the stop member 606*a* through 606*f* and the upwardly extending limiting tab members 510*a* through 510*f*, respectively, of the dual-anchor members 91. A first tabletop 40*a* and a second tabletop 40*d* that are across from each other are shown fully rotated in a counterclockwise direction with stop members 510*a* and 510*d* connected thereto likewise rotated in counterclockwise direction until stop surfaces of members 606*a* and 606*d* abut and are limited by adjacent limit surfaces of tabs 510*a* and 510*d*, respectively.

A third tabletop 40*b* is rotated to an intermediate orientation between the limit positions and tab 50*b* associated therewith is shown in an intermediate position substantially equi-spaced between the stop surfaces formed by stop member 606*b*. A fourth tabletop 40*e* across from the third tabletop is shown rotated in a clockwise direction with the associated stop member 606*e* similarly rotated in that direction so that a stop surface of member 606*e* abuts a limit surface of tab 510*e*.

A fifth tabletop 40*c* is shown rotated in a clockwise direction with the associated stop member 606*c* rotated in that direction so that a stop surface of member 606*c* abuts a limit surface of tab 510*c*. A sixth tabletop 40*f* across from the fifth tabletop is shown rotated in a counterclockwise direction with the associated stop member 606*f* similarly rotated in that direction so that a stop surface of member 606*f* abuts a limit surface of tab 510*f*.

As shown, when the tops are positioned as described above, a first straight rear edge portion of top 40*a* is aligned with the central trough plane 233 and top 40*a* is rotated away from adjacent top 40*b*, tops 40*d* and 40*e* are rotated toward each other so user's of those tops can collaborate, tops 40*c* and 40*f* are rotated away from adjacent tops 40*b* and 40*e* and have straight rear edges adjacent each other, and top 40*b* is in an intermediate position between tops 40*a* and 40*c* on opposite sides.

Referring still to FIG. 17, it should be appreciated that at least portions of the tops along rear edges can be positioned such that they overlap the spine 30 when viewed in top plan view. In addition, when any of the tabletops is rotated about an associated pivot point P to a limit position, at least one straight edge portion of the rear edge of the top will be parallel to the central spine plane 233, a straight edge portion of the front edge of the top will be parallel to the central trough plane 233, one lateral edge of the top will be perpendicular to the central trough plane and the other lateral edge will be angled at approximately 40 degrees with the central trough plane. In addition, when adjacent tabletops on the same side of the trough 30 are rotated toward each other, adjacent front edge portions of the tops will be substantially in line.

Thus, referring again to FIG. 17, tabletop 40*e* can be rotated between the position illustrated with a lower lateral edge adjacent tabletop 40*d* or could be rotated counterclockwise 40 degrees to it second limit position with the upper lateral edge proximate tabletop 40*f*.

Figure 18:
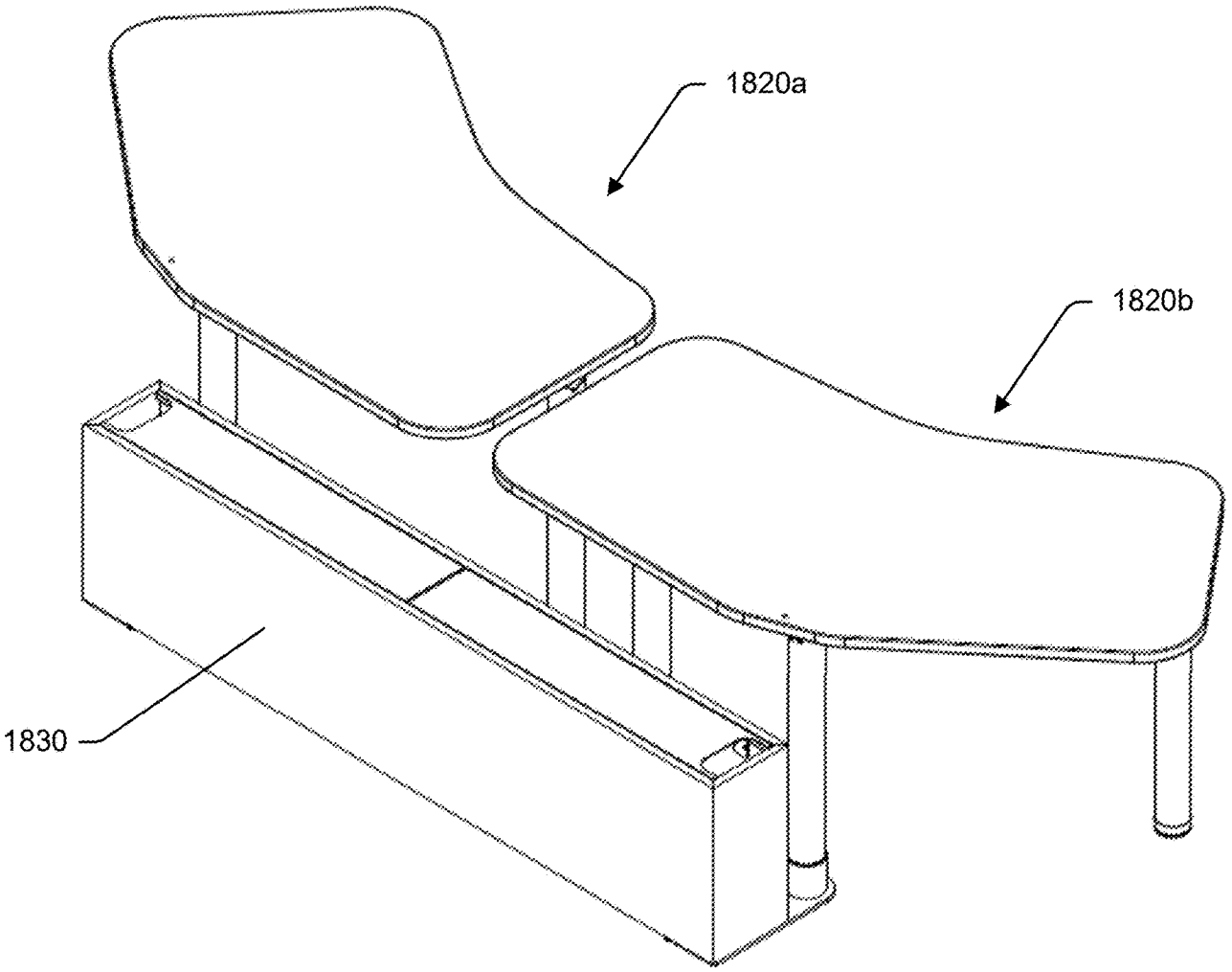
FIG. 18 is a perspective view of another exemplary workstation assembly that includes, among other components, two workstations and a spine, according to some aspects of the disclosure.
Figure 19:
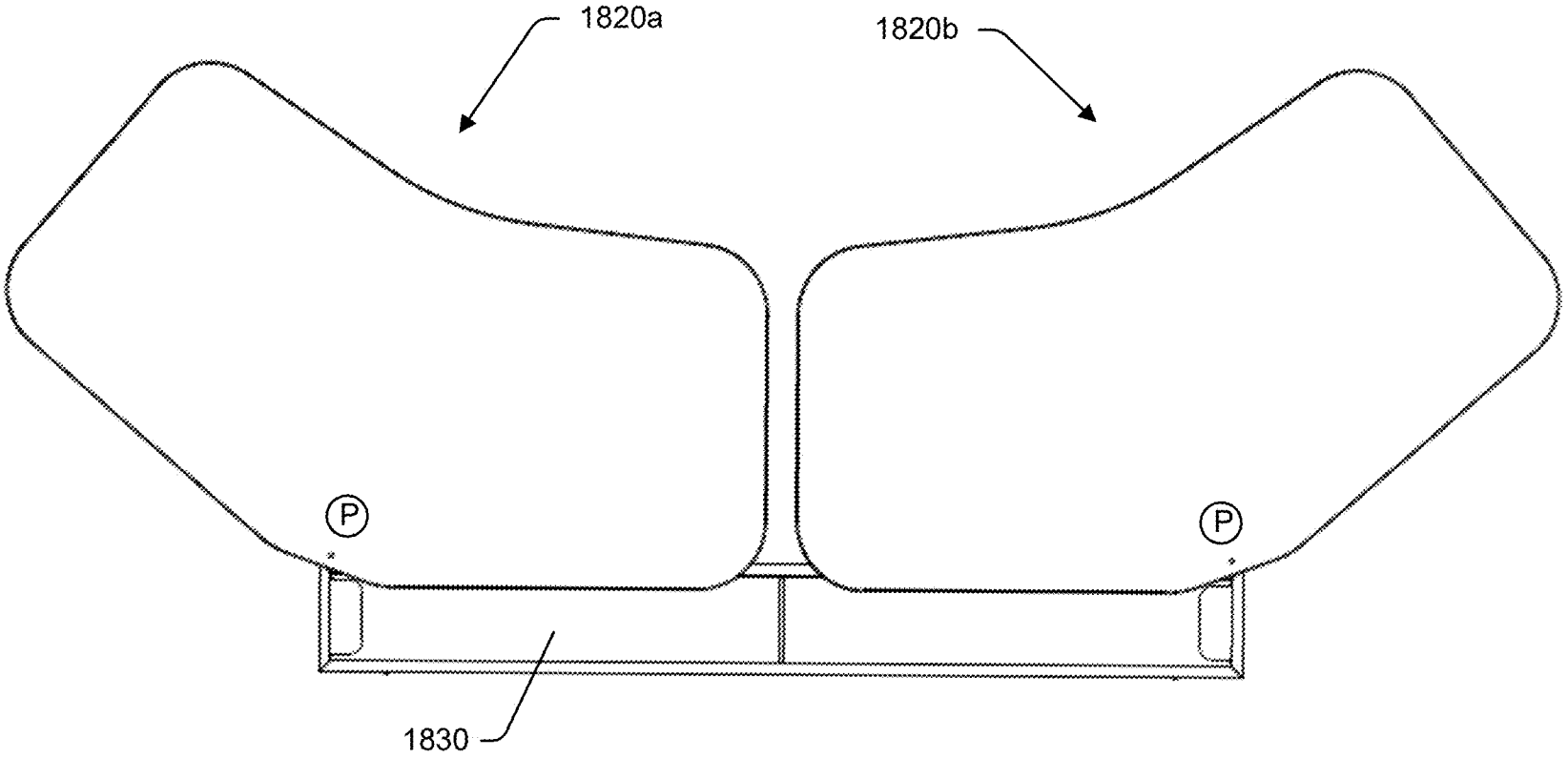
FIG. 19 is a top plan view showing two tabletops of the workstations of FIG. 18, according to some aspects of the disclosure.

In some cases, as mentioned above, workspace assemblies can include more or fewer workstations, arranged in various geometrical configurations. For example, FIGS. 18 and 19 illustrate another exemplary workstation assembly including two workstations 1820*a* and 1820*b* mounted on a first side of a spine 1830. Here, subassemblies 1820*a* and 1820*b* do not include privacy screens. In FIG. 18, when subassemblies 1820*a* and 1820*b* are rotated to align side edges of the tabletops of the respective workstations, the collective area of the tabletops of the workstations can form a relatively continuous (e.g., federated) worksurface. In some cases, as shown, when tabletops of adjacent workstations are rotated maximally towards each other, a gap can be provided between side edges of the adjacent tabletops. In other embodiments, the gap between side edges of adjacent tabletops can be negligible to advantageously promote collaboration across the worksurfaces.

Figure 20:
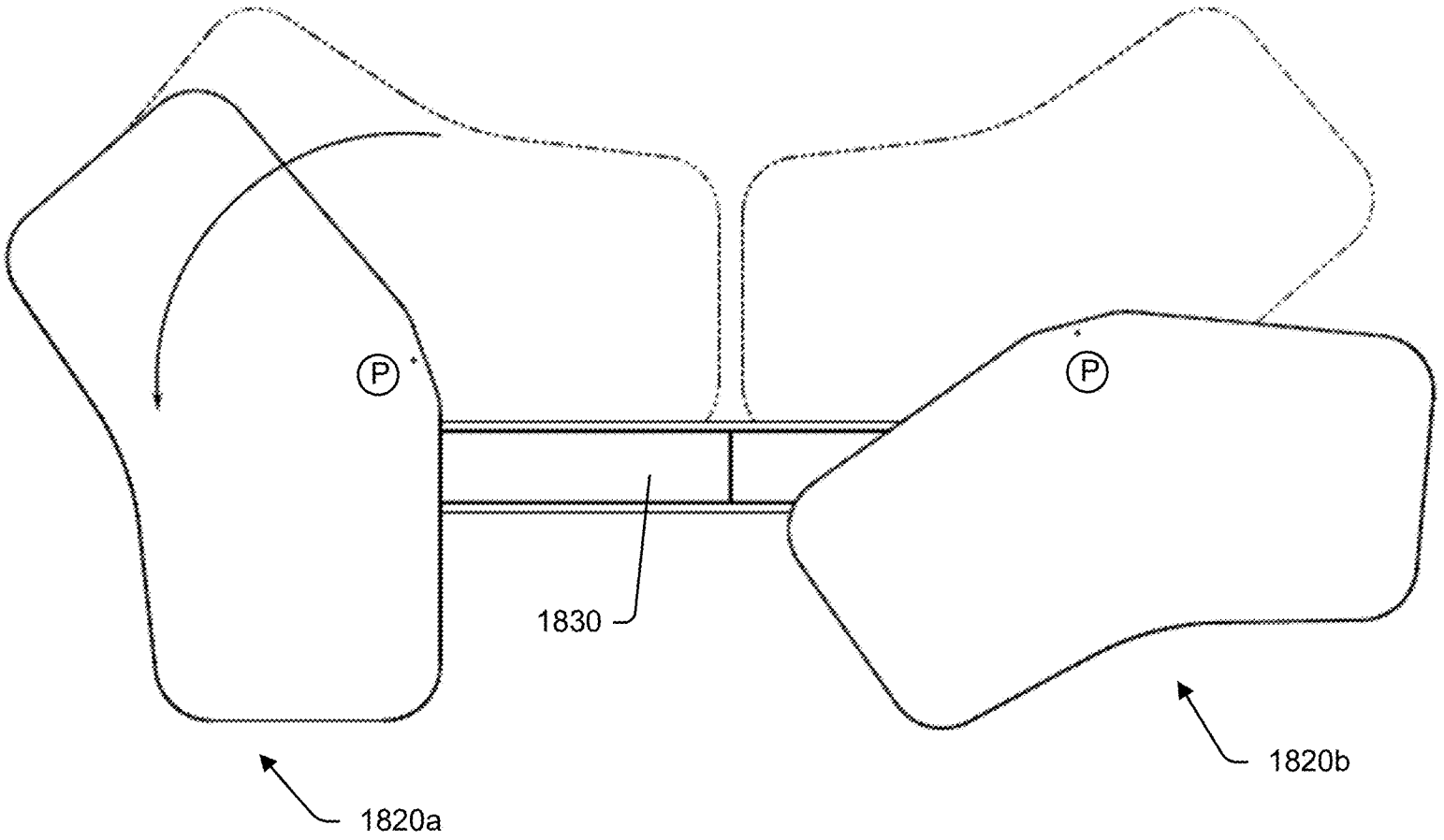
FIG. 20 is a top plan view showing the two tabletops of the workstations of FIG. 18 in different rotational positions, according to some aspects of the disclosure.

In some cases, workstation assemblies can be configured to facilitate more or less than 40 degrees of rotational movement. For example, in the examples of FIGS. 1-17, the rotation-limiting mechanisms limit rotation of each workstation to about 40 degrees. FIG. 20 shows workstations 1820*a* and 1820*b* from FIGS. 18 and 19 rotated beyond 40 degrees. For example, in some cases it can be advantageous to rotate a worksurface to be usable from opposite sides of spine 1830. As shown in FIG. 20, the illustrated embodiment can facilitate rotation of a first workstation tabletop from first positions (e.g., the phantom position) with the workstation oriented on a first side of the spine, to second positions with the first tabletop rotated by greater than 90 degrees, and a second tabletop rotated to be usable from an opposite side of the spine from the original position of the second tabletop. Here, it is still contemplated that the rotating leg assemblies would include limiting structure akin to that described above to limit rotation of the tabletops to positions wherein the tops do not collide with other assembly tabletops and to limit rotation so that the front legs (see 50 and 52 above) do not collide with sine 1830. In this case, however, to facilitate a greater angular degree of rotation, the stop member (see 606 in FIGS. 6, 14 and 15 above) would have a larger limit space 612.

Figure 21:
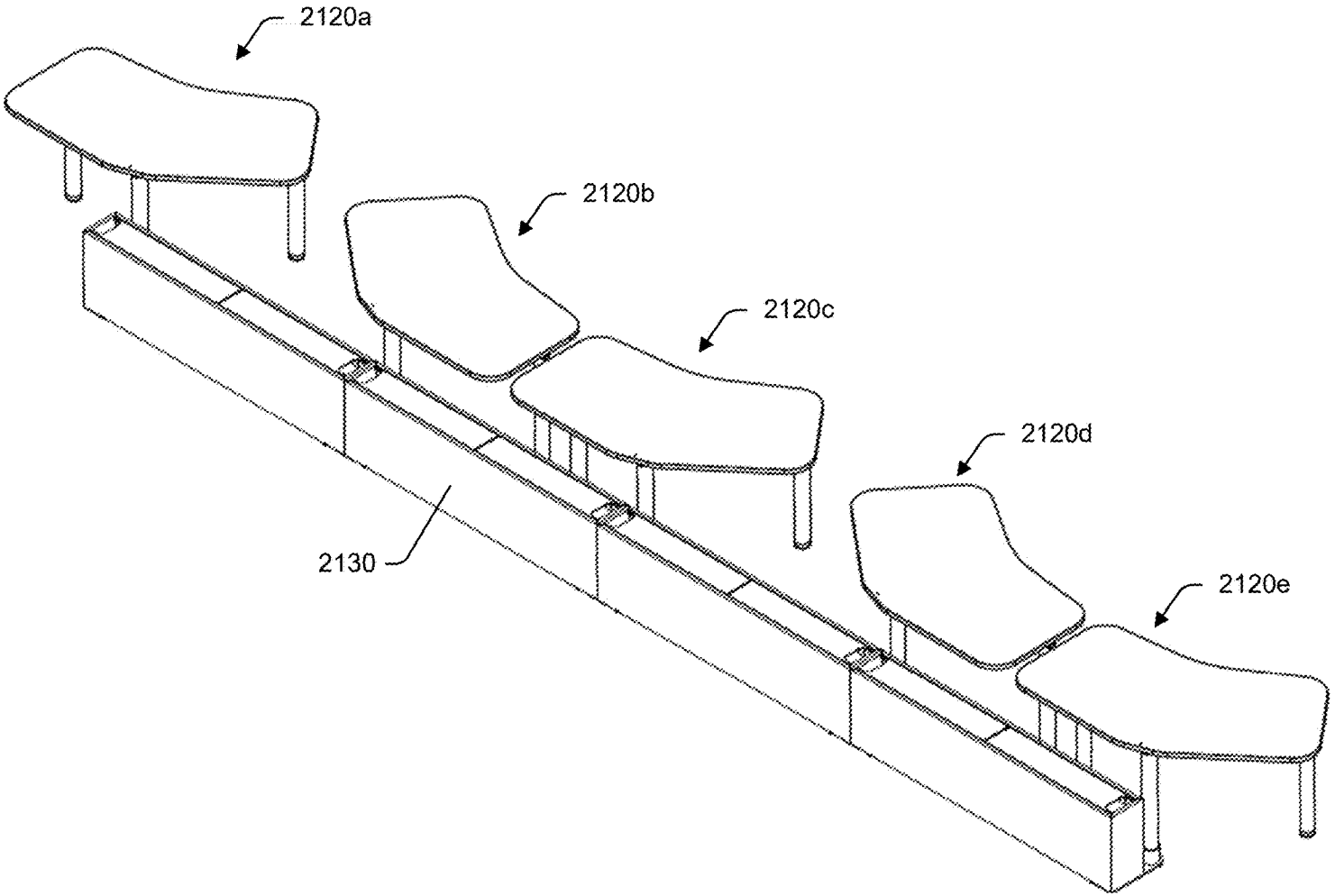
FIG. 21 is a perspective view of an exemplary workstation assembly that includes, among other components, five workstations along a first side of a spine.

FIG. 21 illustrates another exemplary workspace assembly including five workstations 2120*a* through 2120*e* arranged along a first side of spine 2130. As shown, the spine can be modular, and can include a plurality of repeating sections to support a desired number of workstations. In the illustrated embodiment, three central workstations are positioned between two distal workstations 2120*a* and 2120*e*. In some cases, rotation of workstations within a workstation assembly can be variable, and some workstations can have different rotational restrictions than other workstations. For example, central workstations 2120*b*, 2120*c* and 2120*d* can include rotation-limiting mechanisms to limit a rotation of the subassemblies to 40 degrees as described with respect to the workstations illustrated in FIGS. 1-17 to prevent collision with the spine and adjacent workstations. The distal workspace subassemblies 2120*a* and 2120*e* can include rotation-limiting mechanisms that allow greater (e.g., more than 40 degrees) rotational range of movement for the distal workstations. In some examples, the distal workstations can be rotatable around the respective ends of the spine to allow users of the distal workstations to work from opposite sides of the spine 2130.

Figure 22:
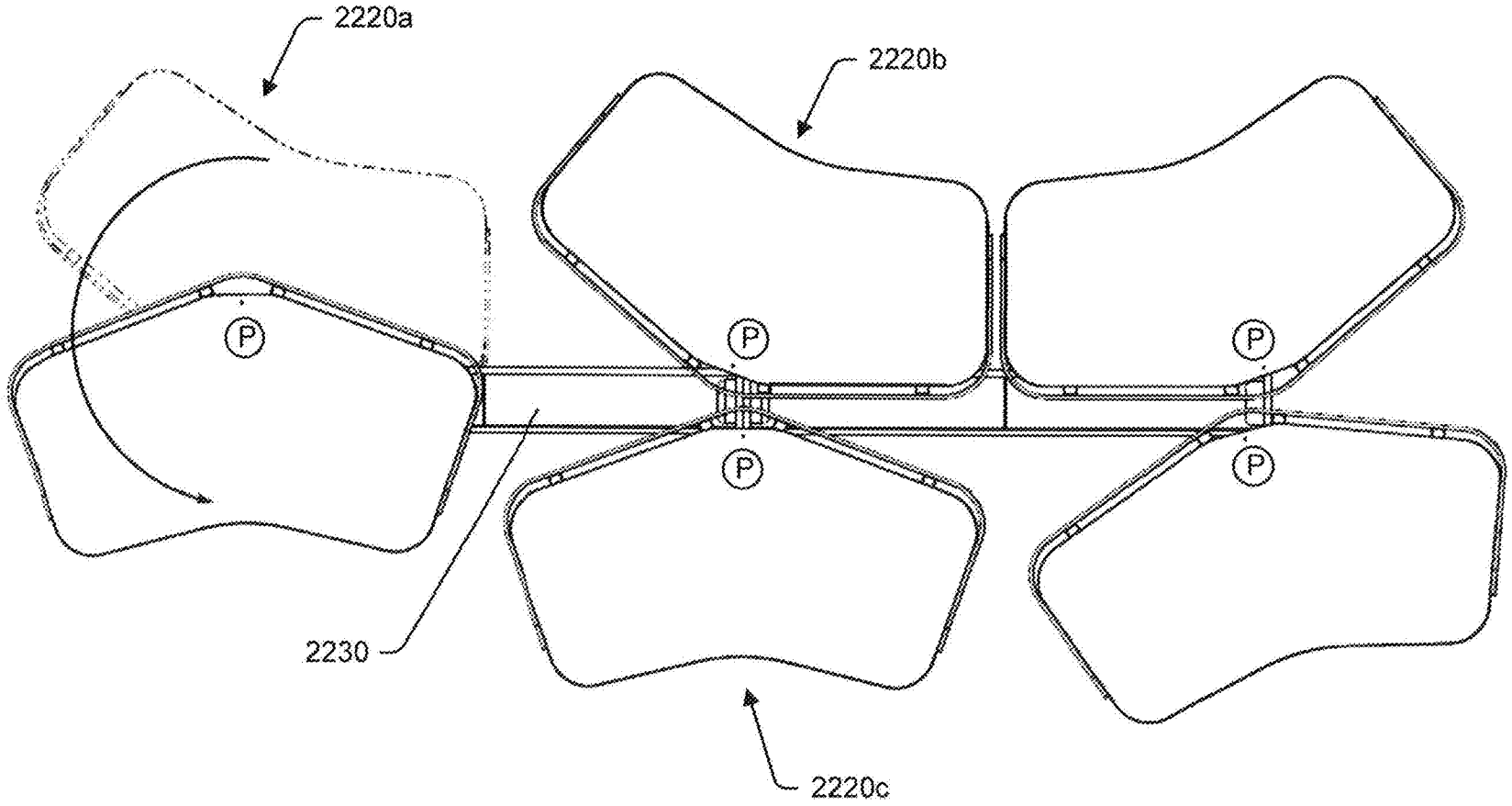
FIG. 22 is a top plan view of five tabletops of workstations of an exemplary workstation assembly in different rotational positions, according to some aspects of the disclosure.

In some cases, a distal workstation having a greater range of rotation can allow a user to collaborate with users on either side of a spine. For example, as shown in FIG. 22, a workstation assembly can include workstations on opposite sides of a spine 2239, and a distal workstation 2220*a* can rotate between a first position (shown in phantom) with the workstation on a first side of spine 2230 adjacent to a workstation 2220*b* on the first side of the spine, to a second position with the distal workstation 2220*a* on a second side of spine 2230, adjacent to a second workstation 2220*c* on the second side of the spine.

Figure 23:
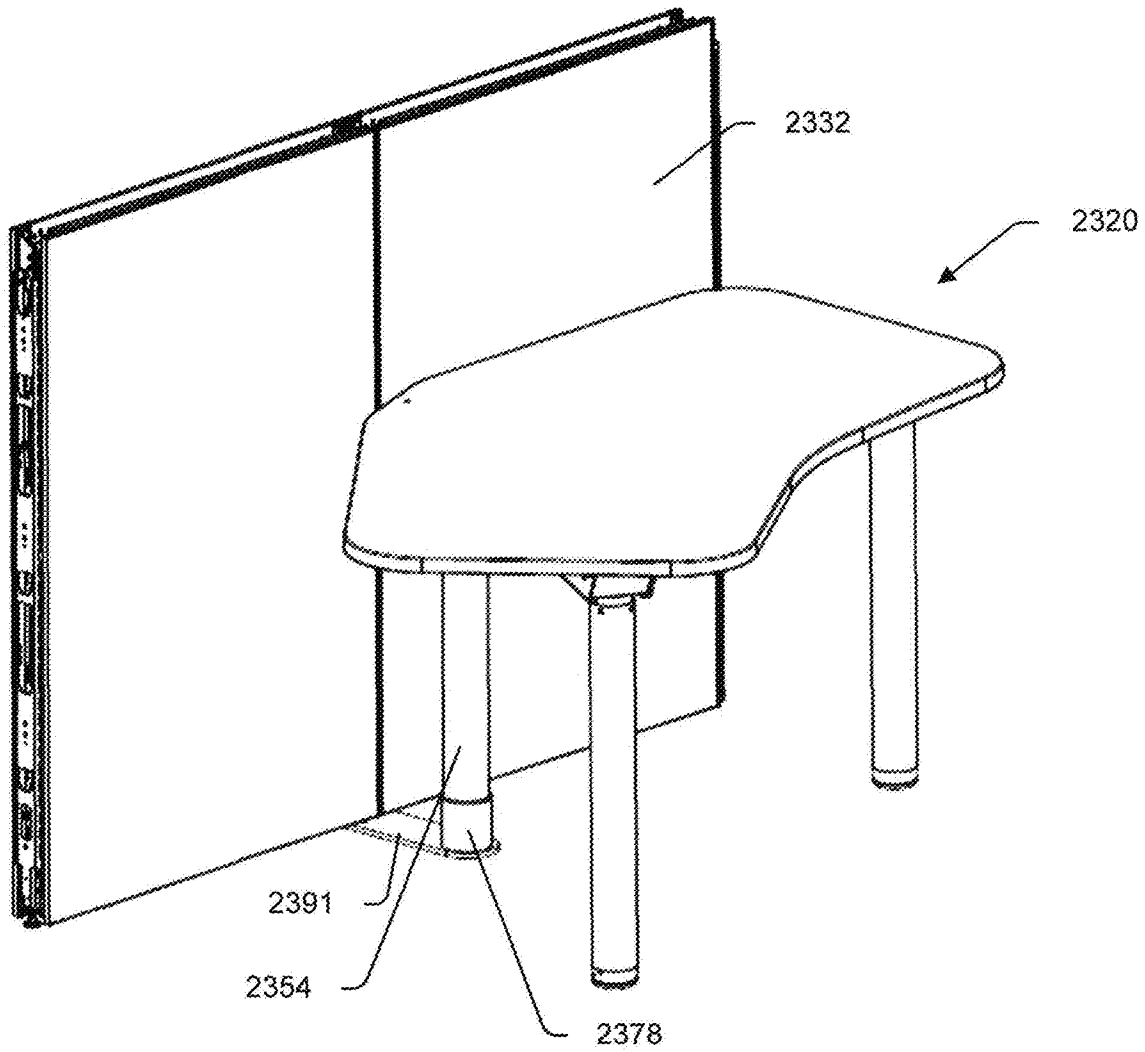
FIG. 23 is a top angled perspective view of an exemplary workstation assembly showing a workstation and a panel support assembly.
Figure 24:
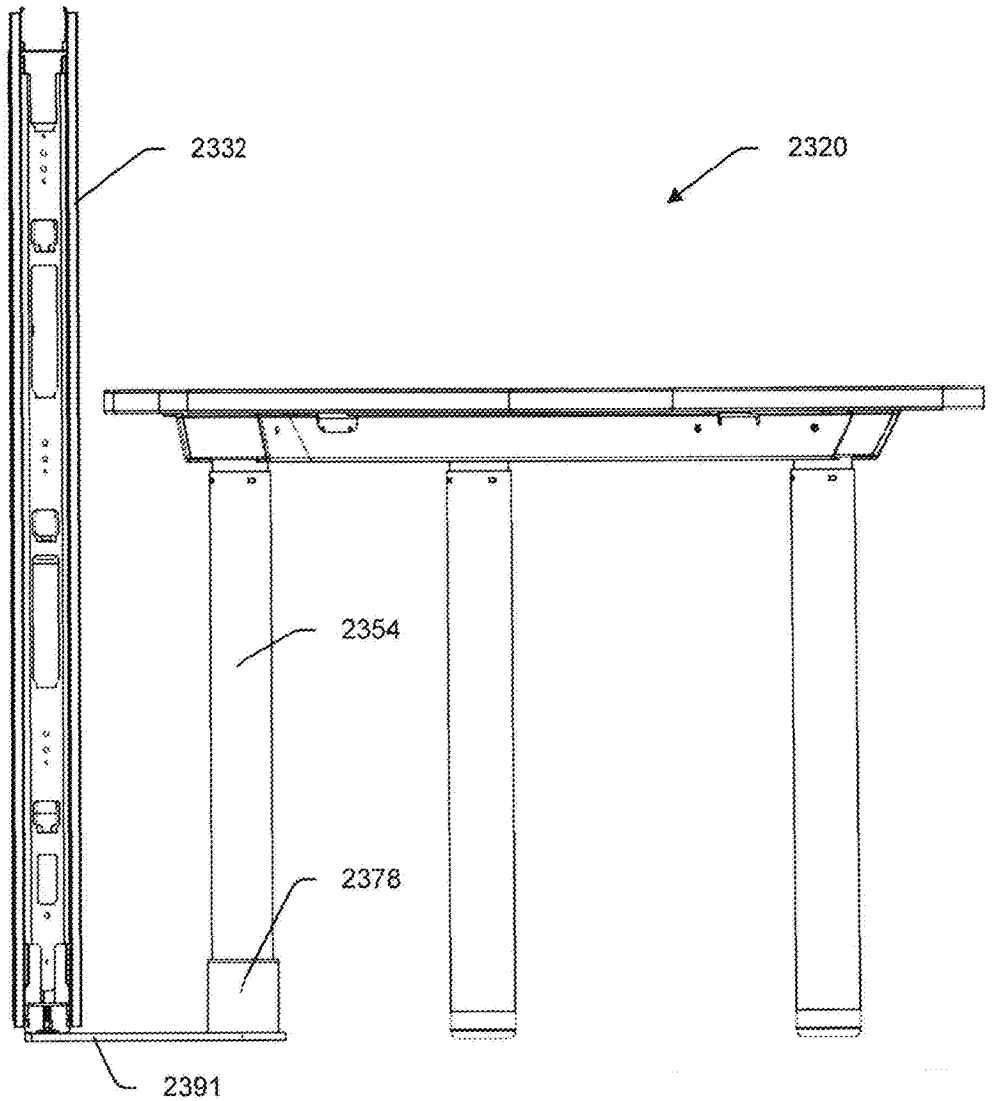
FIG. 24 is a side plan view of the workstation assembly of FIG. 23.

In some cases, a workstation assembly will not include a spine. For example, referring to FIGS. 23 and 24, a workstation 2320 can be positioned along a wall 2332 of a workspace (e.g., an internal wall, an external wall, a dividing wall, etc.). In some examples, workstation assembly 2320 can include a panel with an anchor assembly 2391 for fixing a position of a pivoting leg 2354 of a workstation relative to the panel. Workstation 2320 can be similar or identical to any of the workstations described above. Further, a rotation-limiting mechanism of the workstation can be similar or identical to the rotation-limiting mechanisms described with respect to the examples provided above. As illustrated, an anchor member 2391 extends outwardly from an underside of the panel 2332 and can include a cup member 2378 for at least partially receiving pivoting leg 2354 of the workstation. The anchor member can extend outwardly by any desired length, allowing the workstation to be anchored at any desired distance from the panel.

Figure 25:
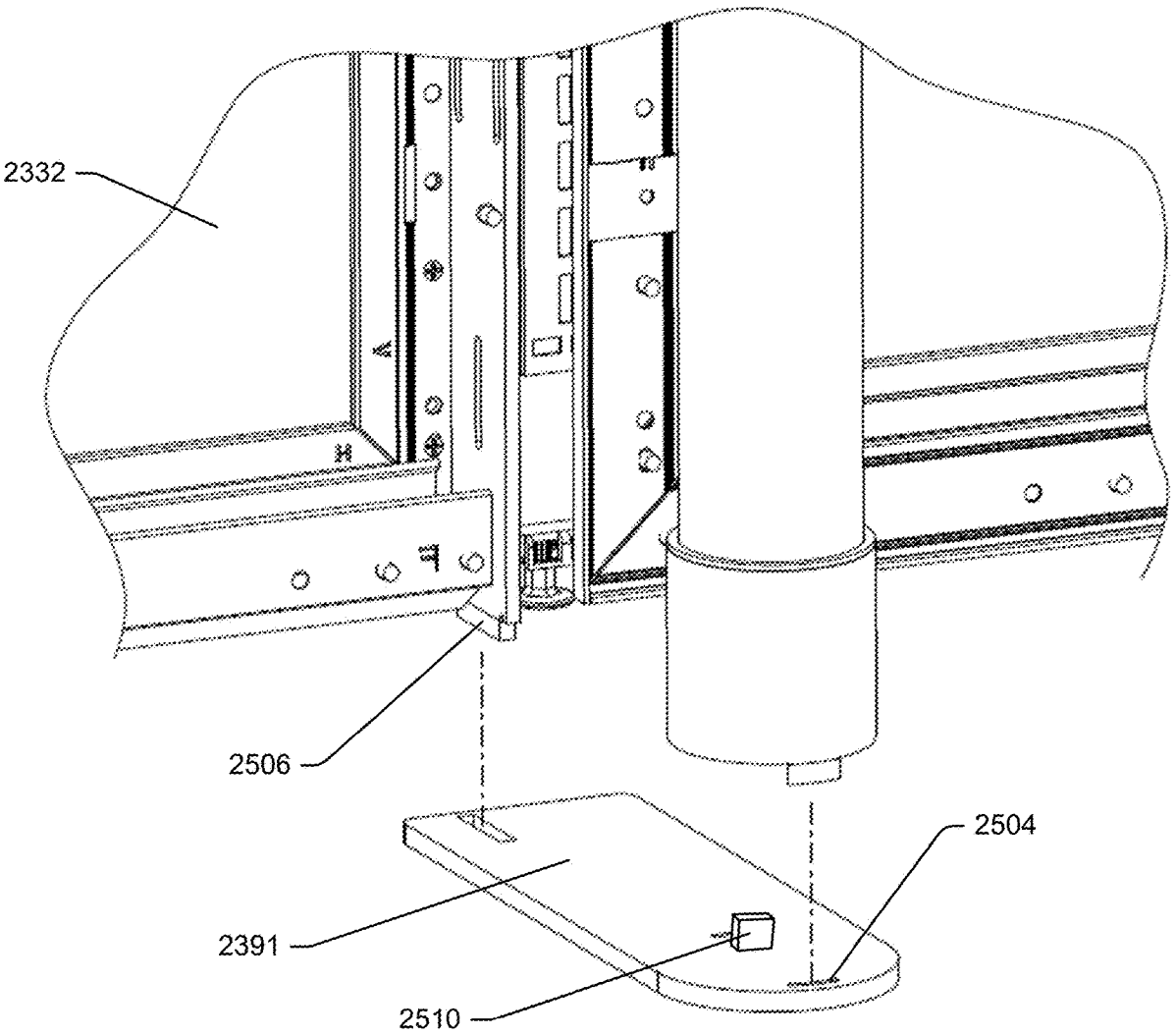
FIG. 25 illustrates a leg retention assembly for the workstation assembly of FIG. 23.

Referring to FIG. 25, the anchor member 2391 can include one or more slots for receiving downwardly-depending tabs 2506 of the panel member, to prevent movement of the anchor member 2391 relative to the panel member 2332. Further, as shown, the anchor member can include a slot 2504 for receiving a downwardly depending tab of the cup member. As shown, anchor member 2391 includes an upwardly extending tab 2510 that cooperates with other components to limit leg rotation as described above to 40 degrees or some other range of rotation.

In the embodiments illustrated above, the screen 72 is a single piece screen. In other embodiments two generally L-shaped screens may be mounted to one or more edges of a tabletop. For example, referring to FIG. 41, a workstation can include a first privacy screen wrapping a left rear corner of a tabletop, and a second privacy screen wrapping a right rear corner of the tabletop, with a space between adjacent edges of the two screen that is open along a central portion of a rear edge of the tabletop. One or more computer displays can be centrally mounted to the rear edge of the tabletop with emissive surfaces facing in the direction of the front edge of the tabletop. In some cases, the display(s) operate(s) as a privacy screening mechanism to substantially block the space between two corner wrapping privacy screens.

In some cases, privacy screens of a workspace subassembly can be adjustable to provide a user a desired level of privacy. For example, sections of a privacy screen can be foldable to remove a barrier between the user and another user or another tabletop. In some cases, privacy screens can be selectively moved in a vertical direction (e.g., up or down) to provide greater or lesser privacy for a user of the workstation. In some examples, a workstation does not include a privacy screen. In some cases, when adjacent workstations are rotated towards each other (e.g., facilitating a collaboration between workers at the adjected workstations), privacy screens of either or both of the adjacent workstations can be adjusted to at least partially remove a barrier between worksurface of the respective workspace subassemblies.

The through subassemblies described above are generally straight. In other embodiments the spine can define other geometries. For example, a spine can include bends, or curves. A spine can define an "S-shape" or can have two or more straight sections positioned at oblique angles relative to each other. The shape and dimensions of a spine can be designed for a particular space and can facilitate various potential configurations of workstations relative to other workstations of a workstation assembly.

In some embodiments, rotation of a workstation can be limited to other angular ranges, including, for example, up to about 30 degrees, 50 degrees, 60 degrees, 90 degrees, 180 degrees, or other ranges of rotation. In some examples, rotation of a workstation is only constrained by potential contact with other components of a workstation (e.g., a spine, a panel subassembly, or other workspace subassemblies) or other items associated with a workstation (e.g., a wall, a barrier etc.).

Figure 26:
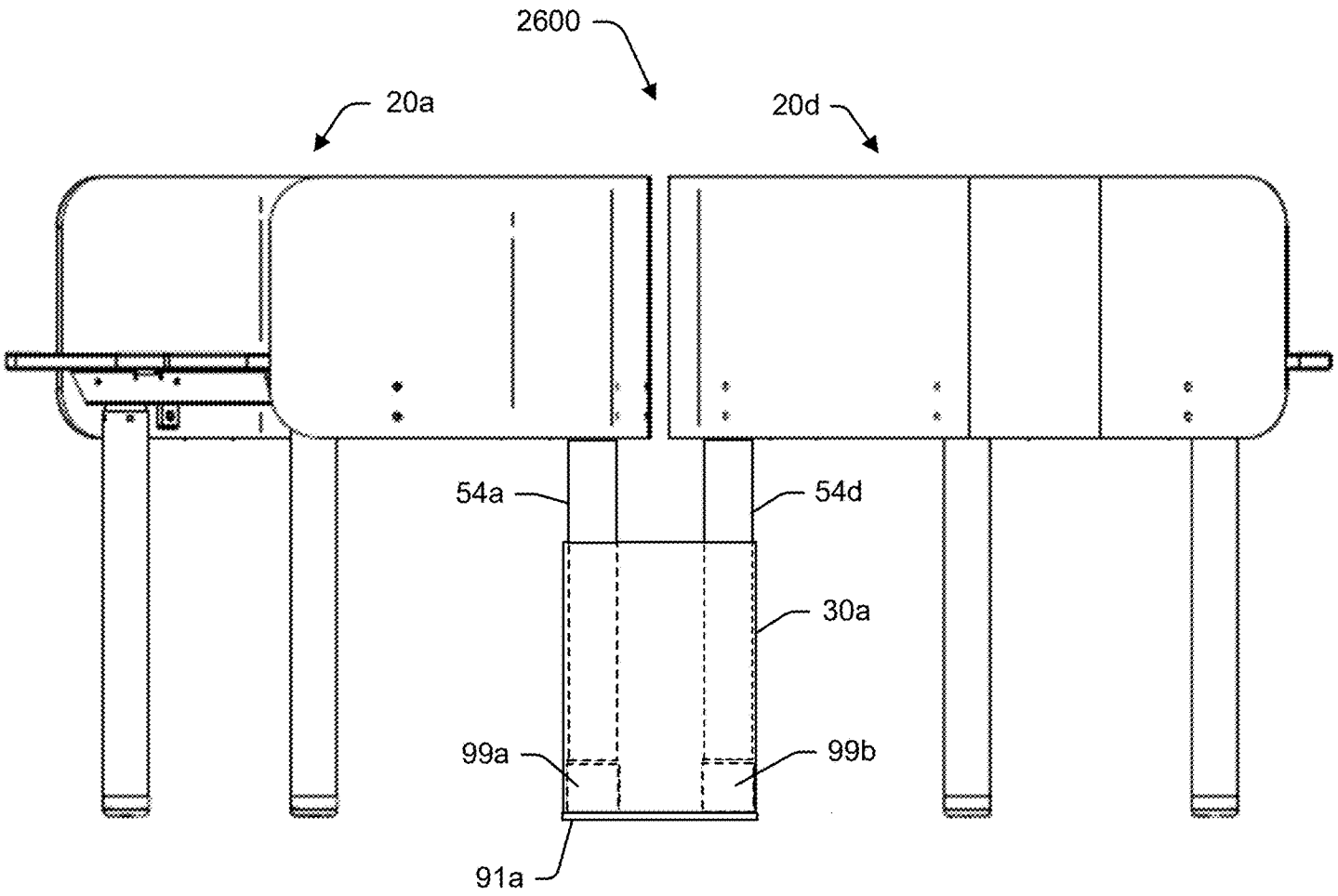
FIG. 26 is a perspective view of another workstation assembly including workstations including pivoting legs that extend down into and are anchored within a space defined by a spine structure.

In some embodiments the spine may be wider and the pivoting legs of workstations may extend down into the spine so that outer panel portions of the spine hide lower ends of the pivoting legs to provide a more finished appearance. To this end see FIG. 26 where a workstation assembly 2600 includes a relatively wide spine 30*a* and at least first and second workstations 20*a* and 20*b*, respectively. In this embodiment, workstations 210*a* and 20*b* are like those described above and in at least some cases would include the rotation restricting mechanism 99 described above. The only different in FIG. 26 is that spine 30*a* is relatively wide so that the lower pivoting legs extend to lower ends located within the cavity formed by spine 30*a*.

Figure 27:
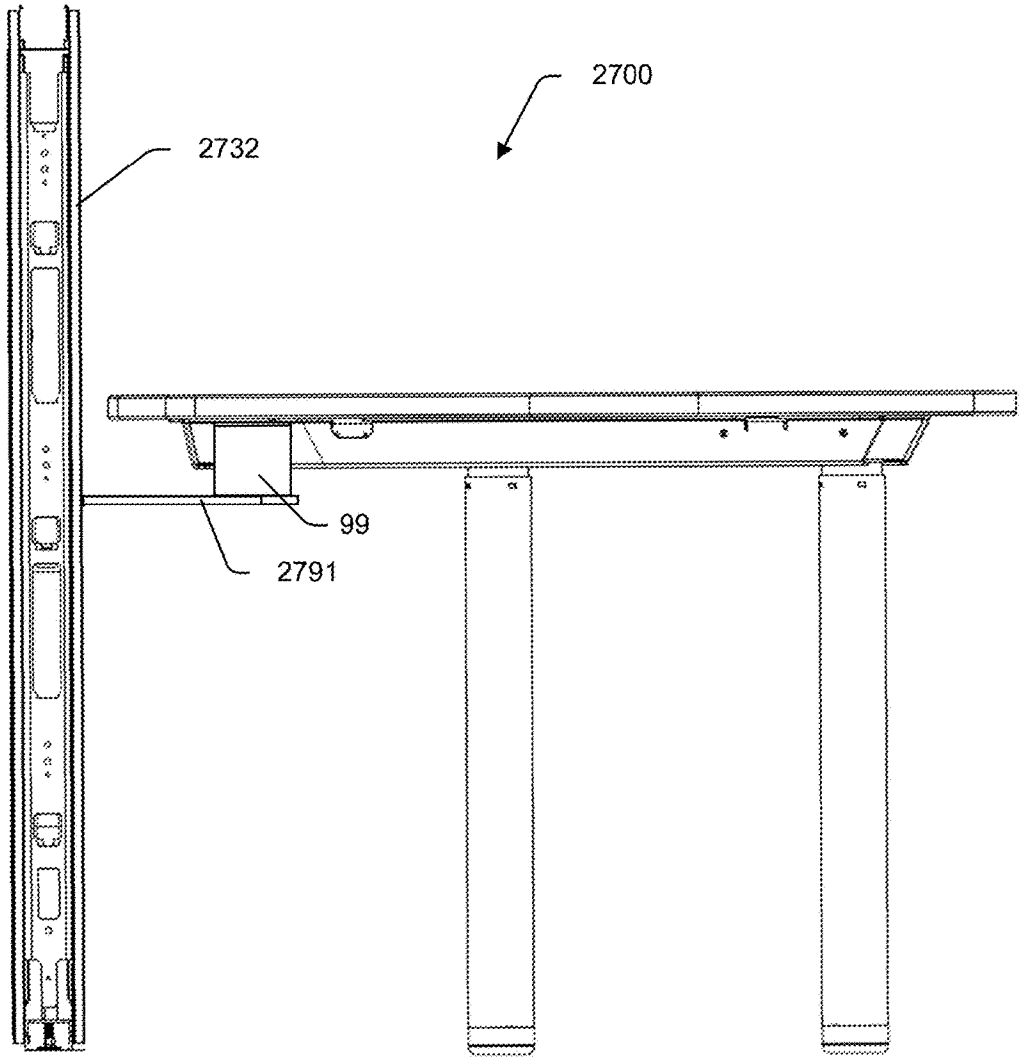
FIG. 27 is a side view of another workstation assembly mounted for rotation to a panel wall where a rotation restricting mechanism is located immediately below a tabletop.

In cases where a workstation tabletop is not height adjustable, the rotation restricting mechanism may be located just below the tabletop and need not include a leg there below. In this regard, see FIG. 27 where a system 2700 includes a shoulder member 2791 that extends from a wall panel system at a height just below the tabletop undersurface and where the rotation restricting mechanism 99 akin to those described above is provided between an upper surface of shoulder member 2791 and an undersurface of the tabletop.

In still other embodiments that include a height adjustable tabletop, the rotation restricting mechanism may be provided at the upper end of a height adjustable leg where the lower end of the leg is anchored to a panel or spine. For example, see FIG. 28 where a lower end of height adjustable leg 4854 is secured or affixed to an anchor member 4891 so that the lower end of the leg will not rotate and an upper end of leg 4854 is secured to a bottom end of a rotation restricting mechanism 99 with the tabletop mounted to the upper end of the rotation restricting mechanism 99. In this case, the stop member 606 described above is rigidly connected to the undersurface of the tabletop and received in a cup shaped space at the upper end of leg 4854 to cooperate with a limit tab to restrict tabletop rotation to a specific range.

In at least some cases it is contemplated that it may be advantageous to decouple a workstation from its anchored and limited position at times to use at a different location or in a different orientation that is not supported by the system design. To this end, in at least some cases it is contemplates that a system may enable a user to lift a workstation upward so that a coupled leg can be removed from the rotation restricting mechanism and moved to a desired location or orientation. In this regard, see FIG. 29 where a system 2800 includes a spine 2830 including a dual anchor assembly 2891 and first and second workstations 2820*a* and 2820*d*.

In the illustrated example, each workstation 2820*a* and 2820*b* includes three legs and casters 2822 are provided at the lower ends of each of the three legs so that when the workstation can be moved with little friction between the lower ends of the legs and an ambient floor surface. A notch is cut out of the side surface at the lower end of the rear leg of each of the workstations to provide stop surfaces for limiting workstation rotation in a manner similar to that described above. To this end, see also FIG. 30 that shows a cross section taken along the line B-B in FIG. 29 of the lower end of leg 54*a* where a radial notch 2870 is formed in the outer surface of the leg that forms first and second stop surfaces 2872 and 2874. A similar notch 2870 can be seen in leg 54*b* of workstation 2820*b* in FIG. 29.

Figure 28:
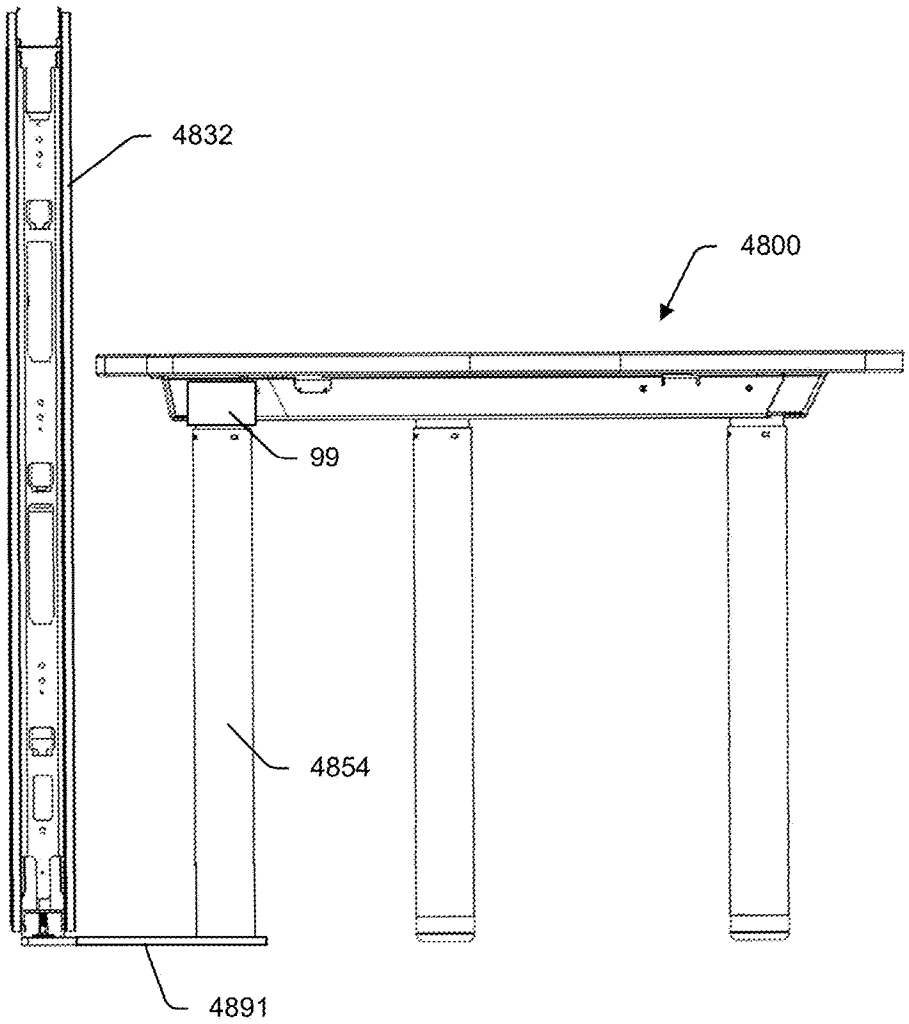
FIG. 28 is similar to FIG. 27, albeit where a rotation restricting mechanism is at an upper end of a stationary rear leg.
Figure 29:
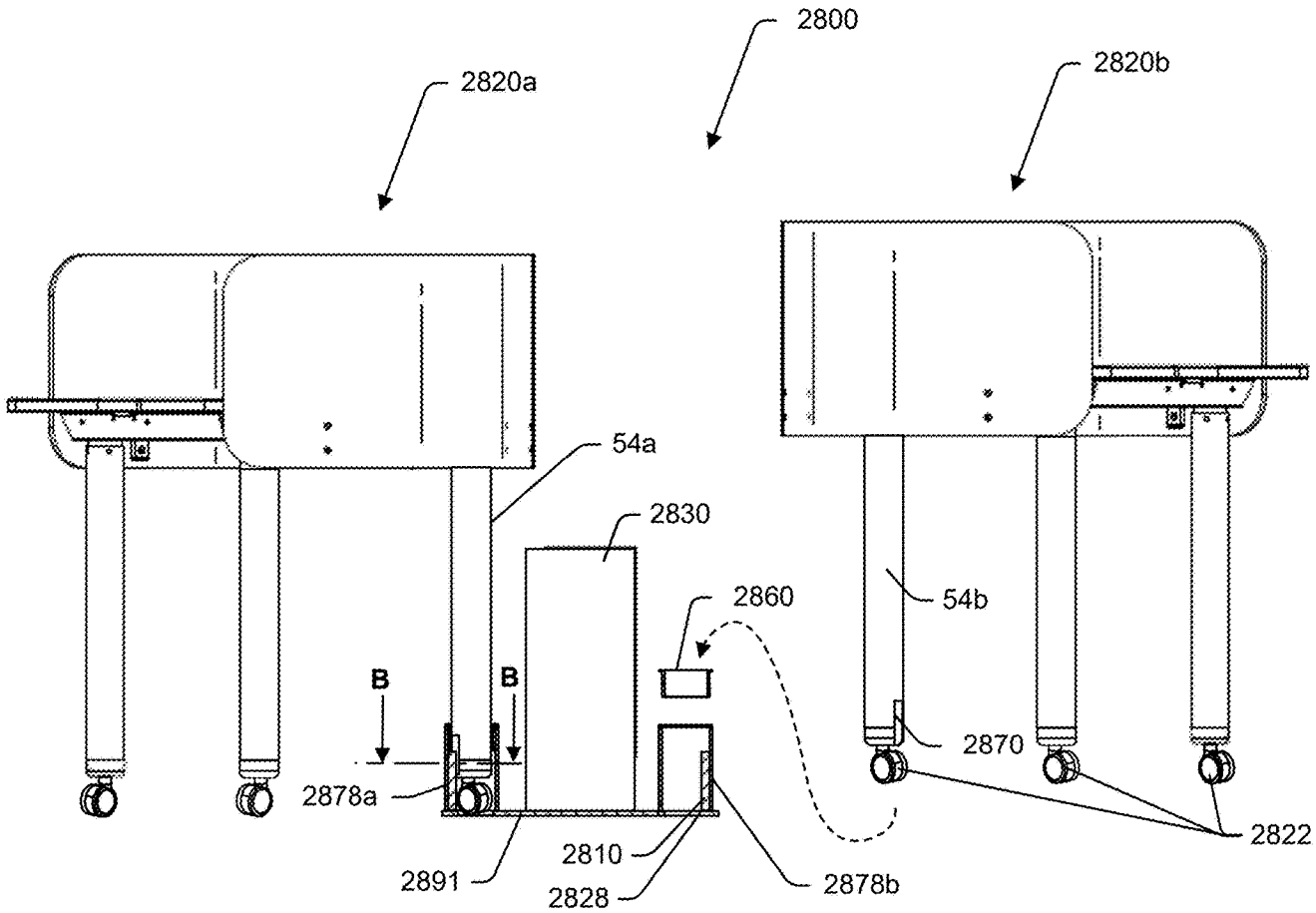
FIG. 29 is a side view of a workstation assembly including workstations that can be coupled and decoupled from a spine that is consistent with at least some aspects of the present disclosure.
Figure 30:
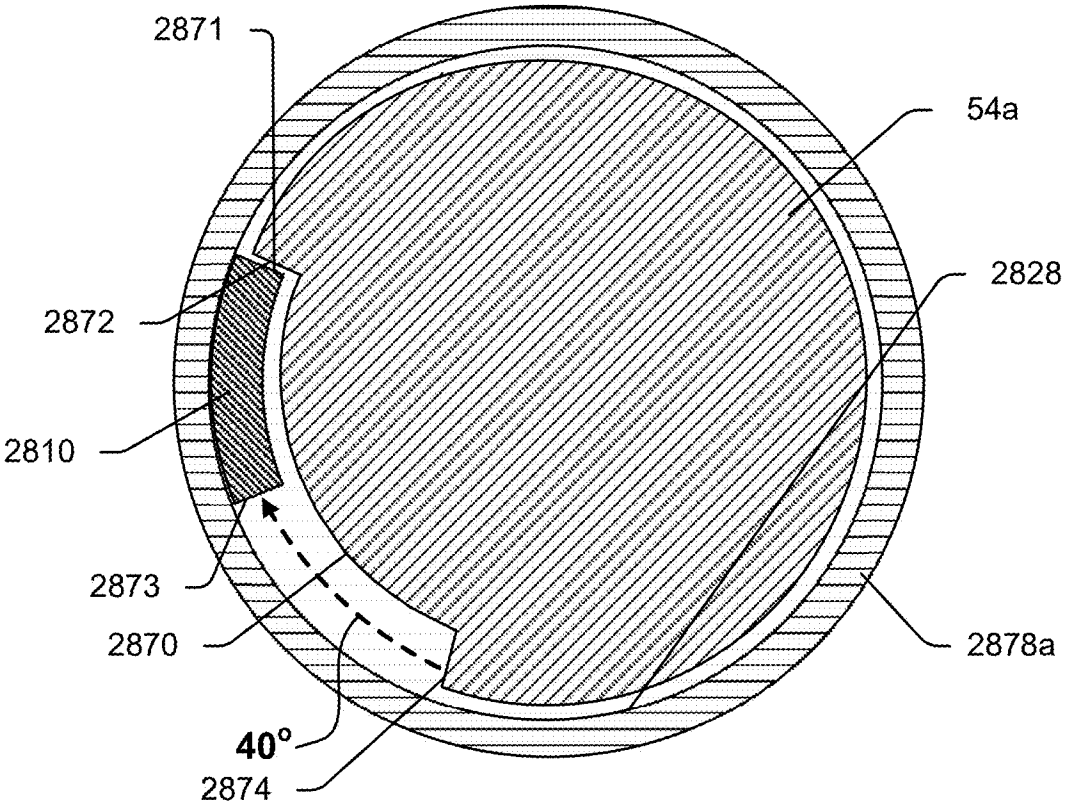
FIG. 30 is a cross sectional view taken along the line B-B in FIG. 29.

Referring still to FIGS. 29 and 30, the anchor assembly in this case includes an anchor member 2891 that extends from an undersurface of spine 2830 to distal ends on either side of the spine and cup members 2878*a* and 2878*b* that extend upward from the distal ends to form upwardly opening cylindrical cavities. Low friction bushings 2860 are placed within the upper ends of the cup cavities and are held at those locations by laterally extending lip members that abut the upper edges of the cup members. Referring specifically to the cup member 2878*b* on the right as illustrated in FIG. 28, a hole or opening 2828 is formed in anchor member 2891 at the bottom of the cup cavity so that when a lower end of one of the legs is placed within the cavity, the bottom of the caster at the bottom of the leg rests on an ambient floor surface. A limit tab 2810 extends from the internal surface of cup member 2878*b* or from the upper surface of the anchor member 2828*b* into the cavity along about the lower ⅔rds of the height of the cup member. Referring to FIG. 30, the limit tab 2810 in cup member 2878*a* is seen in cross section and forms first and second lateral and vertical limit surfaces 2871 and 2873.

To anchor workstation 2820*a* to the anchor or anchor member 2891, a user simply lifts the workstation up and moves the assembly into a position where the rear leg is over the cup cavity and with the notch 2870 aligned with the limit tab 2810 and then drops the lower end of leg 2854 into the cavity until the lower end of the caster contacts the ambient floor surface. Once the lower end of leg 2854*a* is captured within the cavity, the leg can rotate within that cavity between ranges limited by the stop and limit surfaces of the notch 2870 and the tab 2010, respectively.

In other cases it is contemplated that a clamping type decoupling assembly may be provided at the upper end of each rotation restricting mechanism 99 for coupling and decoupling workstation legs to a spine. In this regard, see FIG. 31 where a first decoupling assembly 3150*a* is shown secured at the upper end of rotation restricting mechanism 99*a* and a second decoupling assembly 3150*b* is shown secured at the upper end of rotation restricting mechanism 99*b*. The decoupling assemblies are similar and therefore only assembly 3150*b* will be described in detail. Assembly 3150 includes a post 3140 that extends upward from an anchoring cup member 3178. While not shown, the lower end of post 3140 is like the lower end of leg 54 in FIG. 16 including a stop member (see 606 in FIG. 16) secured to a lower end thereof for limiting rotation of the post in cooperation with a limit tab as described above.

Figure 31:
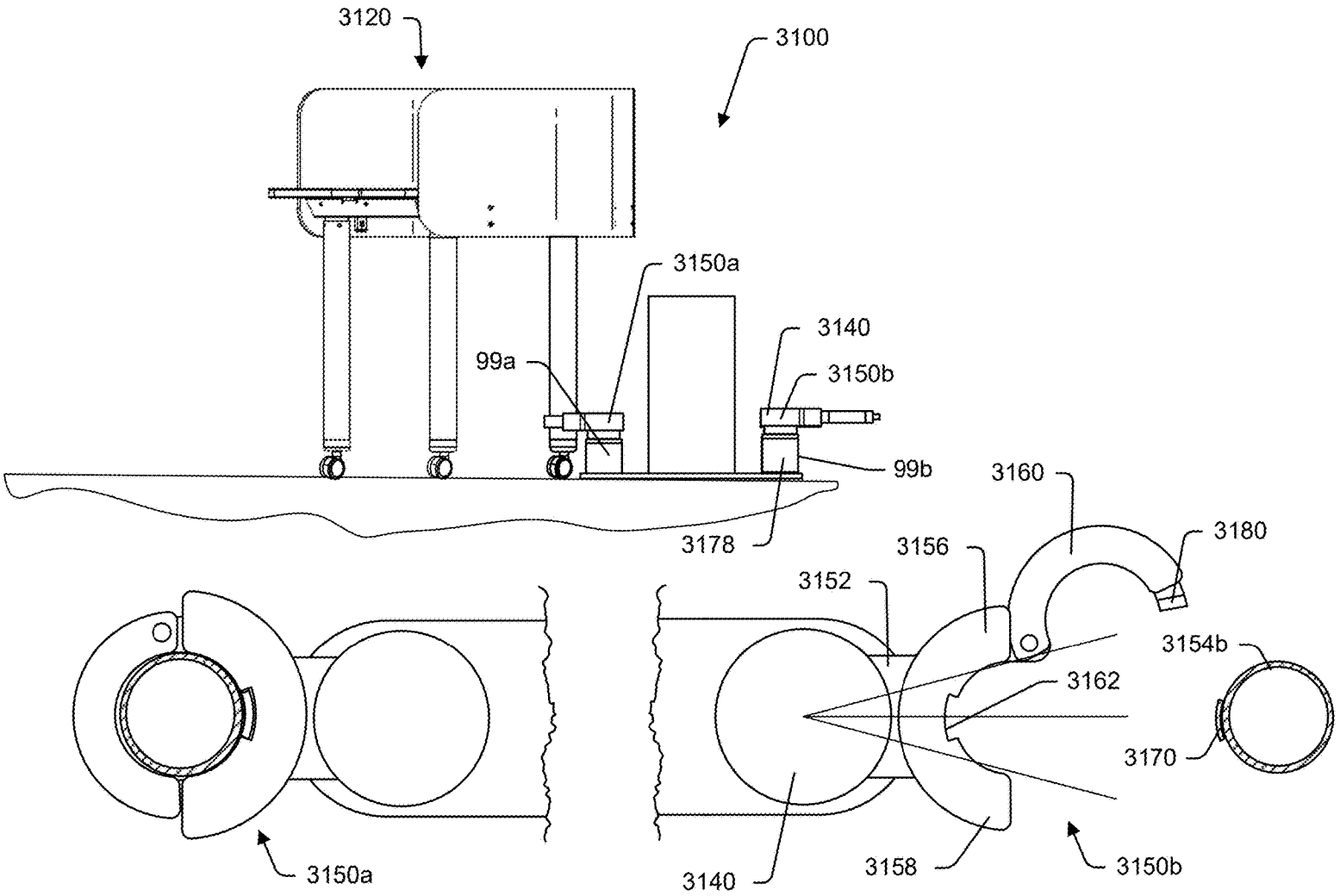
FIG. 31 is a side view and a top plan view of another workstation assembly where workstations can be decoupled form a spine for use at non-tethered locations.

Referring still to FIG. 31, a shoulder member 3152 extends laterally from a side surface of post 3140 and a clamp structure 3156 is located at the distal end of shoulder member 3152. Clamp 3156 includes a first C-shaped stationary clamp member 3158 and a second C-shaped pivotable clamp member 3160 that is hinged to the first clamp member 3158 for movement between an open position as shown and a closed position (see state of assembly 3150*a* in FIG. 31). The internal surfaces of clamp members 3158 and 3160 form a cylinder when in the closed state that is similar to the outer circumference of a workstation leg 3154*b* to be received therein when anchored.

Referring still to FIG. 31, first clamp member 3158 forms a cutout slot 3162 and leg 3154*b* includes a tab or key 3270 at a lower end that is shaped to be snugly received within slot 3162 when leg 3154*b* is anchored by the clamp 3156. A mechanical locking mechanism 3180 is provided at the end of clamp member 3160 for securing that end of the clamp member in a slot (not illustrated) at an adjacent end of first clamp member 3158. Once a leg 3154*b* is secured to the spine via clamp assembly 3150*b*, the leg does not move with respect to the clamp structure. Here, pivoting movement occurs between the workstation and clamp assembly 3150*b* and the spine within the cup member 3178. Pivot restriction here occurs within the cup member 3178 in the manner described above with respect to FIGS. 1-17.

In some embodiments the pivot leg (e.g., the anchored leg about which a workstation pivots) may not be centrally located along the rear edge of the tabletop. For instance, see FIG. 32 where the pivot leg is under the pivot point P at a rear lateral corner location of a tabletop 3240.

In some embodiments the spine structure may have a short length dimension so that one or more workstations anchored thereto can be rotated about through 360 degrees. In this regard see again FIG. 32 where spine 3230 is short so that, in some cases, tabletop 3240 could be configured to rotate through 360 degrees without the spine interfering with the legs below the tabletop.

Figure 32:
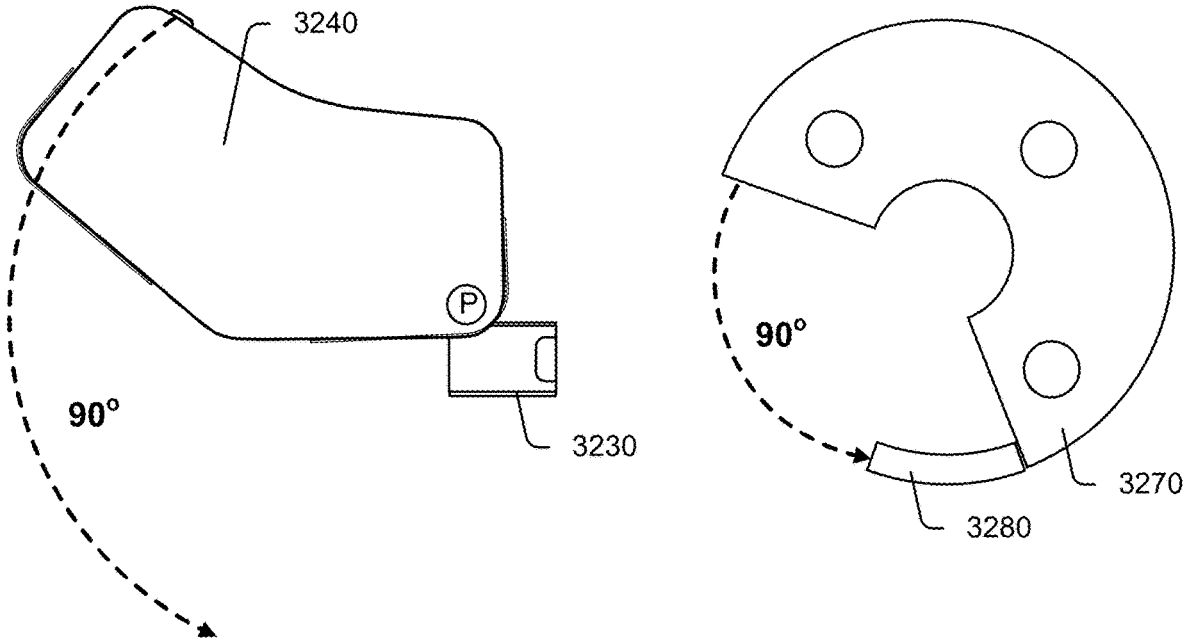
FIG. 32 is a schematic view showing another workstation assembly including a workstation mounted to a short spine and in a first limit position and a rotation restricting mechanism that is consistent with at least some aspects of the present disclosure.
Figure 33:
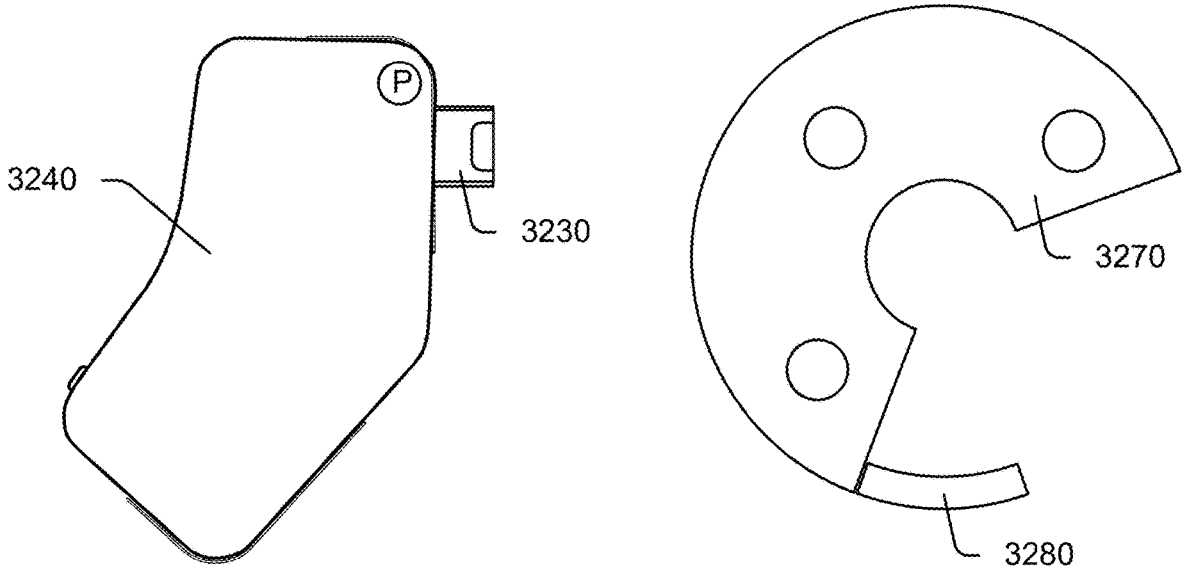
FIG. 33 is similar to FIG. 32, albeit showing the workstation is a second limit position.

Even in cases where the spine is short, it will often be advantageous to limit tabletop/workstation rotation to a range of positions so that any power or data cables do not become twisted due to multiple tabletop rotations in the same direction. In this regard, see again FIG. 32 where a rotation restricting assembly 99 includes a stop member 3270 and a limiting tab 3280akin to those described above, albeit where a limit space 3272 defined by the stop member allows 90 degrees of workstation rotation. In FIG. 32 tabletop 3240 is in a first limit position where stop member 3270 abuts one limit surface formed by tab 3280. In FIG. 33 tabletop 3240 is shown rotated through 90 degrees to the second limit position with stop member 3270 abutting the second limit surface formed by tab 3280.

In some cases two workstations may be anchored to the same short spine for movement between collaboration and private orientations. In this regard see FIG. 34 where first and second workstation tabletops 3440*a* and 3440*b* are secured at rear corner pivot legs (see points P) to a short spine 3430*a* and are positioned in collaborative orientations with adjacent tabletop side edges. See also FIG. 35 where the tabletops 3440*a* and 3440*b* are shown rotated through 90 degrees in opposite directions so that rear edges are adjacent each other to afford more privacy.

Figure 34:
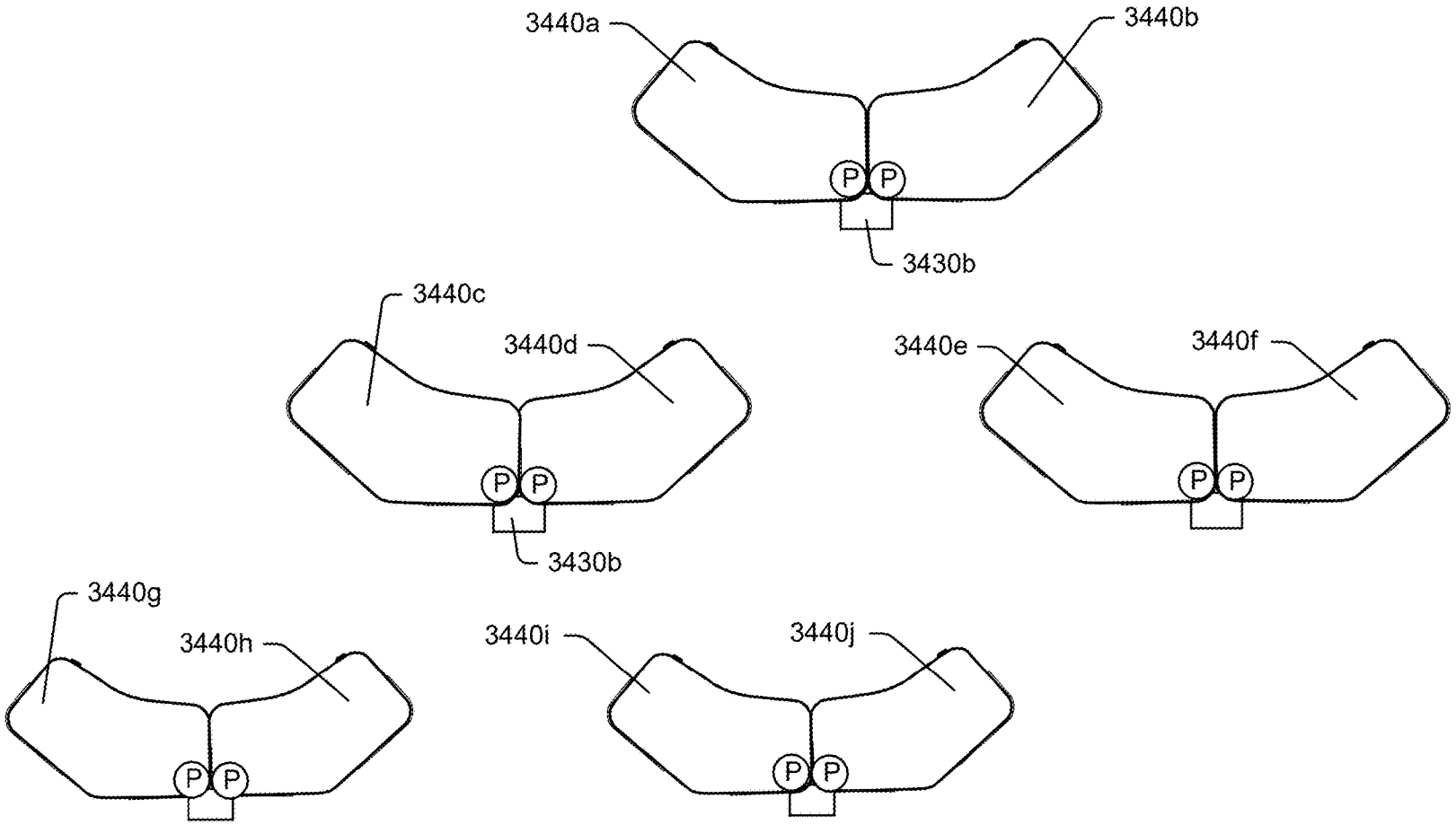
FIG. 34 is a top plan view showing a plurality of workstations similar to the workstation in FIG. 32 in an advantageous relationship.

In some embodiments workstations that are anchored to first and second different/separate spines may be rotatable between separated private positions and adjacent collaboration positions. In this regard see again FIG. 34 where workstation tabletop 3440*a* is anchored to spine 3430*a* and workstation tabletop 3440*d* is anchored to a second and separate spine 3430*b*. As seen, tabletop 3440*a* and spine 3430*a* are completely separate from tabletop 3440*d* and spine 3430*b* when the tabletops are positioned as shown in FIG. 34. See, however, FIG. 34 where tabletop 3440*a* has been rotated counterclockwise through 90 degrees that tabletop 3440*a* can be moved to a position where a lateral edge abuts or is adjacent a lateral edge of tabletop 3440*d* (see instance of top 3440*d* shown in phantom). See also in FIG. 35 that tabletop 3440*d* can be rotated clockwise through 90 degrees to a different position spaced away from tabletop 3440*a*. Thus, tops 3440*a* and 3440*d* can be brought together for collaborative activities and can be rotated to several different relative positions for greater or lesser privacy when desired.

Where spines and workstations have certain features and are arranged in specific patterns, more than two anchored tabletops can be rotated into collaborative orientations. Again, see FIG. 34 where five workstation pairs are shown arranged with respect to each other in a repeating pattern where tabletops can be rotated with respect to spines to different positions. In FIG. 34 the pairs include tabletops 3440*a* and 3440*b*, 3440*c* and 3440*d*, 3440*e* and 3440*f*, 3440*g* and 3440*h*, and finally 3440*i* and 3440*j*. In FIG. 34 each pair is shown in an orientation where side edges of the pair are adjacent and parallel to facilitate two user collaboration.

Figure 35:
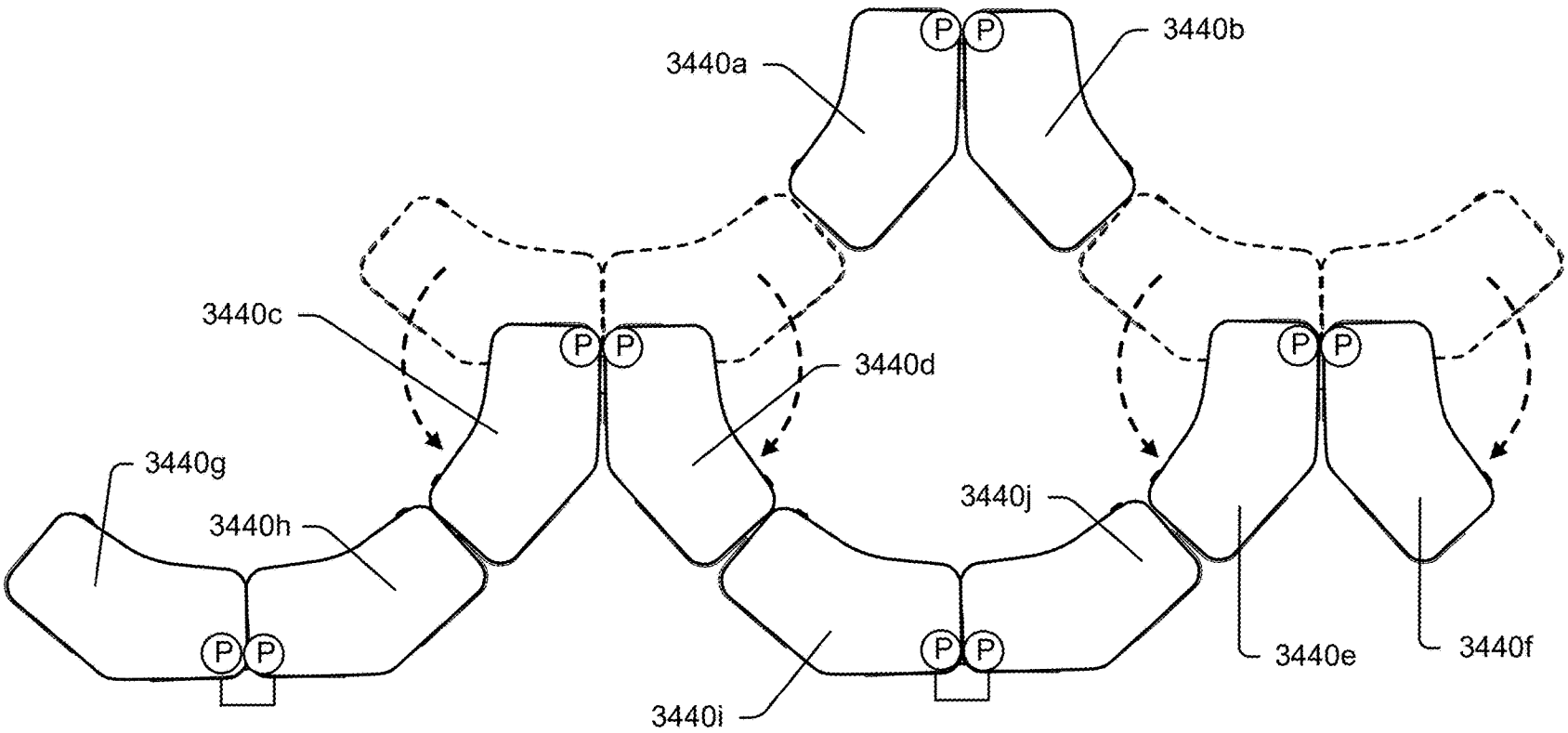
FIG. 35 is similar to FIG. 34, albeit showing the workstations in other rotated positions.

See FIG. 35 where each of tabletops 3440*a*, 3440*b*, 3440*c*, 3440*d*, 3440*e* and 3440*f* have been rotated 90 degrees. Here, tabletops 3440*a* and 3440*b* are in positions spaced from other tables and to facilitate private activity. Tabletops 3440*d*, 3440*i*, 3440*j* and 3440*e* are arranged in a semicircle with adjacent edges to surround users within a semicircular workspace. Similarly, tabletops 3440*g*, 3440*h* and 3440*c* are arranges side edge to side edge to form a three top arrangement for sharing between three users. Top 3440*f* is in a private activity orientation.

Figure 36:
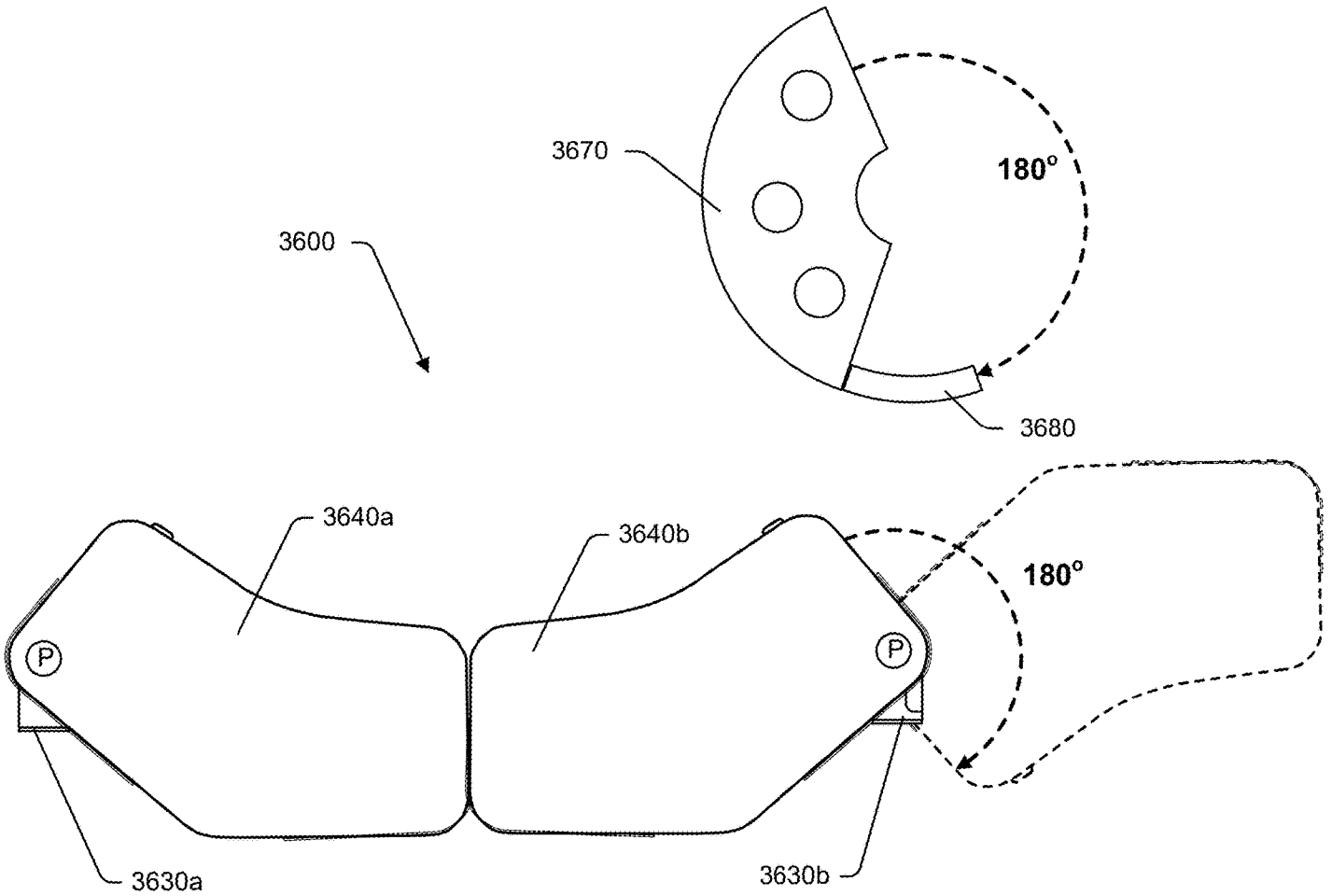
FIG. 36 shows workstations secured to two short spines and a restricting mechanism.

FIG. 36 shows another workstation assembly 3600 including two workstations including tabletops 3640*a* and 3640*b* anchored to separate and spaced apart short spines 3630*a* and 3630*b* where the stop members 3670 and limit tab 3680 are shaped to restrict tabletop rotation to 180 degrees.

Figure 37:
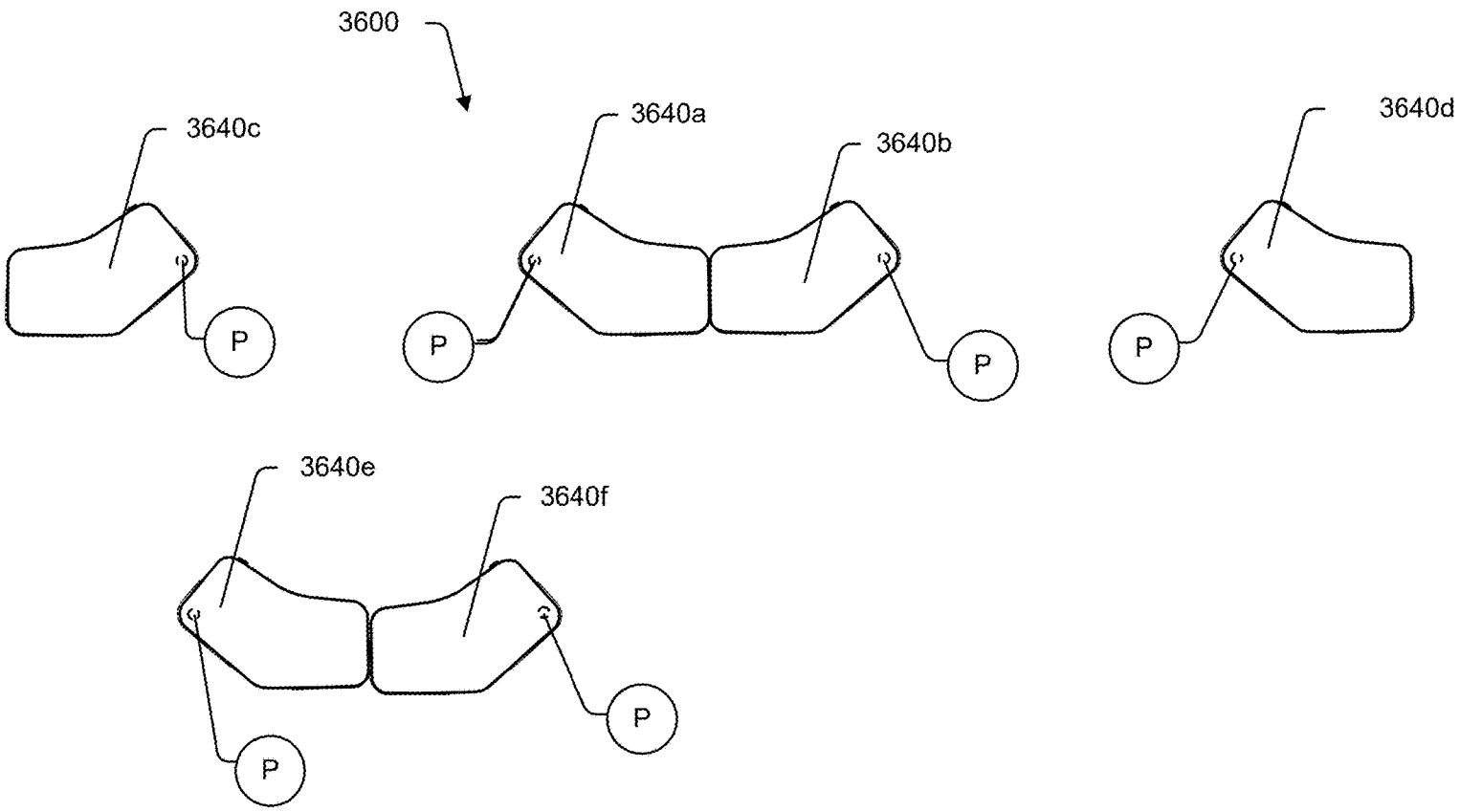
FIG. 37 shows a plurality of the workstation assemblies of FIG. 36 arranges in an advantageous pattern.

Referring to FIG. 37, tabletops 3640*a* and 3440*b* are shown along with two other tabletops 3640*c* and 3640*d* that are anchored to separate spines on opposite sides of tabletops 3640*a* and 3640*b* where the spines anchoring all the tops are spaced along a single line. In this case, the tabletops are dimensioned and mounted at pivot legs and the spines are spaced such that top 3640*a* can be rotated through 180 degrees from the position shown in FIG. 37 to the position shown in FIG. 38 to separate tabletop 3640*a* from tabletop 3640*b* and such that, when top 3640*c* is rotated toward top 3640*a*, the side edges of tops 3640*a* and 3640*c* can be brought together for collaborative activity. Similarly, tops 3640*b* and 3640*d* can be rotated toward each other and into collaborative positions as shown in state 3600*b*.

Figure 38:
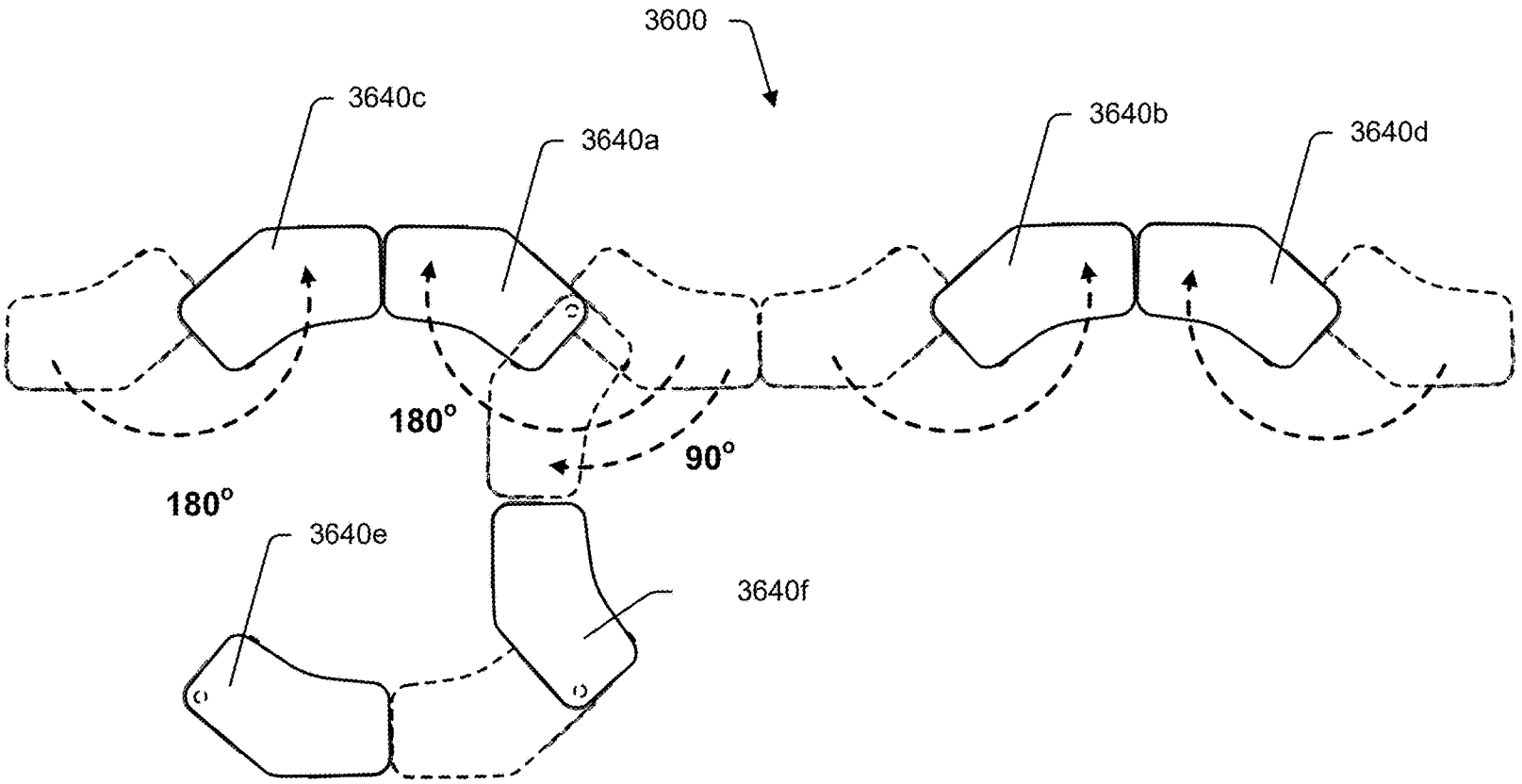
FIG. 38 is similar to FIG. 37, albeit showing the workstations in other rotated positions.

In addition, two other tabletops 3540*e* and 3640*f* are shown anchored to separate spines at points P in FIG. 37 where those tops are dimensioned and anchored with respect to the other tabletops in FIG. 37 so that those tops can be rotated into different collaborative and private positions. INB FIG. 37 tops 3640*e* and 3640*f* are edge to edge in a collaborative orientation. In FIG. 38, top 3640*f* has been rotated through 90 degrees toward tabletop 3640*a*. As shown in a second phantom instance of tpop 3640*a* in FIG. 38, when top 3640*a* is rotated 90 degrees toward top 3640*f*, side edges of tops 3640*a* and 3640*f* are adjacent and those tops can be used to facilitate collaborative activity.

While not shown, it should be appreciated that In some cases the tops in FIG. 37 may be able to rotate through 270 degrees of rotation and at least some of the tops may have other tabletops anchored to spines thereabout, one on each of four sides of the top so that the top can be rotated into collaborative positions to any of the four sides with different surrounding tabletops.

In some embodiments the spine structure may not be straight. In this regard see assembly 3900 in FIG. 39 where a zig zag shaped spine structure 3930 includes an elongated straight central spine 3630*a* having first and second ends and first and second end spines 3630*b* and 3630*c* that extend in opposite parallel directions from the first and second ends of central spine 3630*a*, respectively. Assembly 3900 includes first through eighth workstations including first through eighth tabletops 3940*a* through 3940*h*, respectively. Each top is anchored at a pivot leg at the associated point P indicated and, generally, centrally along the rear edge and under the apex portion of the tabletop.

Tabletops 3940*a* and 3940*b* are generally anchored on an outer side of end spine 3930*b*. More specifically, top 3940*a* is anchored at a distal end of spine 3930*b* and tabletop 3940*b* is anchored adjacent an upper corner of spine 3930*b* as illustrated. In this regard, referring again to FIG. 5, in addition to the anchor members extending perpendicular to the length dimension of a spine, in some embodiments anchor members will be secured to spines to extend in line with the spine length dimension (see phantom 91*a* in FIG. 5) or out a corner formed at the end of a spine (see phantom 91*b* in FIG. 5). In these cases, other than the different orientation of the anchor member with respect to the spine, the rotation restricting assembly will be like others described in this disclosure.

Figure 40:
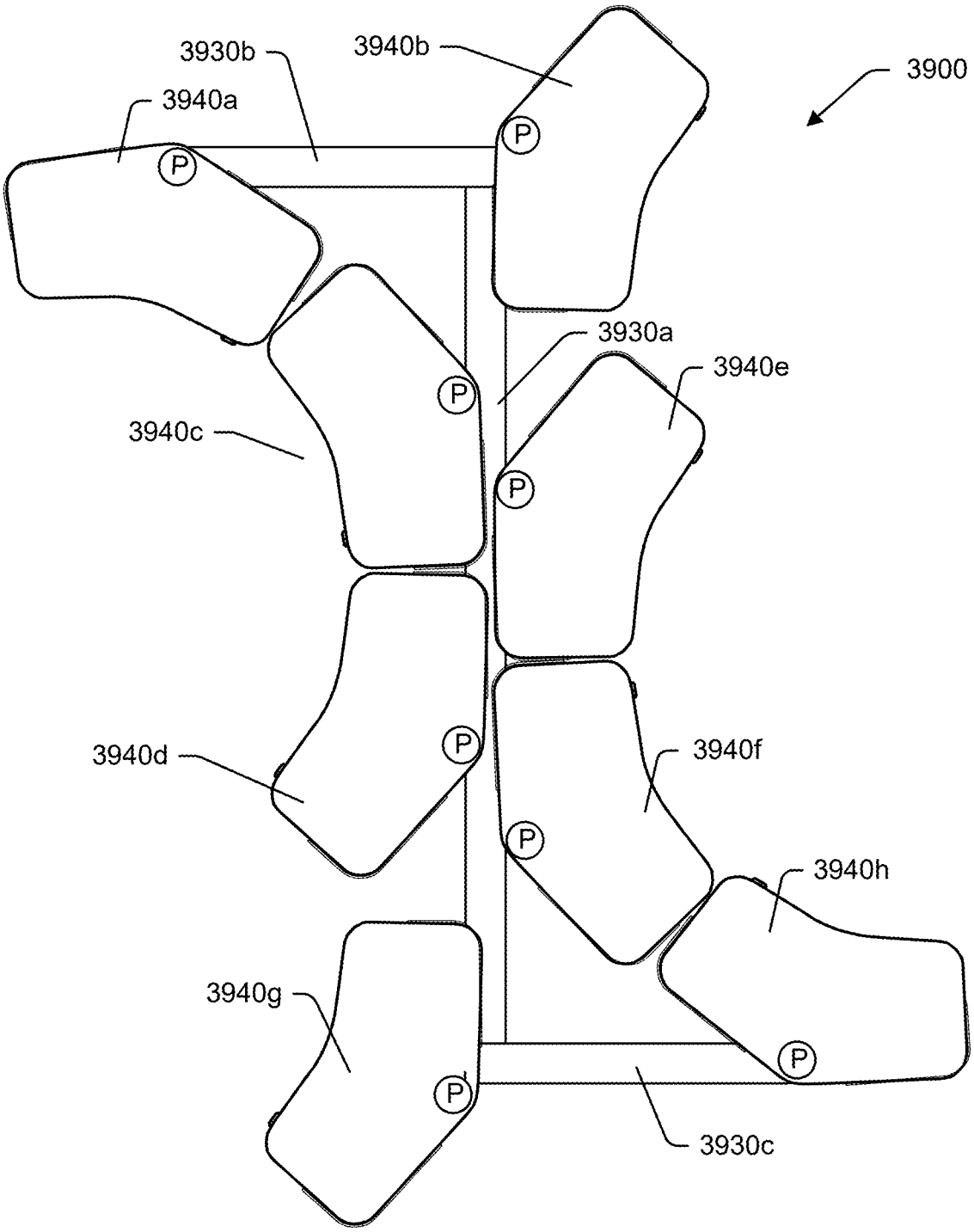
FIG. 40 is similar to FIG. 39 albeit showing the workstations in other rotated positions.

Tabletops 3940*a* and 3940*b* are restricted to have first limit positions in which the tops have adjacent lateral edges to facilitate collaboration between users at those two tops are shown. Each of tops 2940*a* and 2940*b* has a second limit position as shown in FIG. 40 where those tops can be rotated into positions suitable for collaboration with users of other tabletops 3940*c* and 3940*e*, respectively. Thus, top 3940*a* has a range or rotation great that is substantially 180 degrees while tabletop 3940*b* is rotatable through substantially 90 degrees so that a side edge of top 3940*a* can be positioned adjacent a side edge of top 3940*c* and a side edge of top 3940*b* can be positioned adjacent a side edge of top 3940*e* when desired.

Figure 39:
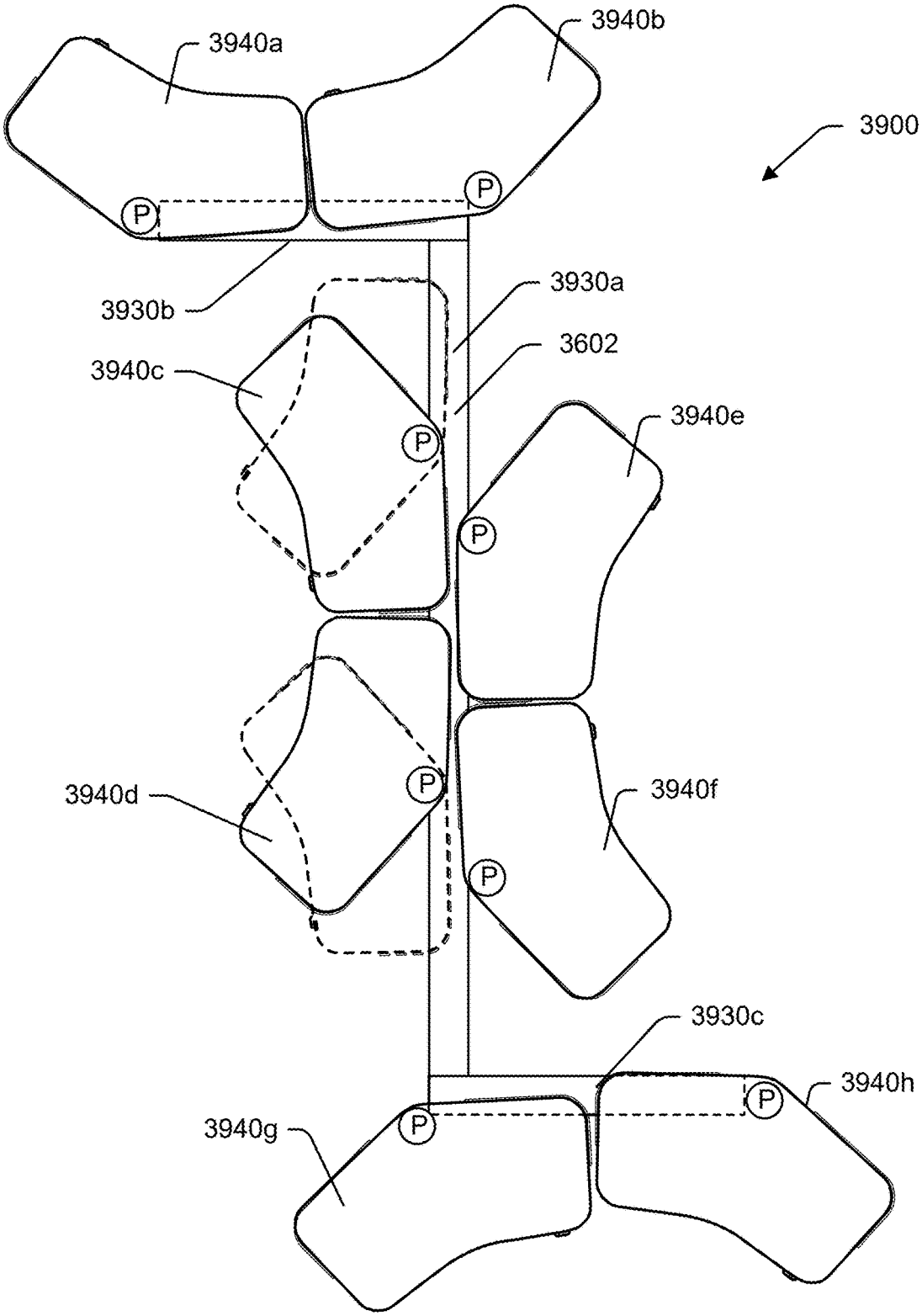
FIG. 39 is a top plan view of a workstation assembly including eight workstations anchored to a zig zag shaped spine.

Referring again to FIG. 39, tabletops 3940*c* and 3940*d* are anchored to one side of central spine 3930*a* while tabletops 3940*e* and 3940*f* are anchored to the other side of spine 3930. In FIG. 39, the tops on opposite sides of spine 3930*a* are not anchored at the same locations along the length of the spine and instead the anchor positions are staggered. In some cases, tops 3940*c* through 3940*f* will each be limited to 40 degrees of rotation as in many of the embodiments described above so that rear edges thereof do not break a central plane through the spine 3930*a*. In other cases tabletops 3940*c* through 3940*f* may be able to rotate through larger ranges of angular motion. In FIG. 39, tops 3940*c* and 3940*d* are shown in a collaborative position with adjacent and parallel side edges. Tops 394*c* and 3940*d* are also shown in second positions in phantom. The positions shown may or may not be limit positions, depending on the rotation restricting mechanism employed. Tops 3940*e* and 3940*f* pivot in a fashion like tops 3940*c* and 3940*d*.

Referring still to FIG. 39, tabletops 3940*g* and 3940*h* are anchored to end spine 3930*c* at locations relative to spine 3930*c* that are like the locations of tops 3940*a* and 3940*b* relative to spine 3930*b* (e.g., via a corner anchor and a spine end anchor) and have rotational limitations like tabletops 3940*b* and 3940*a*, respectively. To this end, tabletops 3940*g* and 3940*h* are shown in first limit positions in FIG. 39 and in second limit positions in FIG. 40. Thus, top 3940*g* is limited to about 90 degrees of rotation while tabletop 3940*h* can be rotated through substantially 180 degrees.

Figure 41:
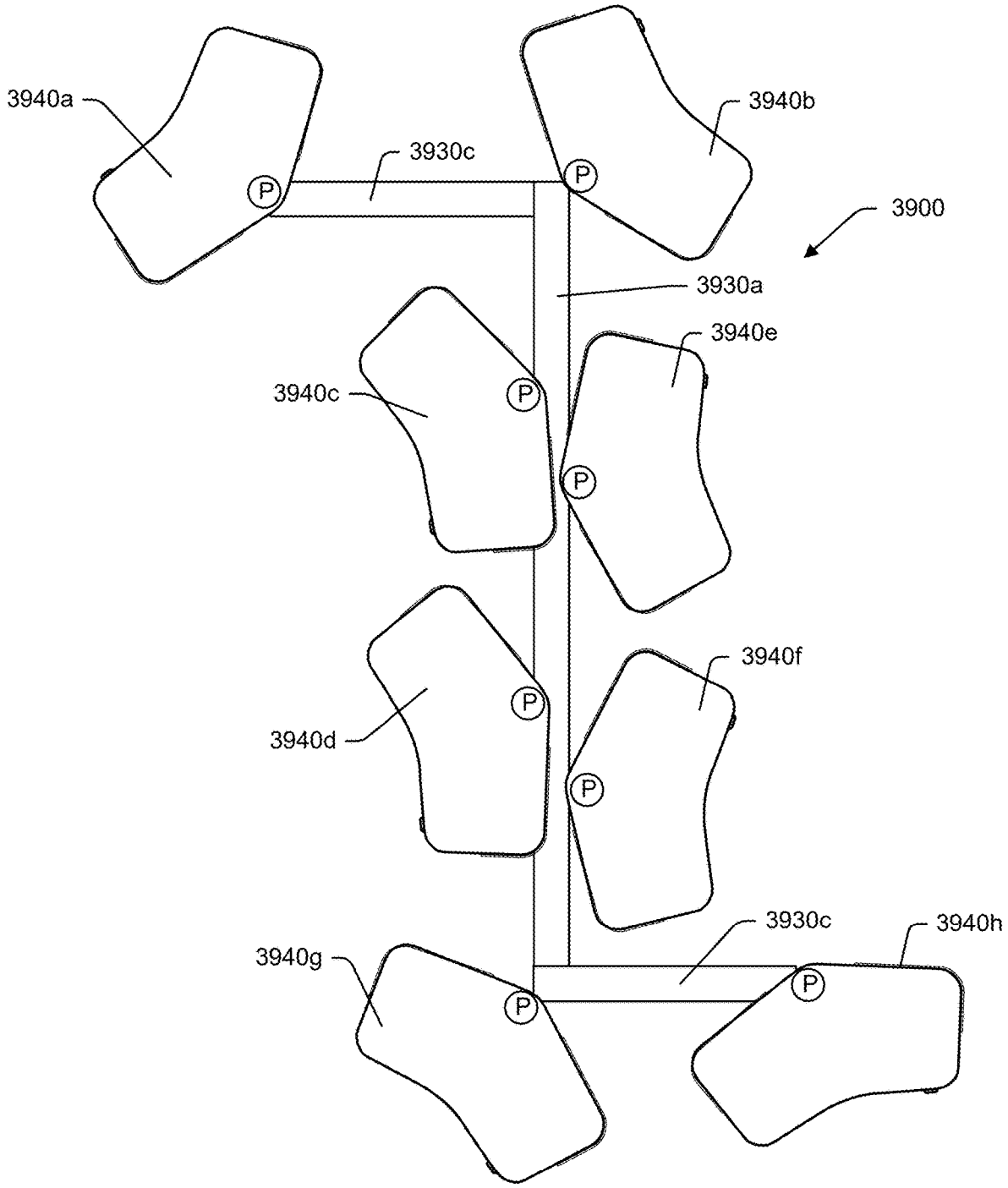
FIG. 41 is similar to FIG. 39 albeit showing the workstations in other rotated positions.

A shown in FIG. 40, when so configured, tops 3940*a*, 3940*c* and 3940*d* can be positioned in a three top arrangement edge to edge while tops 3940*e*, 3940*f* and 3940*h* can similarly be positioned in a three top arrangement edge to edge if desired. Top 3940*d* can also be rotated toward top 3940*g* so tabletops 3940*d* and 3940*g* can be used to facilitate collaboration. Top 3940*e* can also be rotated toward top 3940*b* so tabletops 3940*e* and 3940*b* can be used to facilitate collaboration. In FIG. 41 the tops 3940*a* through 3940*h* are shown rotated to intermediate positions so all the tops can be used in semiprivate orientations.

While FIG. 39 shows a spine with a zig-zag arrangement, other spine shapes are contemplated including X, T, I, S, and C.

Referring again to FIG. 39, while most of the tabletops shown are symmetrical, end tops 3940*a* and 3940*h* are not completely symmetrical and instead are slightly longer to one side than the other. In this regard, see the phantom line on top 3940*a* from the apex of the top to the center of curvature along the front edge where the left end of the top as shown is longer than the right end. In this case, tops 3940*a* and 3940*h* are differently shaped so that when they rotate to different limit positions, edges can be adjacent other tabletop edges as shown in FIGS. 39 and 40. Thus, the tabletop shapes in a workstation assembly need not have identical shapes and in many cases different shapes will be advantageous for different reasons.

Figure 42:
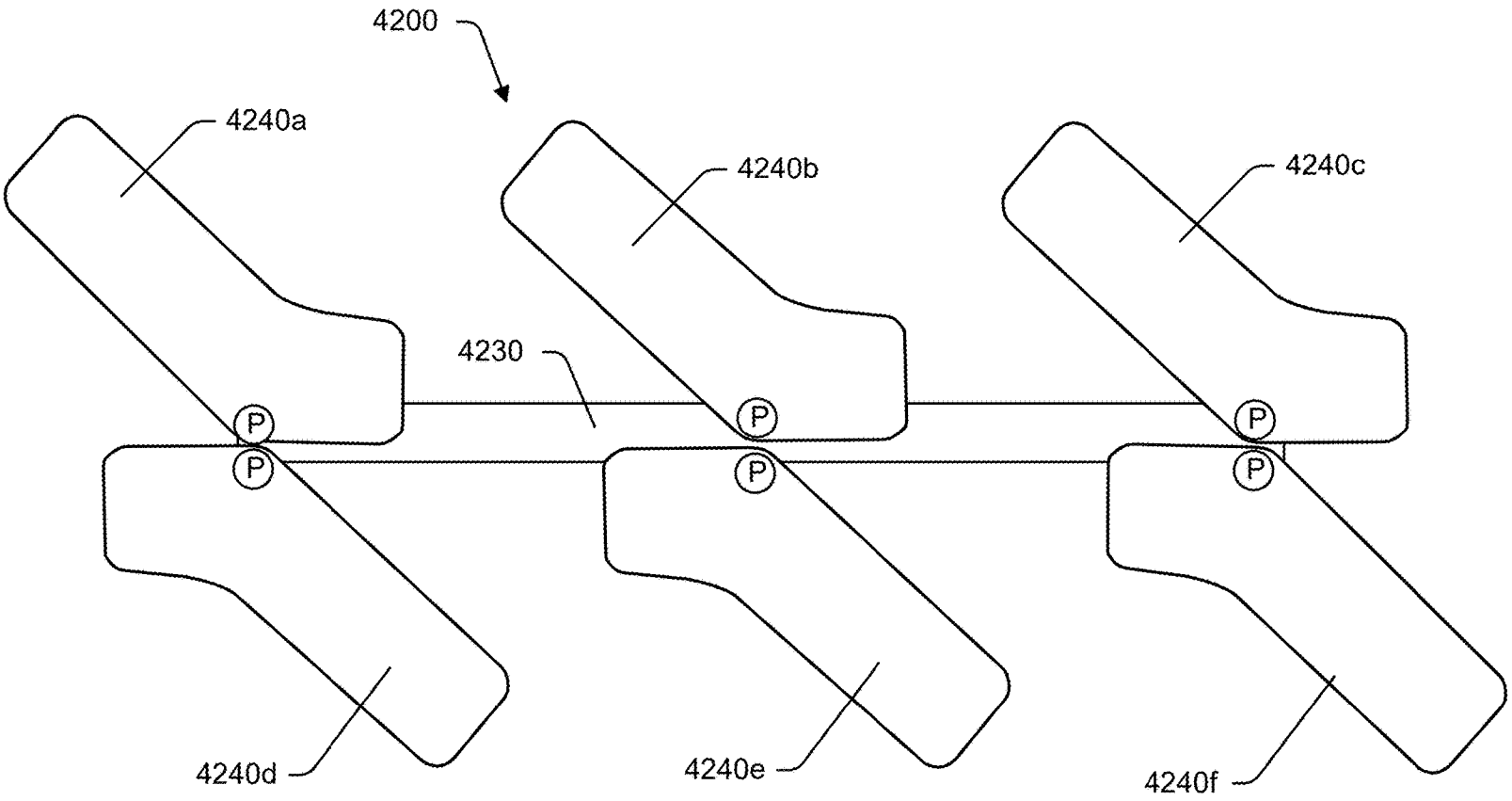
FIG. 42 is a top plan view of an assembly including hockey stick shaped tops that is consistent with at least some aspects of the present disclosure.
Figure 43:
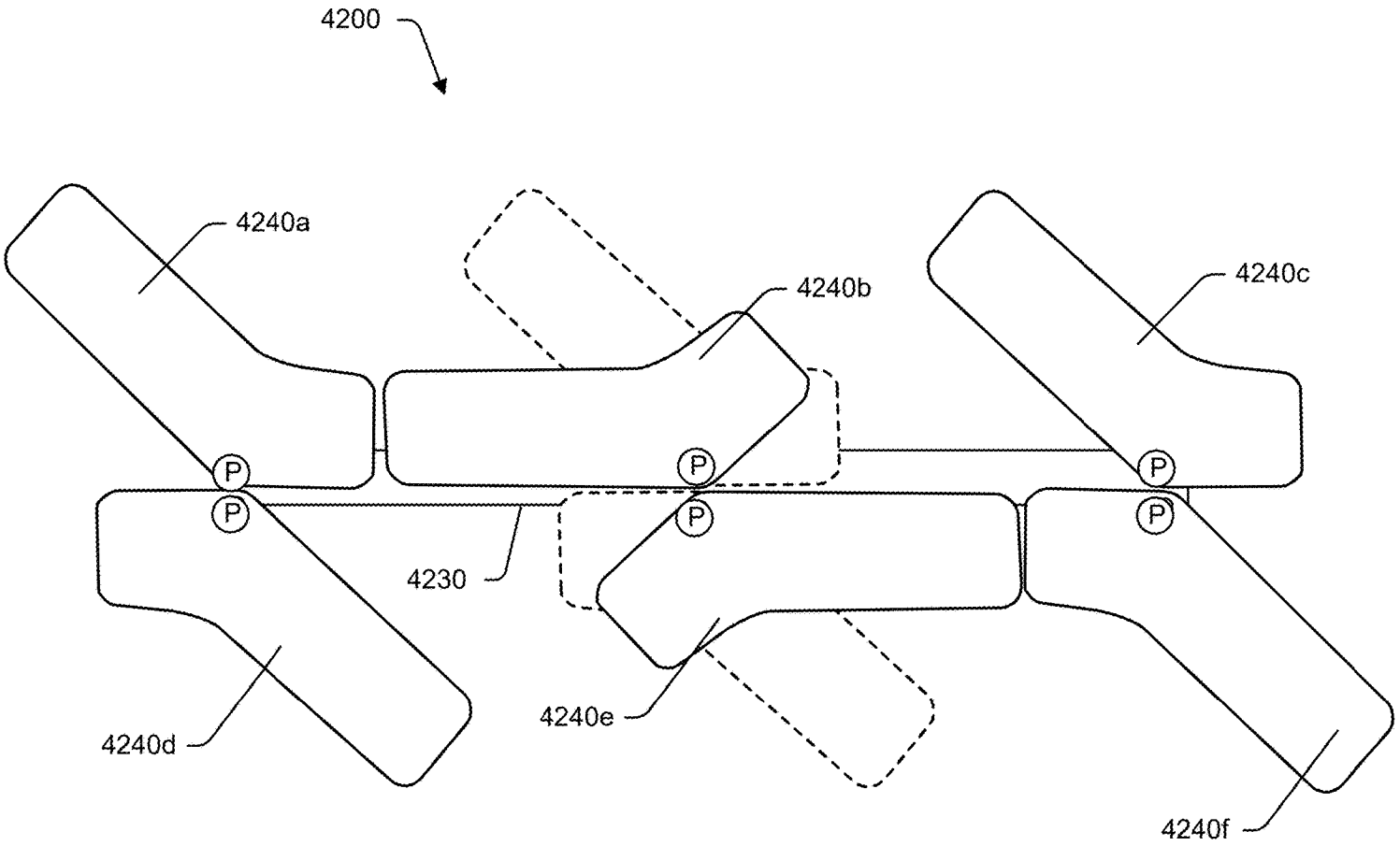
FIG. 43 is similar to FIG. 42, albeit showing some of the tops in a different rotated position.

One other particularly advantageous tabletop shape is referred to herein as a "hockey stick" shape wherein one end of the tabletop is substantially longer than the other end. In this regard see the workstation arrangement 4200 shown in FIG. 42 that includes six workstations having hockey stick shaped tabletops 4240*a* through 4240*f* anchored to a straight spine 4230 below apex portions of the tabletop rear edges. Exemplary top 4240*a* is longer to one side than the other. In FIG. 42, the tops are all rotated to first limit positions where the rear edge along the short end of each top is parallel with the length of spine 4230 and the long ends of each top extend at identical angles from the spine. In FIG. 43, tops 4240*b* and 4340*d* are shown rotated to second limit positions where side edges thereof are adjacent side edges of tabletops 4240*a* and 4240*f*, respectively, to facilitate collaboration among pair of users.

Figure 44:
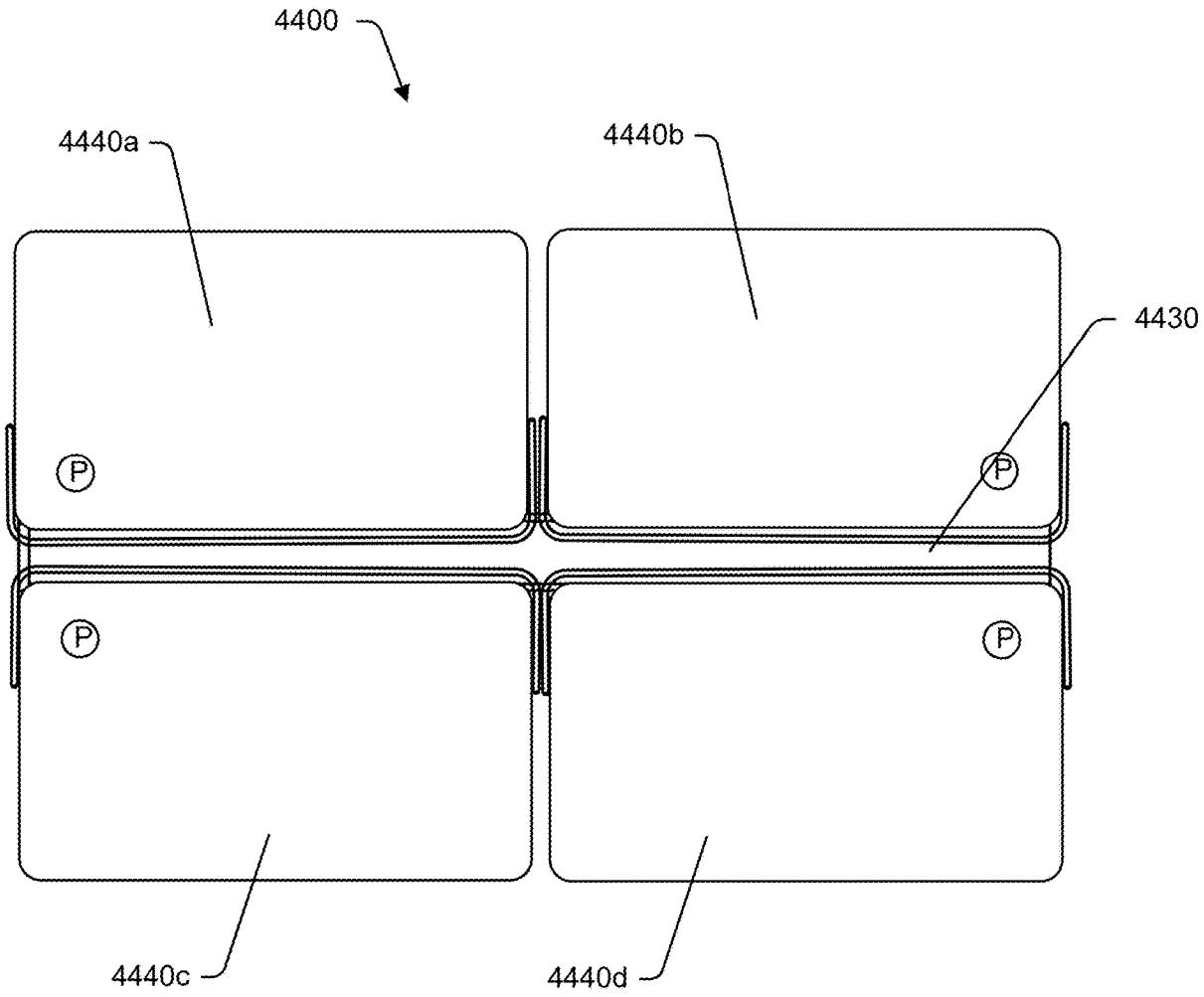
FIG. 44 is a top plan view of an assembly including four rectangular tabletops.

Yet one other interesting tabletop shape is a typical rectilinear shape. IN this regard, see the workstation arrangement 4400 shown in FIG. 44 that includes four workstations having rectangular tabletops 4440*a* through 4440*d* anchored to a spine 4430 at pivot legs that rotate about points P. In this embodiment, the pivot leg for each top is secured to the undersurface of the top below a rear corner portion of the top as indicated by points P. Tabletops 4440*a* and 4440*b* are anchored to one side of spine 4430 and at opposite ends of the spine (e.g., the pivot points are separated by substantially the entire length of the spine) while tabletops 4440*c* and 4440*d* are anchored to the other side of spine 4430 and at opposite ends of the spine. Each top is shown in FIG. 44 in one limit position where edges of tops 4440*a* and 4440*b* are adjacent and parallel so users of those workstations can collaborate and where edges of tops 4440*c* and 4440*d* are adjacent and parallel so users of those workstations can collaborate.

Figure 45:
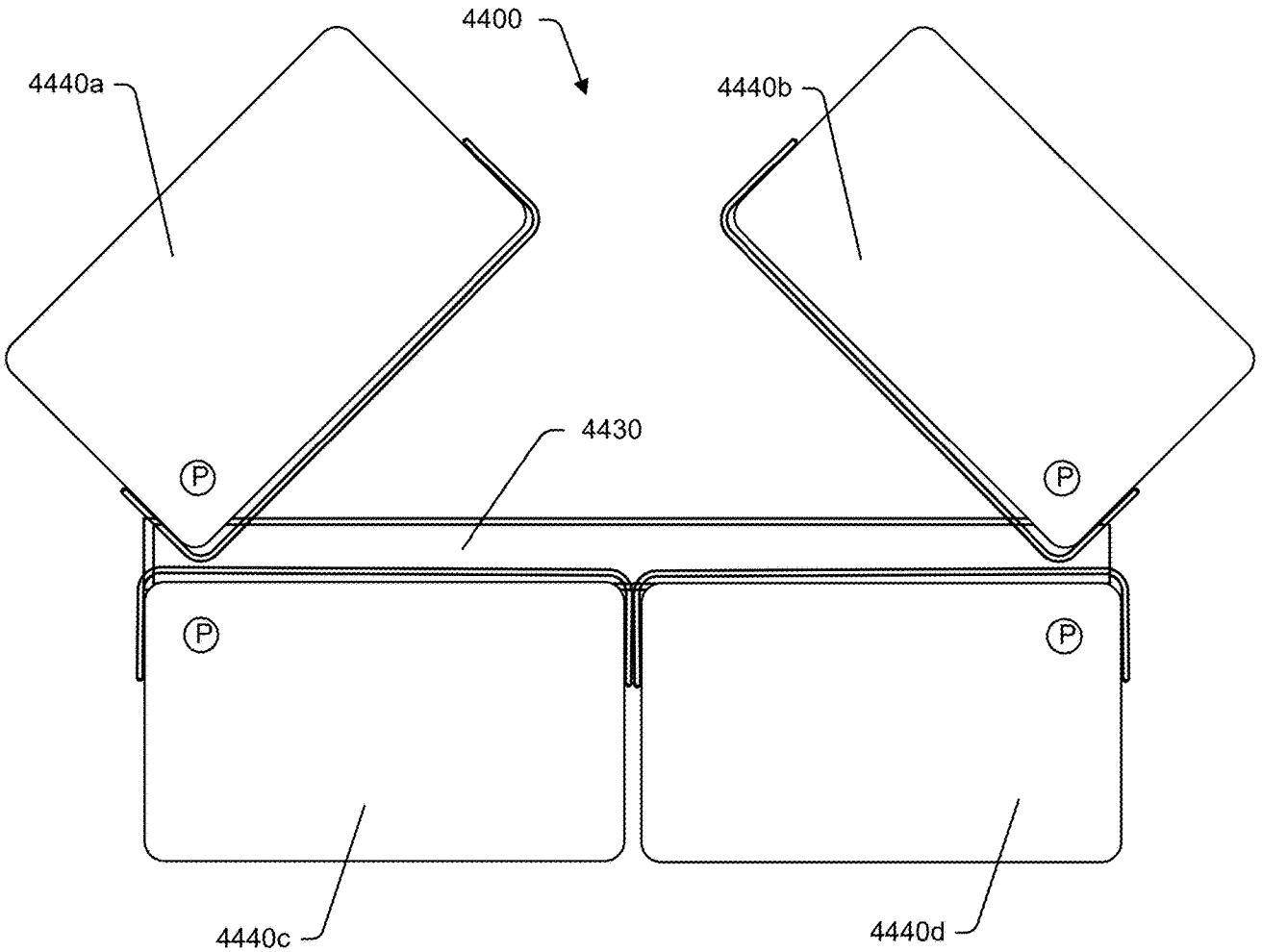
FIG. 45 is similar to FIG. 44 albeit where the two of the tops are in different rotational positions.
Figure 46:
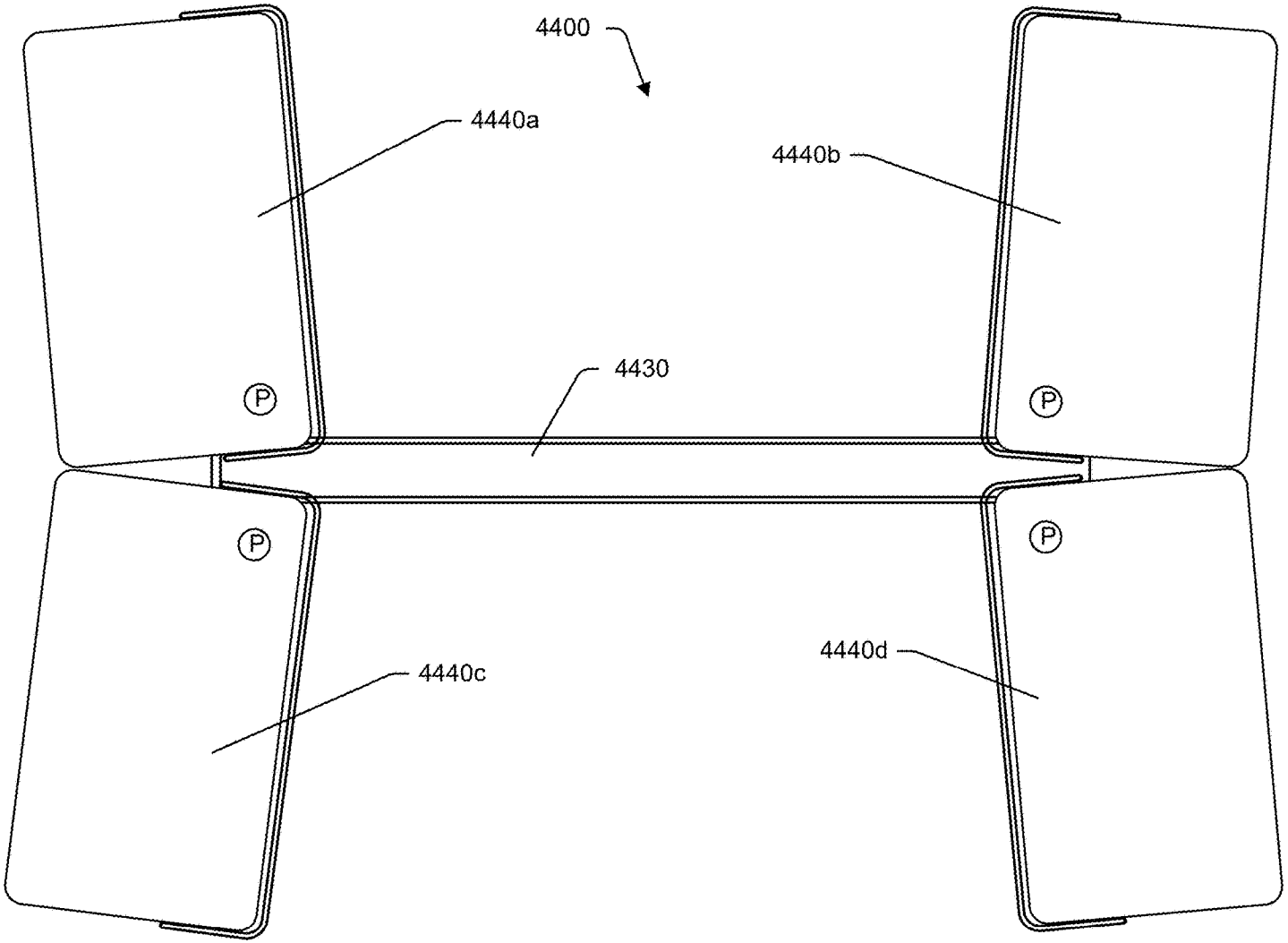
FIG. 46 is similar to FIG. 44 albeit where all four tops are in different rotational positions.

Referring to FIG. 45, tabletops 4440*a* and 4440*b* are shown rotated to intermediate positions that angled at about 45 degrees with respect to spine 4430 so that users of those tops can have at least some level or privacy. Referring to FIG. 46, all fourth tops 4440*a* through 4440*d* are shown at second limit positions where side edges of tops 4440*a* and 4440*c* are proximate and side edges of tops 4440*b* and 4440*d* are proximate. Here, each top is shown to rotate through slightly more than 90 degrees (e.g., the range of rotation is greater than 90 degrees) so that when in the second positions, the front edges of the tops angle slightly toward each other to form an obtuse angle (e.g., around 170 degrees) to enhance collaborative effect between users of adjacent tops.

Referring again to FIG. 46, it should be appreciated that two short spines may be used to replace the long spine shown so that the space between top pair 4440*a* and 4440*c* and top pair 4440*b* and 4440*d* when the tops are in the second limit positions can be unobstructed.

Figure 47:
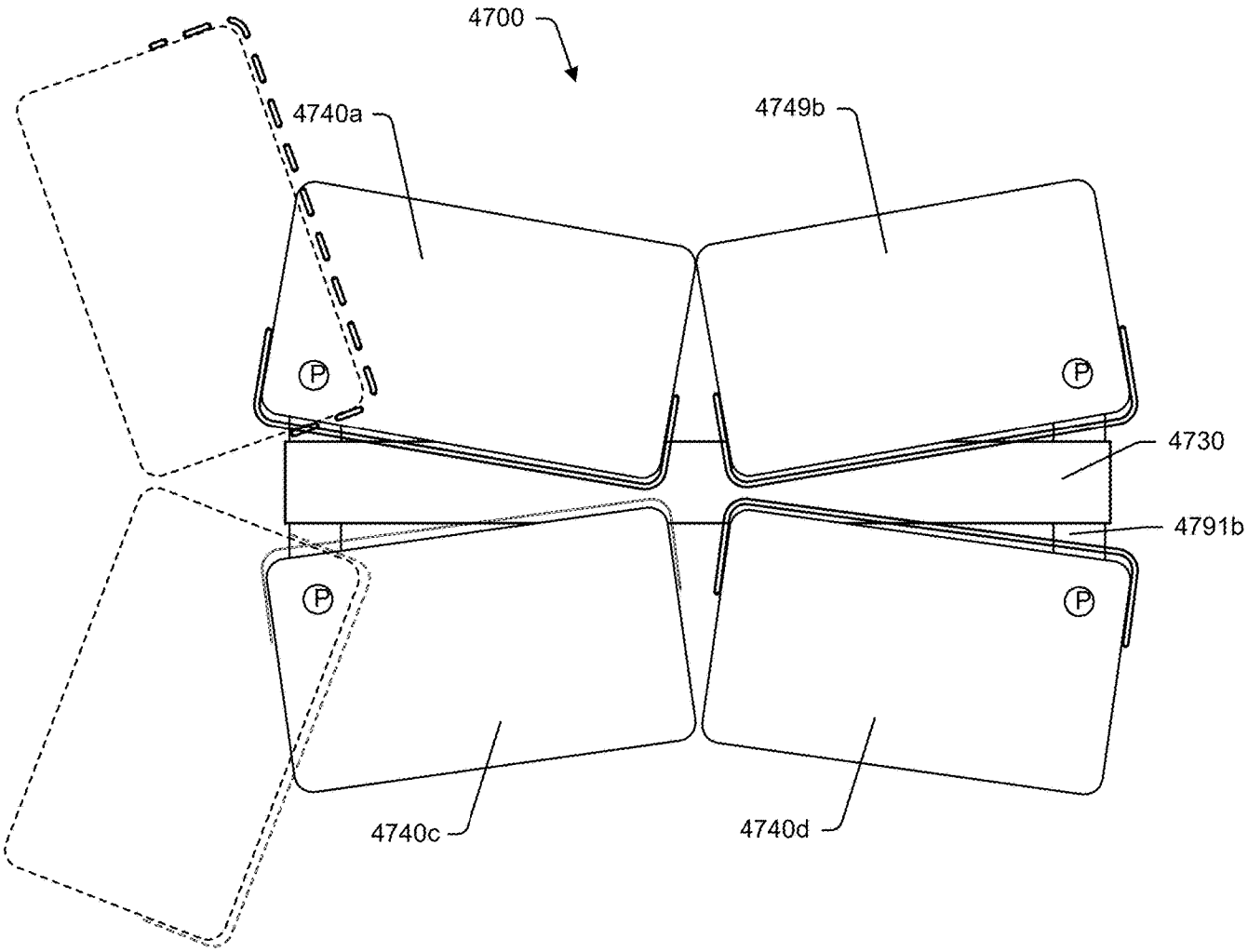
FIG. 47 is similar to FIG. 44, albeit where the tops can rotate through larger ranges of motion.

Referring now to FIG. 47, arrangement 4700 is like arrangement 4600 described above, the differences being that anchor members 4791*a* and 4791*b* in FIG. 47 are longer, the spine 4730 is longer and the ranges or motion between workstation limit positions are greater which enables the tops to rotate to angles where front edges of adjacent tops form smaller obtuse angles to better facilitate collaboration. Thus, tops 4740*a* and 4740*b* are shown in first limit positions where front edges thereof angle toward each other to afford better views of both tops 4740*a* and 4740*b* for users of both tops and tops 4740*c* and 4740*d* are shown in first limit positions where front edges thereof angle toward each other to afford better views of both tops 4740*c* and 4740*d* for users of both tops while tops 4740 and 4740*c* are shown in phantom in second limit positions with front edges thereof angled toward each other to a greater degree than possible in the arrangement 4400 shown in FIG. 46.

Figure 48:
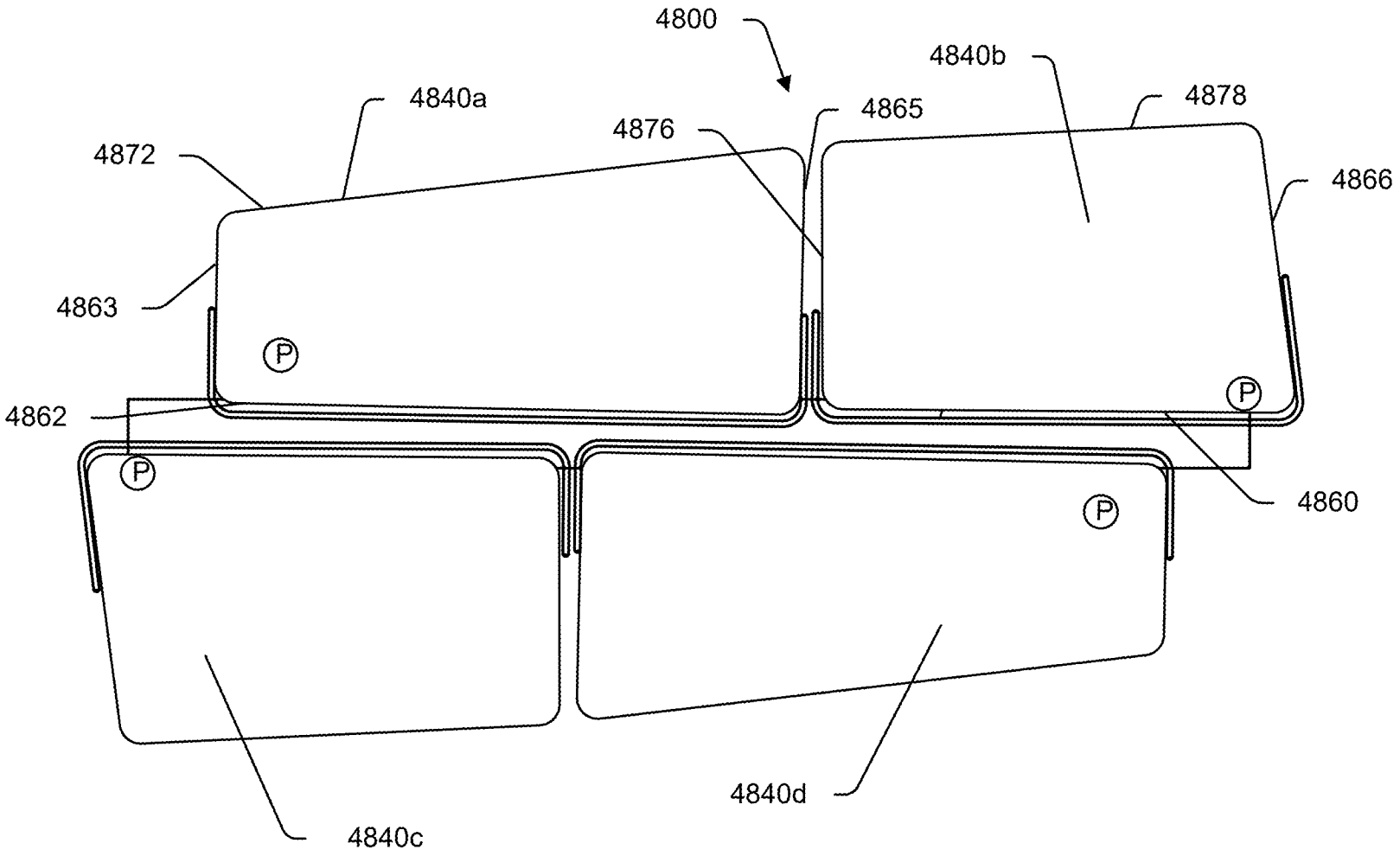
FIG. 48 is a top plan view of another station assembly with non-symmetrical tabletops.

The arrangement 4800 shown in FIG. 48 is like the arrangement in FIG. 44, albeit including two differently shaped tabletops. Two of the tops 4840*a* and 4840*d* have identical shapes that have a trapezoidal shape. Tops 4840*b* and 4840*c* have the same shape and are irregular quadrilateral in shape. Top 4840*a* has a straight rear edge 4863 and first and second parallel side edges 4863 and 4865 that extend at right angles from the rear edge. Side edge 4865 is longer than side edge 4863 and a straight front edge 4872 extends between distal ends of the side edges opposite the rear edge.

Top 4840*b* has a straight rear edge 4860, a first side edge 4876 that forms a right angle with the rear edge a second side edge 4866 opposite the first side edge that forms a slightly acute angle with the rear edge to angle slightly toward the first side edge and that is longer than the first side edge, and a straight front edge 4878 between distal ends for the side edges opposite the rear edge.

With tops 4840*a* through 4840*d* in first limit positions shown in FIG. 48, tops 4840*a* and 4840*b* have adjacent parallel side edges and substantially colinear front edges and are set up to facilitate collaboration between users of those tops while tops 4840*c* and 4840*d* have adjacent parallel side edges and substantially colinear front edges and are set up to facilitate collaboration between users of those tops. The tops 4840*a* through 4840*d* can rotate about their pivot legs at points P to any position between and including their first and second limit positions.

Figure 49:
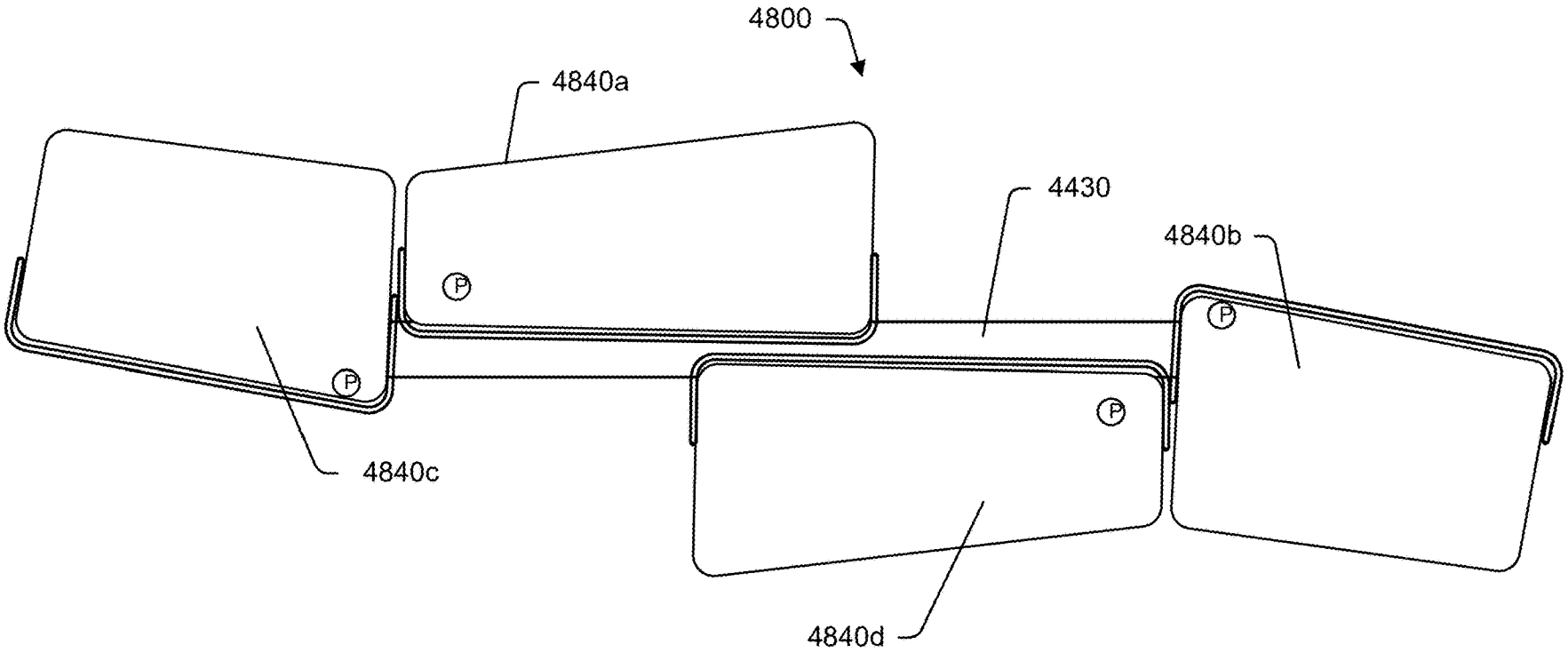
FIG. 49 is similar to FIG. 48, albeit showing two of the tops in other positions.
Figure 50:
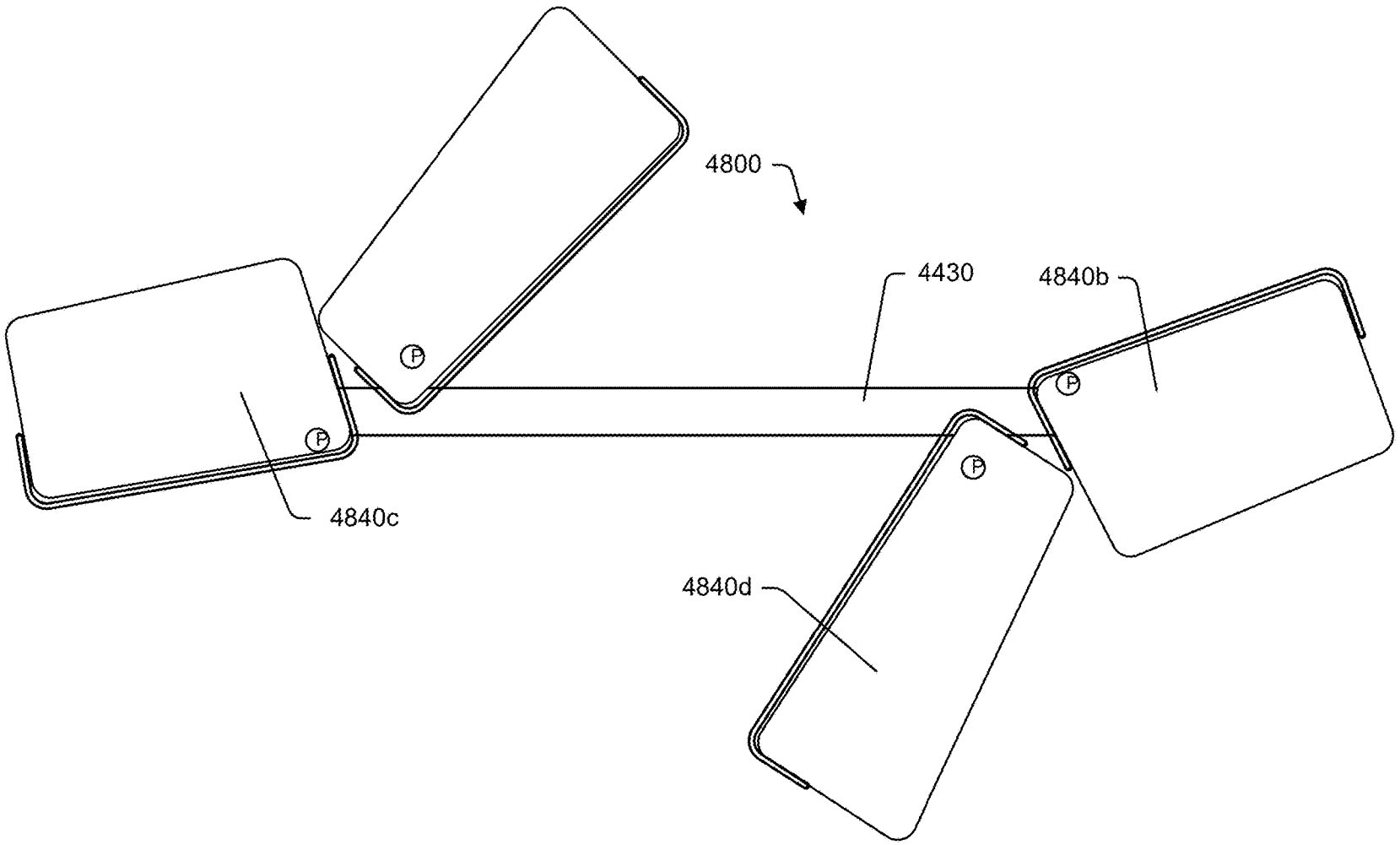
FIG. 50 is similar to FIG. 48, albeit showing all four tops in other positions.

Referring to FIG. 49, tops 4840*b* and 4840*c* are shown rotated to their second limit positions while tops 4840*a* and 4840*d* remain in their first limit positions. When the tops are so positioned, at least a front portion of one side edge of top 4840*c* is adjacent and proximate a side edge of top 4840*a* and at least a front portion of one side edge of top 4840*b* is adjacent and proximate a side edge of top 4840*d*. Thus, each of tops 4840*b* and 4840*c* can be positioned relative to a first other top or relative to a second other top for collaborative activities. FIG. 50 shows all of the tops 4840*a* through 4840*d* in intermediate positions where tops 4840*a* and 4840*c* are adjacent for collaborative work and tops 4840*b* and 4840*d* are also adjacent for collaborative work.

Figure 51:
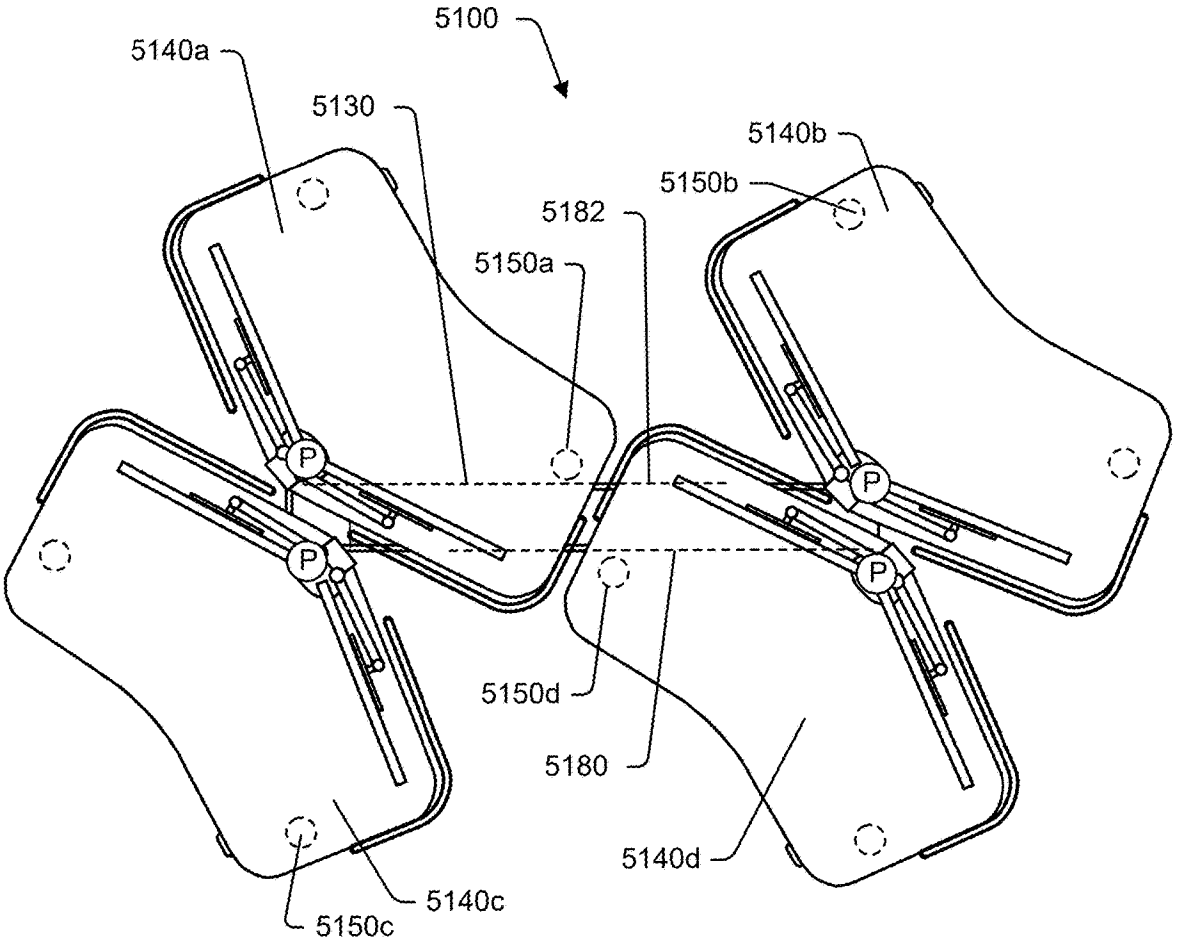
FIG. 51 is a top plan view of another assembly including four workstations.

In some embodiments it is contemplated that workstations will be anchored to a spine or other supporting stationary structure is such a way that the tabletops will be able to rotate as far as possible without causing the table legs or the tabletops to collide with the spine or other supporting structure. In this regard, see FIG. 51 where a workstation arrangement includes four workstation tops 5140*a* through 5140*d* anchored to a spine 5130 (primarily shown in phantom) where spine 5130 has first and second side panels that form first and second side surfaces 5182 and 5180, respectively. Again, the tabletops are anchored to rotate within a limit range about associated points labelled P. the front legs of each workstation are also shown in phantom with one of the first tabletop supporting legs labelled 5150*a* and one of the fourth tabletop supporting legs labelled 5150*d*. The tops are shown rotated into first limit positions where leg 5150*a* is immediately adjacent but slightly spaced from spine surface 5182 while leg 5150*d* is immediately adjacent but slightly spaced from spine surface 5180. While the legs associated with tabletops 5140*b* and 5140*c* are nowhere near the spine surfaces, the positions of those tops have to be limited so that those tops do not collide with tabletops 5140*a* and 5140*d* or associated workstation components. Here, it is contemplated that the rotation restricting assemblies would limit the first limit positions as shown. Clearly, the tops in this embodiment are rotatable to be substantially over the spine structure to the point where at least rear corners reside above space on opposite sides of the spine. The second limit positions would be similar to the first, albeit where the legs 5150*b* and 5150*c* are immediately adjacent yet slightly separated from surface 5182 and 5180, respectively.

Figure 52:
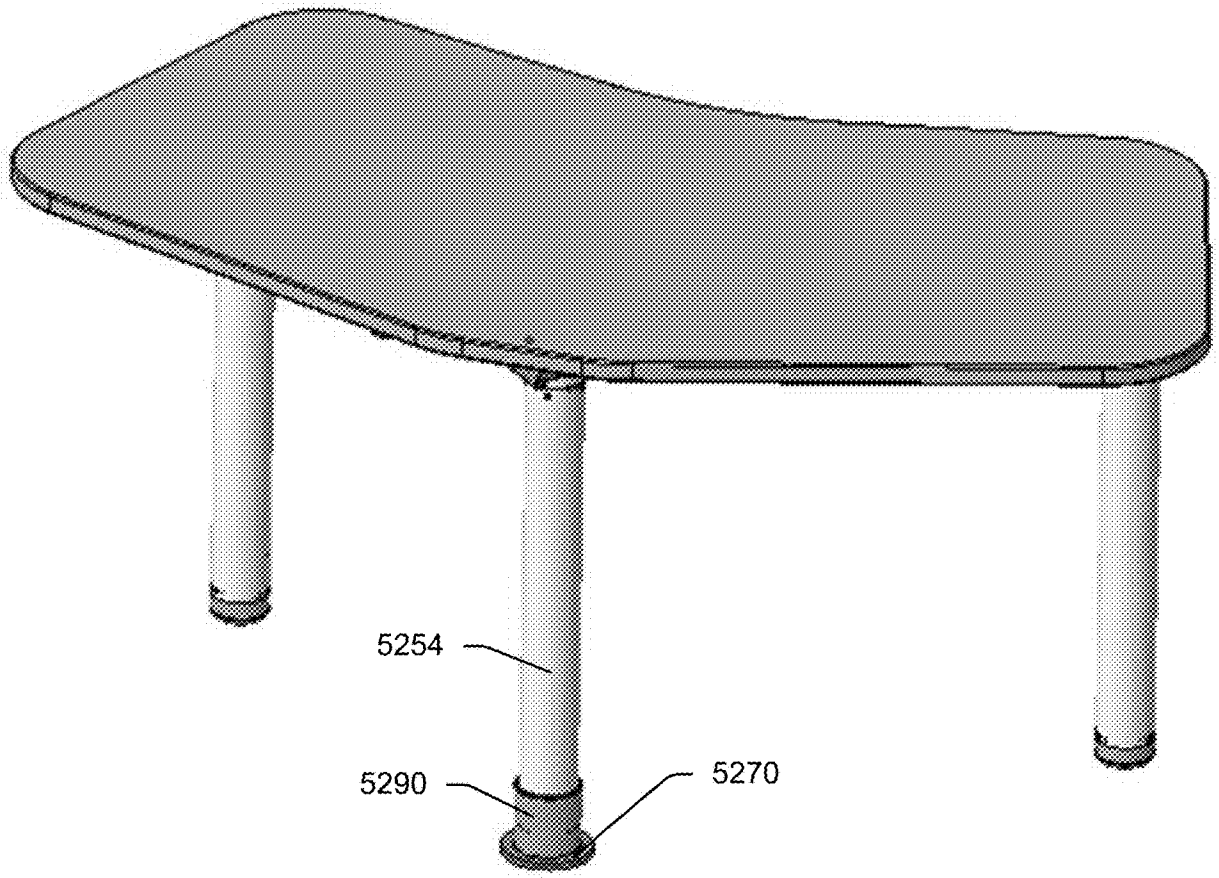
FIG. 52 is a perspective view of a workstation assembly that is consistent with some aspects of the present disclosure.
Figure 53:
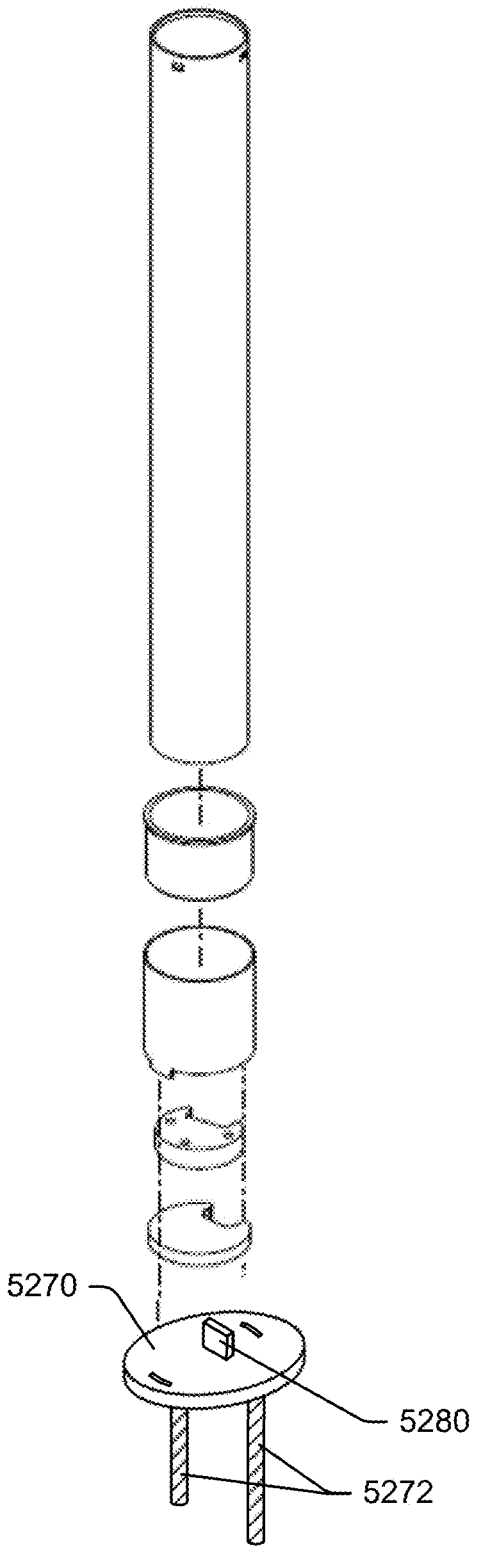
FIG. 53 is an exploded view of an anchor and rotation restricting mechanism that forms part of the assembly from FIG. 52.

It has been recognized that, in some embodiments, there is no need for a spine or other upright wall or dividing structure for anchoring a workstation leg and for limiting rotation of a workstation to a range or angles. Instead, in some cases, an anchor assembly may be attached directly to an ambient floor surface. In this regard, see FIG. 52 where an anchor assembly 5290 is secured to an ambient floor surface for anchoring a workstation leg at a location and limiting rotation about the anchored leg. Referring also to FIG. 53, the cup and rotation limiting mechanism in this embodiment is substantially identical to the mechanism described above with respect to FIG. 6 except that the anchor member or anchor plate 91 in FIG. 6 is replaced by an anchor disc 5270 that includes a rigid disc member 5270 having two threaded shafts 5272 extending out of an undersurface for securing the disc to an ambient floor. Disc 5270 forms slots for securing an assembly cup member and forms an upwardly extending limit tab 5280 like the limit tab described above with respect to FIG. 6. The rotation restricting mechanism in the FIGS. 52 and 53 embodiment operates in a fashion like that described above.

Referring again to FIG. 6, in at least some cases it is contemplated that a user or facilities manager may be able to quickly and inexpensively change the rotation restricting mechanism to modify the range of rotation of an associated workstation. In this regard, the only thing that needs to change to change the range of workstation rotation is the stop member 606. For instance, member 606 in FIG. 6 allows 40 degrees of rotation. To change the range of rotation to 90 degrees, a user can remove stop member 606 and replace it with another stop member that affords a larger range of rotation.

Figure 54:
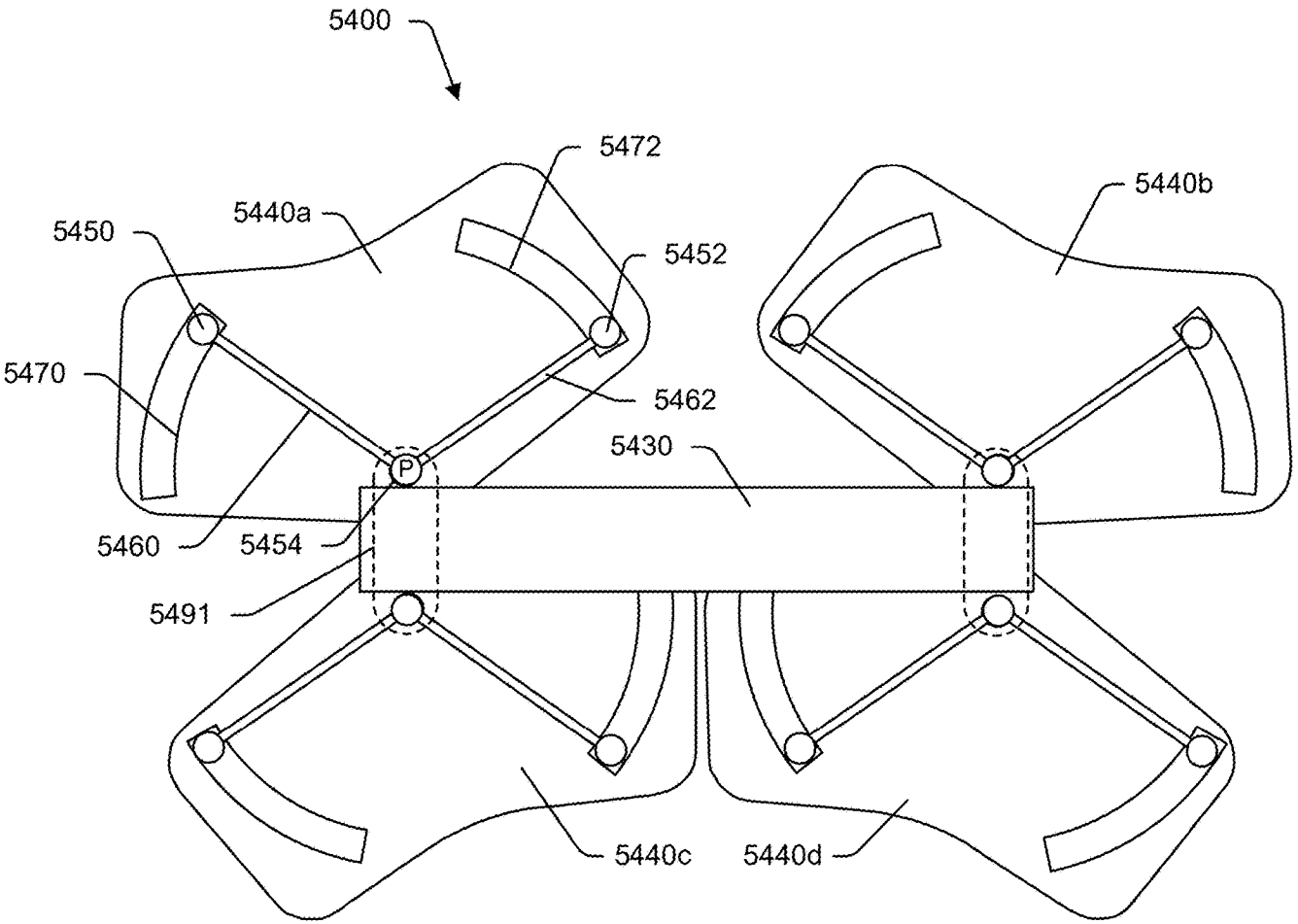
FIG. 54 is a bottom plan view of yet another workstation assembly including stationary legs and pivoting tabletops.

Other assemblies to facilitate tethered and restricted workstation rotation are contemplated. For instance, see the bottom plan view of workstation assembly 5400 in FIG. 54 that includes four workstation tabletops 5440*a* through 5440*d* that are anchored to a spine 5430 including tabletops 5440*a* and 5440*b* on a first side and tabletops 5440*c* and 5440*d* on a second side opposite the first side. In FIG. 54, all the workstations have s similar design and operate in a similar fashion and therefore only workstation 5440*a* is described in any detail.

Referring still to FIG. 54, workstation 5440*a* includes a rear leg 5454 and first and second lateral gels 5450 and 5452, respectively. Rear leg 5454 is anchored to spine 5430 via an anchor member 5491 shown in phantom and is restricted from rotating at its lower end. In this embodiment, the side legs 5450 and 5452 are also stationary and do not rotate with tabletop 5440*a*. In this regard, a first cross member 5460 is secured at opposite ends to legs 5450 and 5454 to lock relative positions of those legs and maintain both legs stationary and a second cross member 5462 is secured at opposite ends to legs 5452 and 5454 to lock relative positions of those legs and maintain both legs stationary with respect to spine 5430. Tabletop 5440*a* is mounted at the upper end of leg 5454 for pivoting rotation about a vertical axis at the location labelled P. First and second arcuate tracks 5470 and 5472 are provided on the undersurface of tabletop 5440*a* that each form a 40-degree arc about the pivot point P. the upper ends of legs 5450 and 5452 are received in the tracks 5470 and 5472, respectively, for sliding motion relative thereto about the arcs formed by the tracks. In this embodiment, the side legs form limit surfaces and opposite ends of the structure that forms the arcuate tracks form stop surfaces for limiting workstation rotation.

In FIG. 54, tabletops 5440*a* and 5440*b* are shown rotated away from each other in first limit positions where the legs abut end limit surfaces of the tracks and the workstations are separated and angled away from each other to afford privacy to workstation users. Tabletops 5440*c* and 5440*d*, on the other hand, are shown rotated toward each other to limit positions where adjacent edges are parallel and proximate to facilitate collaborative activity.

While both tracks 5470 and 5472 are shown to provide limit surfaces in FIG. 54, is some embodiments only one of the tracks may include limit surfaces. In other embodiments neither track may provide limit surfaces and instead a rotation limiting mechanism akin to those described above may be provided at the upper end of rear leg 5454 where tabletop pivoting occurs.

In still other cases, simple rollers may be provided at the upper ends of the side legs in FIG. 54 where the roller roll along the undersurface of tabletop 5440*a* as the top rotates about point P. In this case, the workstations may or may not include an arcuate track. In a case where workstations do not include an arcuate track, simple stop members may be provided at limit positions within the path followed by the rollers to limit tabletop rotation to desired ranges.

Figure 55:
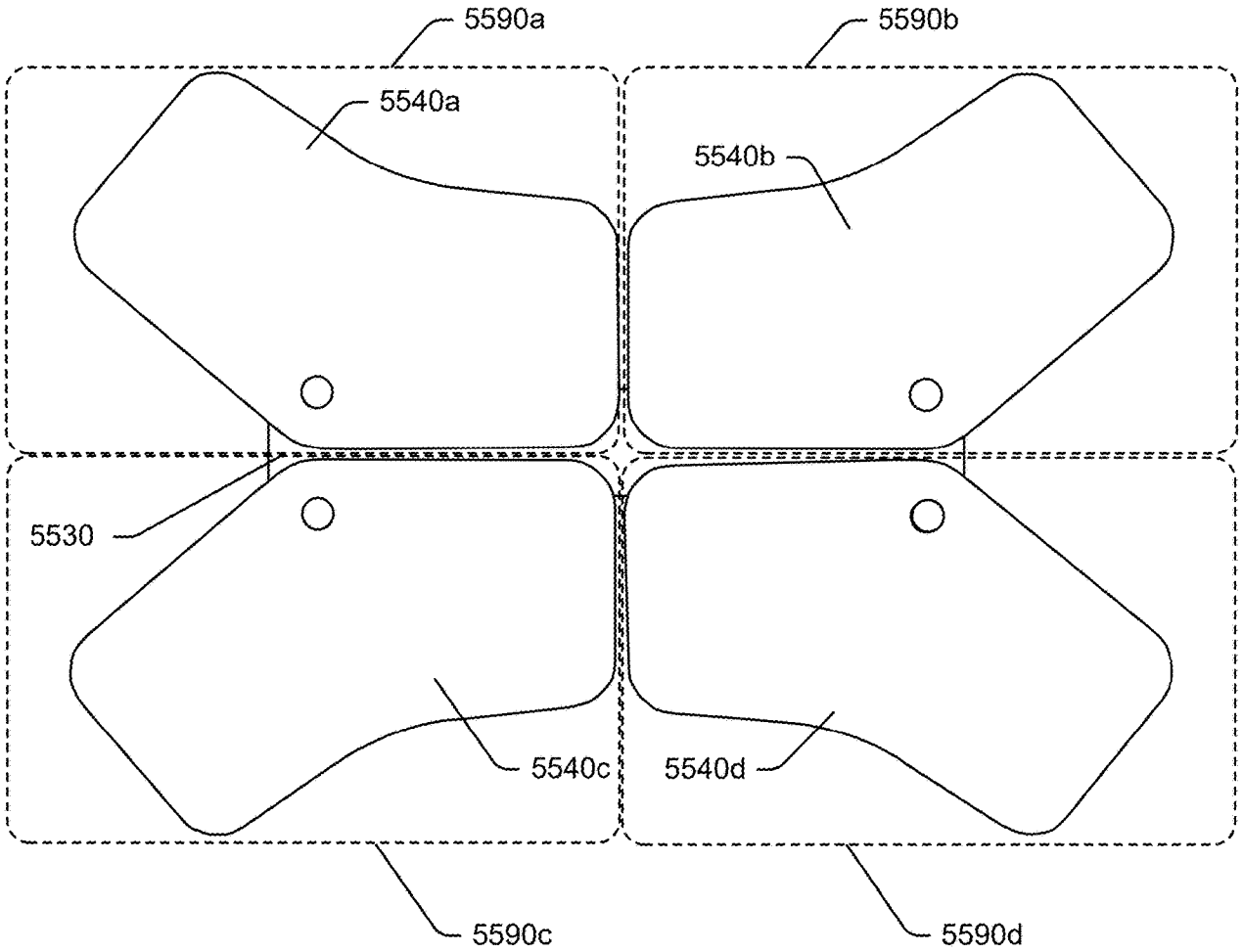
FIG. 55 is a top plan view of another assembly of workstations.

Assembly 5500 in FIG. 55 shows four workstation tabletops 5540*a* through 5540*d* where the workstations do not include privacy screens. In FIG. 55 the tops 5540*a* through 5540*d* are shown with rear inner corners of the tops rotated toward each other so that rear edge portions of all of the tops are located over the spine 5530 and are parallel and proximate. Here, the tops form a substantially contiguous top surface and this arrangement is particularly suitable for collaboration between users on opposite sides of the spine and across the spine.

While tabletops may be rotated into unoccupied overlapping spaces (e.g., spaces not currently occupied by other tabletops or workstation components) in some of the embodiments described above, in particularly advantageous embodiments tops are restricted to rotation within workstation specific spaces or areas that do not overlap to avoid collisions between workstation components. To this end, see again FIG. 55 where tops 5540*a* through 5540*d* are restricted to rotation within spaces or areas 5590*a* through 5590*d*, respectively.

While embodiments above anchor workstations via a spine, a panel wall or a floor secured anchor assembly, any type of stationary base structure may be used as an anchor structure.

Figure 56:
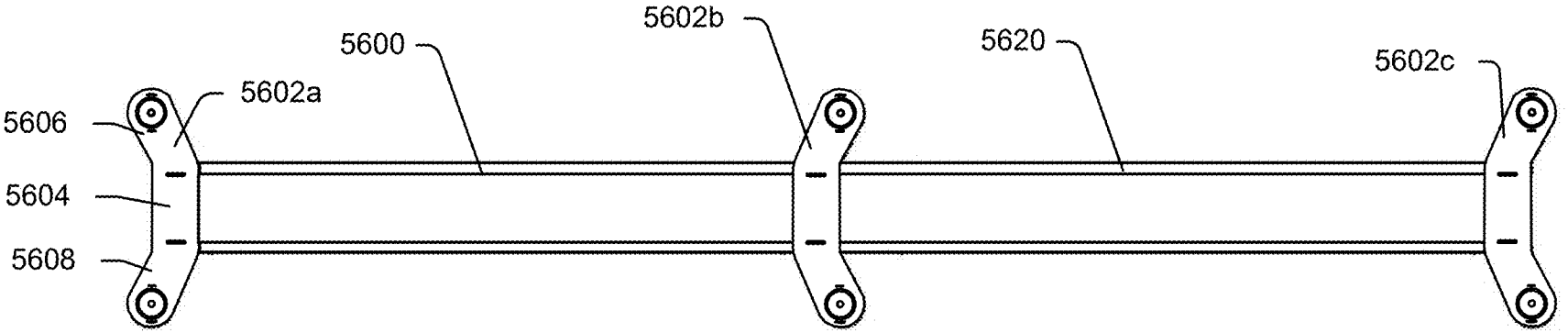
FIG. 56 is a bottom plan view of a spine assembly that is consistent with at least some embodiments contemplated by the present disclosure.

Referring to FIG. 56, another exemplary spine assembly 5600 is illustrated in a bottom plan view that that is like assembly 30 in FIGS. 3 and 5 and that includes an elongated spine subassembly 5620 and first, second and third foot or anchor members 5602*a*, 5602*b* and 5602*c*, respectively. Subassembly 5620 is like the assembly 30 described above and therefore is not described again here in detail. The anchor members are similar in construction and operation and therefore only anchor member 5602*a* is described in some detail. Anchor member 5602*a* is like the anchor members 91 described above, albeit where member 5602*a* includes a central or shoulder portion 5604 and first and second arm portions 5606 and 5608, respectively. Shoulder portion 5604 is an elongated member that extends perpendicular to the length of spine subassembly 5620 and is mounted to the underside of subassembly 5620 to operate as a stabilizing structure. Arm member 5606 extends from a first end of shoulder member 5604 at an approximately 40-degree angle with the length dimension of shoulder member 5604 while second arm member 5608 extends from a second end of shoulder member 5604 at an approximately 40 degree angle with the length dimension of shoulder member 5604 and to the same side as first arm member 5606 to form a shallow U-shaped anchor member 5602*a* when viewed from above or below. While not shown pivoting leg assemblies like those described above are mounted to distal ends of the first and second arm members.

Referring still to FIG. 56, anchor member 5602*a* is mounted to the underside of a first end of spine subassembly 5620, anchor member 5602*c* is mounted to the underside of a second end of spine subassembly 5620, and anchor member 5602*b* is mounted to an underside of spine subassembly 5620 near a central location. As illustrated, the arm members 5606 and 5608 extend in a direction generally away from the direction in which subassembly 5620 extends from shoulder member 5604 and arm members of anchor member 5602*c* extends in a direction away from anchor member 5602*a*. The shallow U-shaped anchor members have several advantages including increased stability and aesthetics. Regarding aesthetics, having workstations pivot about vertical axis that are spaces from the ends of spine subassembly 5620 tends to better obstruct views of the ends of the spine subassembly resulting in a better overall assembly appearance. Central anchor member 5602*b* has a shallow U-shape in bottom plan view identical to the shape of anchor member 5602*a* which allows for manufacturing a single anchor type component for use for all of the anchor members even though different anchor members extend in different directions (e.g., the arm members of anchor member 5602*a* extend in the opposite direction from which the arm members of anchor member 5602*c* extend). Because the arm members on anchor member 5602*b* extend at least somewhat along the length dimension of spine subassembly 5620 and the pivoting leg members mounted to the anchor members need to be equi-spaced along the length of subassembly 5620 for the workstation top members to rotate between preferred limit positions, anchor member 5602*b* is mounted slightly closer to anchor member 5602*a* than it is to anchor member 5602*c*.

Figure 57:
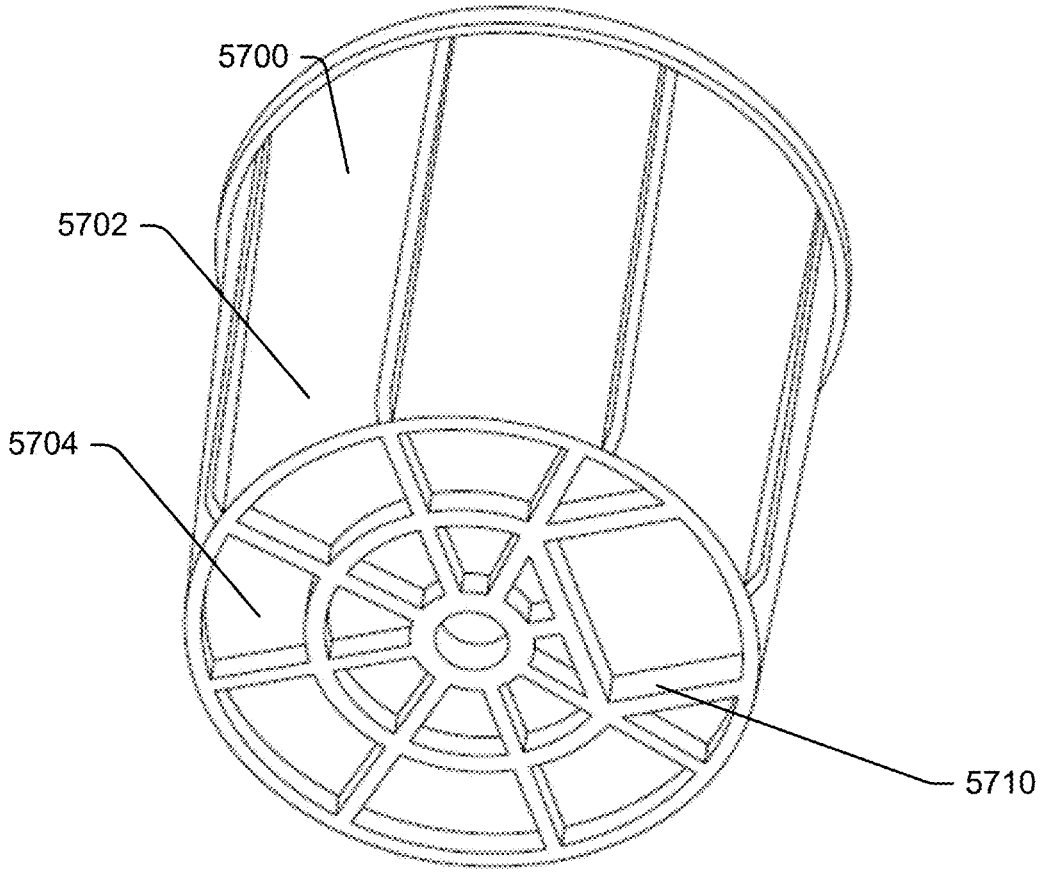
FIG. 57 is a perspective view of a bushing member that can be swapped in for two of the friction minimizing components described above in relation to FIG. 6.

Referring again to FIG. 6, while assembly 99 is described above as including a cylindrical bushing 602 and a separate friction plate 618, in other embodiments it is contemplated that bushing 602 and plate 618 may be formed as a single component. In this regard see exemplary bushing/plate member 5700 in FIG. 57 that includes a circular and flat plate member 5704 and a cylindrical bushing 5702 that extends in a single direction from a circumferential edge of plate member 5704. Member 5700 forms a slotted radial opening 5710 akin to the slot 620 formed in member 618 above (see again FIG. 6) and is open opposite plate member 5704 so that a lower end of a leg subassembly can be received within the cylindrical chamber formed by member 5700 for rotation about a vertical pivot axis as described in detail above.

Referring again to FIG. 2, in some embodiments, each worktop 40*a*, 40*b*, 40*c*, etc., is sized to support a user in a central position with respect to a front edge of the worktop. For instance, DO, which is a dimension between lateral rear edge corners of each worktop member in the FIG. 2 embodiment in some cases where the user is to be located centrally with respect to the top member may be within a range between 62 and 66 inches and, in a particularly advantageous embodiment, may be approximately 66 inches where a worktop depth dimension D7 between front and rear edges is between 23 and 26 inches and, in some embodiments is approximately 34 inches.

Figure 58:
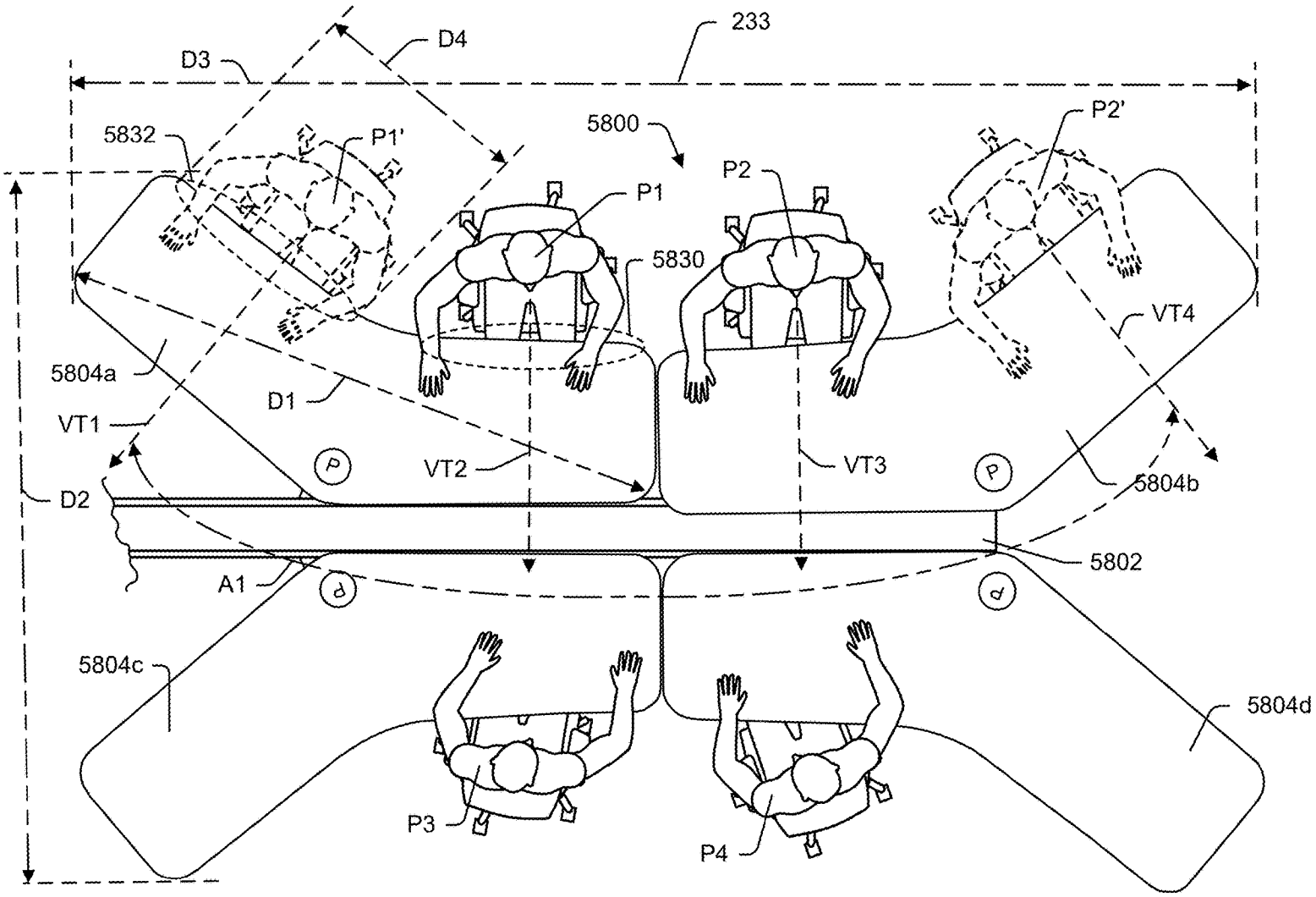
FIG. 58 is a top plan view of another workstation configuration that is consistent with at least some aspects of the present disclosure.

In other embodiments it is contemplated that each worktop may have a substantially larger rear corner to rear corner dimension with similar corner angles to those described above and illustrated in exemplary embodiments so that lengths of the straight edge sections of the front edge are longer and a user can assume decidedly different first and second positions adjacent either the left or the right straight edge sections of the front edge of a top member which facilitates even more user choice regarding work position relative to adjacent workstations/users. To this end, see FIG. 58 where another workstation configuration 5800 is illustrated that includes a spine assembly 5802 and first, second, third, and fourth relatively larger worktops 5804*a*, 5804*b*, 5804*c* and 5804*d*, respectively. Worktops 5804*a* and 5804*b* are mounted via rear pivoting legs (not labelled) to a first side of spine assembly 5802 at spaced apart locations such that when tops 5804*a* and 5804*b* are rotated toward each other as shown in FIG. 58 so that adjacent lateral edges are parallel, the lateral edges are in close proximity (e.g., ½-2 inches apart). Similarly, worktops 5804*c* and 5804*d* are mounted via rear pivoting legs (not labelled) to a second side of spine assembly 5802 opposite the first side at spaced apart locations such that when tops 5804*a* and 5804*b* are rotated toward each other as shown in FIG. 58 so that adjacent lateral edges are parallel, the lateral edges are in close proximity (e.g., ½-2 inches apart).

Referring still to FIG. 58, each worktop has a similar shape and therefore in the interest of simplifying this explanation, only top 5804*a* will be described in any detail. Top 5804*a* is similar in shape to the tops described above with respect to FIG. 8 in several respects. In this regard, top 5804*a* includes a rear edge, a front edge, and first and second lateral side edges that extend between the rear and front edges. Also, the rear edge includes first and second straight edge portions and a curved portion between the first and second straight edge portions where the first and second straight edge portions form a convex angle that is, in some embodiments, substantially 140-degrees (e.g., plus or minus 10 degrees). The front edge also includes first and second straight edge portions and a curved portion between the first and second straight edge portions where the first and second straight edge portions form a concave angle that is, in some embodiments, substantially 140-degrees (e.g., plus or minus 10 degrees). The first and second lateral side edges are each straight and they form a substantially 40-degree angle, angling or converging toward each other from the rear edge to the front edge. Curved corners are formed between the rear edge and each of the lateral side edges and between the front edge and the lateral side edges.

The main difference between the worktop 5804*a* in FIG. 58 and the top in FIG. 8 is that top 5804*a* extends laterally a greater distance such that the front and rear straight edge portions are longer. The elongated front straight edge sections enable a user to position herself at first and second different locations or positions along the front edge of top 5804*a*. More specifically, elongated front straight edge sections enable a user to assume a first position adjacent a left straight edge 5830 section as shown at position P1 or a second position adjacent a right straight edge section 5832 as shown at position P1'. Similarly, the extended length of worktop 5804*b* enables a user of that top to assume right and left positions along its front edge as illustrated at P2 and P2'. The different positions along the front edges combined with the pivoting features associated with each of the tops enables many different relative juxtapositions between users of configuration 5800.

In the interest of simplifying this explanation, the term "view trajectory" ("VT") will be used to refer to a direction or trajectory that is substantially perpendicular to a substantially straight front edge section of a worktop and that extends from the front edge toward the rear edge. For instance, in FIG. 58, a first view trajectory VT1 corresponds to a user at position P1' adjacent the right front edge section of top 5804*a* and is perpendicular to the right front edge section and extends from the front edge in the direction of the rear edge and a second view trajectory VT2 corresponds to a user at position P1 adjacent the left front edge section of top 5804*a* and is perpendicular to the left front edge section and extends from the front edge in the direction of the rear edge. Third and fourth view trajectories are labelled VT3 and VT4, respectively, in FIG. 58.

Referring again to FIG. 58, tops 5804*a* and 5804*b* are shown rotated toward each other with lateral side edges immediately adjacent each other. As shown, users of tops 5804*a* and 5804*b* can assume positions P1 and P2 and be immediately adjacent each other for dyadic two-person communication where the users have parallel view trajectories VT2 and VT3. With these view trajectories, the users at tops 5804*a* and 5804*b* can easily turn slightly toward each other to communicate or look forward to display screens while sharing information. Common view trajectories and close proximity facilitate dyadic communication.

When users want to work independently, they can assume positions P1' and P2' that are substantially spaced apart where they have view trajectories VT1 and VT4, respectively. Because of the angles between the different straight edge sections of each of the tops and the relative positions of the tops with respect to each other, VT1 and VT4 form an approximately 80-degree angle A1 in some embodiments and diverge from each other so that the users are generally juxtaposed to look in different directions which enhances a sense of privacy and reduces visual peripheral disturbances during individual work. The users are also spaced away from each other in positions P1' and P2' which further enhances a sense of privacy and minimizes distractions.

Referring still to FIG. 4, with tops 5804*c* and 5804*d* also rotated toward each other, users in adjacent positions P3 and P4 are adjacent each other and located across from users in positions P1 and P2, positions optimized for a four-person meeting or conversation. Each user of one of tops 5804*c* or

5804*d* can also assume positions at spaced apart locations along front edges of those tops if a more private sense of space is desired.

Referring to FIG. 58, in at least some cases a dimension D1 between rear side corners of top 5804*a* that is large enough to afford ample left and right positions along the front edge is within a range between 65 and 75 inches and, in some cases, is between 68 and 72 inches. In one embodiment dimension D1 is approximately 70 inches and each straight edge front section 5830 and 5832 of the top is between 20 and 24 inches and in some cases is approximately 22-23 inches. With a 70-inch dimension D1, a dimension D2 corresponding to a maximum width of assembly 5800 is approximately 89 inches and a minimum length dimension D3 between four tops (e.g., when tops on the same side of the spine are rotated toward each other) is substantially 137 inches.

Figure 59:
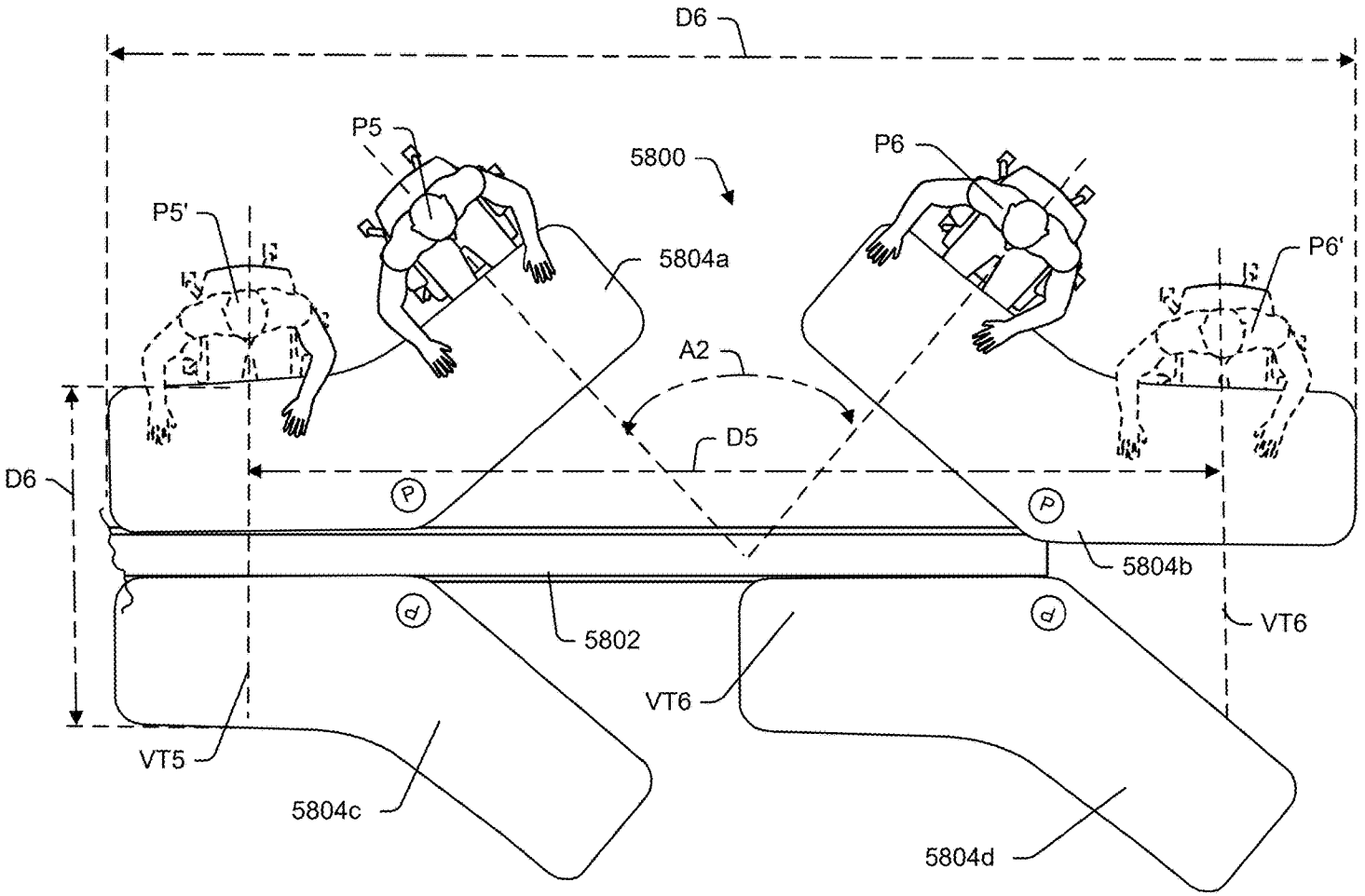
FIG. 59 is like FIG. 58, albeit showing workstations in different relative juxtapositions.

Referring now to FIG. 59, the configuration 5800 from FIG. 58 is illustrated again, albeit with the tops in different relative juxtapositions. More specifically, tops 5804*a* and 5804*b* are shown rotated away from each other and top 5804*c* is shown rotated away from top 5804*d*. In the FIG. 59 configuration a user at top 5804*a* can assume either of two different positions P5 or P5', adjacent left and right front edge sections of the top, respectively, while a user at top 5804*b* can assume either of two different positions P6 or P6', adjacent right and left front edge sections of the top, respectively. When the users are in positions P5 and P6, their view trajectories form a substantially 80-degree angle A2 like angle A1 shown in FIG. 58, albeit where the VTs intersect as opposed to diverge as in FIG. 58. In positions P5 and P6 the users are separated but nevertheless relatively close to each other and, at least peripherally have views of each other, ideal positions for individual work with intermittent dyadic communication. Contrast that juxtaposition with the one in FIG. 58 where users are in positions P1' and P2' where the users are outside of each other's peripheral vision so distractions are minimized.

Referring still to FIG. 59, users at tops 5804*a* and 5804*b* can also assume positions P5' and P6' where they have parallel view trajectories but are spaced apart from each other by a substantial distance D5 which is more than 3 times the distance between users when in positions P1 and P2 as shown in FIG. 58. In addition to being separated by space, users in positions P5' and P6' are separated by the unused halves of tops 5804*a* and 5804*b* which further and advantageously affords a sense of individual space.

Thus, referring again to FIGS. 58 and 59, a user at top 5804*a* can assume many positions with respect to users at other tops and, in particularly, can assume at least four distinct relative limit positions. In a first position P1 (FIG. 58) the user is proximate the space associated with an adjacent top 5804*b* and has a view trajectory VT2 that is perpendicular to the spine length which can be ideal for dyadic communication with a user at top 5804*b* when that user rotates her top 5804*b* toward top 5804*a*.

In a second position P1', with top 5804*b* still rotated toward the space associated with top 5804*b*, the user moves to the right front edge section of top 5804*a* and is spaced generally away from the space associated with adjacent top 5804*b* and has a view trajectory VT1 that is away from the space associated with top 5804*b* which can be ideal for independent work activities.

Referring to FIG. 59, with top 5804*a* rotated to the other limit position away from the space associated with top 5804*b*, a user can assume either third or fourth positions. In the third position P5, the user is again adjacent the left front edge section of top 5804*a*, this time however, with a view trajectory that is angled toward a central portion of the spine 5802 where the space associated with top 5804*b* is in the user's peripheral view. In this third position P5, the user can perform individual work yet still have a peripheral view of a second user at top 5804*b*. The longest combined dimension D6 of two tops rotated away from each other in at least some embodiments will be within a range between 140 and 160 inches and, in some embodiments, between 147 and 151 inches. In some embodiments dimension D6 is approximately 149 inches.

In fourth position P5', the user is again adjacent the right front edge section of top 5804*a*, this time however, with a view trajectory that is perpendicular to the spine length dimension and is spaced away from a second user within the space associated with top 5804*b*.

Figure 60:
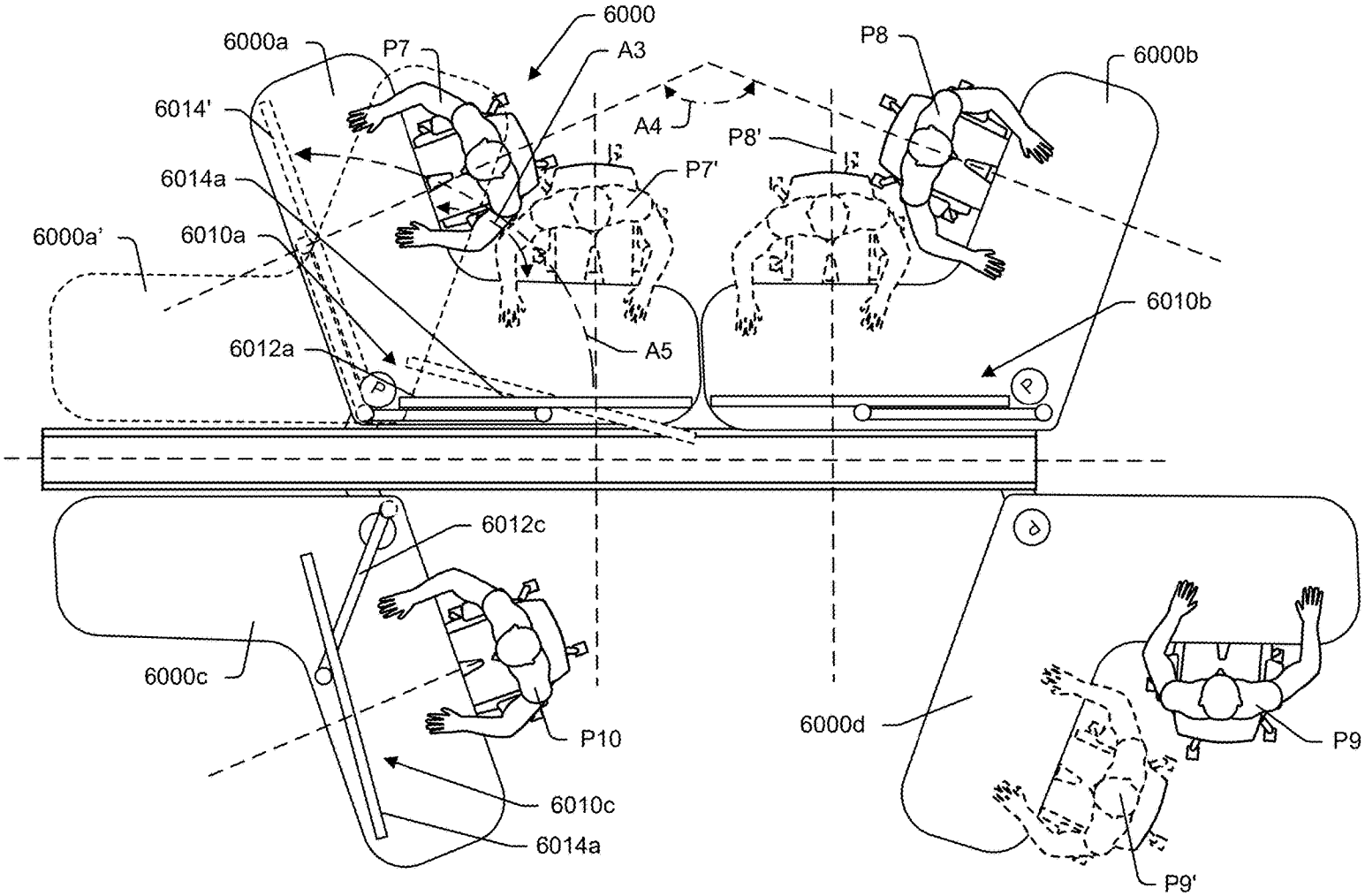
FIG. 60 is a top plan view of yet another workstation configuration that is like FIG. 58, albeit where the workstation worktops have a different shape and can be pivoted through a relatively larger range of rotational motion with respect to a supporting spine assembly.

Referring now to FIG. 60, yet another workstation configuration 6000 is illustrated that includes first through fourth worktops 6000*a*, 6000*b*, 6000*c* and 6000*d*, respectively, mounted via rear legs for pivoting rotation to a spine assembly. The tops 6000*a*-6000*d* are similar is shape and operate is a similar fashion and therefore only top 6000*a* is described here in any detail. Top 6000*a* is like top 5804*a* described with reference to FIGS. 58 and 59, albeit where an angle A3 formed between left and right straight front edge sections is between 65 and 80 degrees and, in some cases, is approximately 75 degrees. An angle formed between the left and right straight rear edge sections essentially mirrors the front edge angle (e.g., may be substantially 75 degrees in some embodiments). Top 6000*a* can be positioned as shown by solid lines rotated toward top 6000*b* or may be rotated to the position 6000*a'* shown in phantom lines in FIG. 60 where it is spaced from top 6000*b*. In this case, the pivoting leg assembly would be configured to allow rotation between first and second limit positions where the left rear straight edge section is parallel to a spine length dimension and where the right rear straight edge section is parallel to the spine length dimension, respectively. In the illustrated example the angle between the limit positions is approximately 75 degrees.

Referring again to FIG. 60, again, users can assume positions P7' and P8' at tops 6000*a* and 6000*b*, respectively, for close dyadic communication or can assume positions P7 and P8 for diverging spaced apart activities like individual focused work. In this case, the view trajectories of users in positions P7 and P8 diverge at an angle A4 that is around 130 degrees so that users are almost facing in opposite directions away from each other.

Referring again to FIG. 60, when one of the tops 6000*a*-6000*d* is rotated away from an adjacent top, a user has more juxtaposition options. To this end, see top 6000*d* that is rotated away from top 6000*c* where a user can choose between positions P9 and P9'. As in the FIG. 59 embodiment, here, position P9 orients a user along a view trajectory that is perpendicular to the length of the spine and the user is spaced a substantial distance away from a user at top 6000*c*. A user that chooses position P9' is spaced from a user at top 6000*c* but generally faces in the direction of top 6000*c* and therefore is positioned for individual work with the ability to participate in periodic dyadic communication with a user at top 6000*c* when desirable.

Referring yet again to FIG. 60, see that when top 6000*c* is rotated to a first limit position where a left rear edge section is parallel to the spine length, a user may also choose a position P10 adjacent the right rear edge section of the top if desired. While the user is shown at position P10, it should be appreciated that if top 1000*c* were rotated to the other limit position with the right rear edge section parallel to spine length, a user could choose a different position adjacent the left rear edge section of top 6000*c* if desired.

Referring still to FIG. 60, the larger angles between front edge sections and rear edge sections and larger rotational angle between limit positions is advantageous in some cases as the different positions a user can assume with respect to other workstations are more distinct and may be more advantageous.

Referring still to FIG. 60, each workstation may be equipped with a display assembly for displaying information to a user while also operating as a mechanical screen or visual barrier, three of which are labelled 6010*a*, 6010*b* and 6010*c*. In the illustrated embodiment all the display assemblies are similarly constructed and have similar dimensions and therefore, in the interest of simplifying this explanation, only assembly 6010*a* will be described here in detail.

Assembly 6010*a* includes a support arm 6012*a* and an electronic flat panel display 6014*a*. Arm 6012*a* is mounted for rotation about a vertical axis to worktop 6000*a* near the rear corner of top 6000*a* and, in at least some embodiments, is designed to rotate through at least a range of angles A5 between first and second positions where the arm length extends substantially parallel to the left and right rear edge sections of the top 6000*a* as shown in solid line and in phantom lines, respectively.

Display 6014*a* has a rectangular emissive surface for presenting information and data to a user and has a width dimension that is similar to the length of one of the left or right rear edge sections of top 6000*a* in some cases. The display 6014*a* is mounted to a distal end of arm 6012*a* for rotation about a second vertical axis. Arm 6012*a* enables a user to move display 6014*a* between various positions to accommodate user positions and privacy needs. To this end, see the solid line drawing of display 6014*a* in FIG. 60 where display 6014*a* is moved to a position that is essentially parallel to the left rear edge section of top 6000*a* either for personal use by a user in position P7' or for sharing content with a user in position P8'. For sharing content, display 1614 can rotate toward a user at position P8' (see phantom). Arm 6012*a* can be rotated to a second position where the arm 6012*a* is parallel to the right rear edge section and the display can be rotated to the position shown in phantom at 6014*a*' to face a user in position P7 when desired. In either position, the display 6014*a* operates as a sight blocking barrier and enhances a user's sense of privacy.

Referring still to FIG. 60, when a user positions herself at position P10 adjacent the right rear edge section of top 6000*c*, a display arm 6012*c* may be rotated to the position illustrated and display 6014*c* may be rotated to face the right rear edge section and the user at position P10.

To apprise the public of the scope of this invention, the following claims are made:

What is claimed is:

1. A reconfigurable assembly comprising:

a stationary base;

a workstation including a worktop forming a worksurface and an undersurface, the workstation supported by the base with the worksurface in a substantially horizontal orientation;

a mounting assembly securing the workstation to the base for rotation about a vertical axis passing through the base and the worktop, the mounting assembly including a first coupler secured to the base and a second coupler secured to the workstation wherein the first coupler forms first and second stationary limit surfaces within an arcuate path about the vertical axis that define a limit space having a first length dimension along the arcuate path, the second coupler forms first and second stop surfaces within the limit space having a second length dimension along the arcuate path that is less than the first dimension with the first and second stop surfaces facing the first and second limit surfaces along the arcuate path; and wherein, the workstation is rotatable about the vertical axis between a first limit position where the first stop surface contacts the first limit surface and a second limit position where the second stop surface contacts the second limit surface.

2. The reconfigurable assembly of claim 1 wherein the workstation further includes a leg having upper and lower ends, the lower end of the leg including the second coupler and affixed to the base for rotation about the vertical axis, the worktop secured to the upper end of the leg.

3. The reconfigurable assembly of claim 2 wherein the leg is height adjustable.

4. The reconfigurable assembly of claim 3 wherein the leg includes a lower leg member and an upper leg member, the lower leg member affixed to the base for rotation about the vertical axis, the upper leg member telescopically mounted to the lower leg member for movement between extended and contracted positions.

5. The reconfiguration assembly of claim 4 wherein an edge defines the shape of the worktop, the edge including a rear edge having a first substantially straight rear edge portion and a second substantially straight rear edge portion that form an obtuse angle and an apex adjacent the obtuse angle, the leg mounted to the undersurface of the worktop adjacent the apex.

6. The reconfiguration assembly of claim 5 wherein the first substantially straight rear edge portion is substantially parallel to a first vertical plane when the workstation is in the first limit position and the second substantially straight rear edge portion is substantially parallel to the first vertical plane when the workstation is in the second limit position.

7. The reconfigurable assembly of claim 5 wherein the edge further includes first and second substantially straight lateral edges that extend from distal ends of the first and second rear edge portions toward a front edge of the worktop and, wherein, the first and second substantially straight lateral edges angle toward each other from the rear edge toward the front edge such that the first lateral edge is substantially perpendicular to the first vertical plane when the worktop is in the first limit position and the second lateral edge is substantially perpendicular to the first vertical plane when the worktop is in the second limit position.

8. The reconfigurable assembly of claim 5 wherein the obtuse angle is within a range between 135 degrees and 145 degrees.

9. The reconfigurable assembly of claim 4 wherein the leg is a first leg, and the assembly further includes at least a second leg spaced from the first leg, the second leg height adjustable and controlled such that the worksurface remains substantially horizontal as height is adjusted.

10. The reconfigurable assembly of claim 9 including a caster at the lower end of the second leg.

11. The reconfigurable assembly of claim 1 wherein the base includes a stationary leg having upper and lower ends, the first coupler affixed to the upper end of the leg and the second coupler affixed to the undersurface of the worktop for rotation about the vertical axis.

12. The reconfigurable assembly of claim 1 wherein the base includes a cup structure having an undersurface and forming an upwardly opening cylindrical cavity, the cup structure mountable to an ambient floor surface with the undersurface adjacent the floor surface and the cup opening upward and centered along the axis of rotation.

13. The reconfigurable assembly of claim 1 wherein a range of rotation between the first and second limit positions is substantially 40 degrees.

14. A reconfigurable assembly comprising:

a stationary base;

a workstation including a worktop forming a worksurface and an undersurface, an edge defining the shape of the worktop, the edge including a rear edge having a substantially straight first rear edge portion and a substantially straight second rear edge portion that form an obtuse angle and an apex at the obtuse angle, wherein the workstation is supported by the base for rotation about a vertical axis through the base between first and second limit positions at which positions the workstation is limited from further rotation;

wherein, the first substantially straight rear edge portion is substantially parallel to a first vertical plane when the workstation is in the first limit position and the second substantially straight rear edge portion is substantially parallel to the first vertical plane when the workstation is in the second limit position.

15. The reconfigurable assembly of claim 14 wherein the base is affixed to an elongated spine subassembly having a length dimension and a width dimension perpendicular to the length dimension, the length dimension extending parallel to the first vertical plane.

16. The reconfigurable assembly of claim 15 wherein the first vertical plane divides the width dimension in half and wherein the first and second rear edge portions are adjacent the vertical plane when the workstation is in the first and second limit positions, respectively.

17. A reconfigurable assembly comprising:

a first stationary base;

a second stationary base adjacent the first stationary base;

a first workstation including a first worktop forming a first worksurface and an undersurface, an edge defining the shape of the first worktop, the edge including first and second adjacent and substantially straight edge portions that form a first angle, wherein the first workstation is supported by the first base for rotation about a vertical axis through the first base between first and second limit positions at which rotation of the first workstation is limited;

a second workstation including a second worktop forming a second worksurface and an undersurface, an edge defining the shape of the second worktop, the edge including third and fourth adjacent and substantially straight edge portions that form a second angle, wherein the second workstation is supported by the second base for rotation about a vertical axis through the second base between first and second limit positions at which rotation of the second workstation is limited;

wherein, the first edge portion is substantially parallel to and proximate the third edge portion when the workstations are in the first limit positions and the second edge portion is substantially parallel to and proximate the fourth edge portion when the workstations are in the second limit positions.

18. The reconfigurable assembly of claim 17 wherein the first and second edge portions are first and second rear edge portions of the first worktop that form an obtuse angle and wherein the third and fourth edge portions are first and second rear edge portions of the second worktop that form an obtuse angle.

19. The reconfigurable assembly of claim 18 wherein the obtuse angles are between 110 and 160 degrees.

20. A reconfigurable assembly comprising:

a first stationary base;

a second stationary base spaced from the first stationary base;

a first workstation including a first worktop forming a first worksurface and an undersurface, an edge defining the shape of the first worktop, the edge including a substantially straight first lateral edge, wherein the first workstation is supported by the first base for rotation about a vertical axis through the first base between first and second limit positions;

a second workstation including a second worktop forming a second worksurface and an undersurface, an edge defining the shape of the second worktop, the edge including a substantially straight second lateral edge, wherein the second workstation is supported by the second base for rotation about a vertical axis through the second base between first and second limit positions;

wherein, the first lateral edge is substantially parallel to and proximate the second lateral edge when the workstations are in the first limit positions and the first lateral edge is spaced from and forms an acute and with the second lateral edge when either one of the first and second workstations is in a position other than the first limit position.

* * * * *